US012484702B2

(12) United States Patent
Lawson

(10) Patent No.: US 12,484,702 B2
(45) Date of Patent: Dec. 2, 2025

(54) ARTICLE OF FURNITURE

(71) Applicant: Ryan Lawson, Bellevue Hill (AU)

(72) Inventor: Ryan Lawson, Bellevue Hill (AU)

( * ) Notice: Subject to any disclaimer, the term of this patent is extended or adjusted under 35 U.S.C. 154(b) by 508 days.

(21) Appl. No.: 17/776,885

(22) PCT Filed: Nov. 16, 2020

(86) PCT No.: PCT/AU2020/000131
§ 371 (c)(1),
(2) Date: May 13, 2022

(87) PCT Pub. No.: WO2021/092642
PCT Pub. Date: May 20, 2021

(65) Prior Publication Data

US 2022/0400865 A1 Dec. 22, 2022

(30) Foreign Application Priority Data

Nov. 15, 2019 (AU) ..... 2019904315
Dec. 19, 2019 (AU) ..... 2019904839
Feb. 25, 2020 (AU) ..... 2020900535

(51) Int. Cl.

| | |
|---|---|
| ***A47C 13/00*** | (2006.01) |
| ***A47B 83/02*** | (2006.01) |
| ***A47C 4/02*** | (2006.01) |
| ***A47C 7/32*** | (2006.01) |
| ***A47C 7/54*** | (2006.01) |
| ***A47C 7/68*** | (2006.01) |
| ***A47C 17/34*** | (2006.01) |

(52) U.S. Cl.
CPC ..... *A47C 13/005* (2013.01); *A47B 83/02* (2013.01); *A47C 4/022* (2013.01); *A47C 4/028* (2013.01); *A47C 7/705* (2018.08)

(58) Field of Classification Search
CPC ..... A47C 13/005; A47C 4/022; A47C 4/028; A47C 7/705; A47C 7/42; A47C 7/546; A47B 83/02
USPC ..... 297/115, 118, 130, 144, 411.2, 297/440.14–440.16
See application file for complete search history.

(56) References Cited

U.S. PATENT DOCUMENTS 2,466,204 A * 4/1949 Brown ..... A47C 17/045 297/440.16
2,784,769 A * 3/1957 Fisher ..... A47C 1/023 248/188

(Continued)

FOREIGN PATENT DOCUMENTS

AU 2012203573 A1 1/2013
AU 2014200058 A1 7/2014

(Continued)

*Primary Examiner* — Robert Canfield
(74) *Attorney, Agent, or Firm* — Hayes Soloway P.C.

(57) ABSTRACT

An article of furniture includes a seat assembly that includes a rectangular seat support frame and a rest mount arranged on each of at least two adjacent sides of the seat support frame. A rest assembly includes a rectangular rest support frame and a seat mount arranged on at least one side of the rest support frame. The article of furniture includes at least one elongate connector, the, or each, elongate connector having a first portion that is engageable, in a detachable manner, with either of the rest mounts, and a second portion that is engageable, in a detachable manner, with the seat mount.

21 Claims, 35 Drawing Sheets

(56) References Cited

U.S. PATENT DOCUMENTS

| | | | | |
|---|---|---|---|---|
| 4,488,755 | A * | 12/1984 | Nemschoff | A47C 4/028 297/440.22 |
| 5,000,512 | A * | 3/1991 | Laird | A47C 4/028 297/440.22 |
| 5,542,743 | A * | 8/1996 | Olson | A47C 4/02 297/411.27 |
| 6,616,234 | B1 * | 9/2003 | King | A47C 7/42 297/440.16 |
| 8,764,114 | B1 * | 7/2014 | Frank | A47C 7/42 297/440.16 |
| 11,930,930 | B1 * | 3/2024 | Zhao | A47C 13/005 |
| 12,185,837 | B2 * | 1/2025 | Altemimei | A47C 17/04 |
| 2004/0041453 | A1 * | 3/2004 | Ellis | A47D 1/002 297/445.1 |
| 2008/0136244 | A1 * | 6/2008 | Cheng | A47C 7/546 297/411.26 |
| 2013/0341992 | A1 * | 12/2013 | King | A47C 13/005 403/361 |
| 2016/0174715 | A1 * | 6/2016 | Nelson | A47C 17/045 297/440.14 |
| 2016/0262542 | A1 * | 9/2016 | Chung | A47C 7/546 |
| 2020/0187654 | A1 * | 6/2020 | Mutyala | F16B 12/60 |
| 2023/0270252 | A1 * | 8/2023 | Shih | A47C 17/02 297/440.11 |
| 2023/0270258 | A1 * | 8/2023 | Shih | A47C 4/028 297/440.11 |
| 2023/0284779 | A1 * | 9/2023 | Lee | A47C 13/005 |
| 2024/0023715 | A1 * | 1/2024 | Chen | A47C 4/02 |
| 2024/0108145 | A1 * | 4/2024 | Armond | A47C 13/005 |
| 2024/0358156 | A1 * | 10/2024 | Wu | A47C 7/546 |

FOREIGN PATENT DOCUMENTS

| | | | |
|---|---|---|---|
| AU | 2017101633 | A4 | 12/2017 |
| CN | 106763046 | A | 5/2017 |
| DE | 29605147 | U1 | 8/1996 |

* cited by examiner 18
148

158
158

162
160

163
164
150
148
146
169
152
148

146
165
146
148

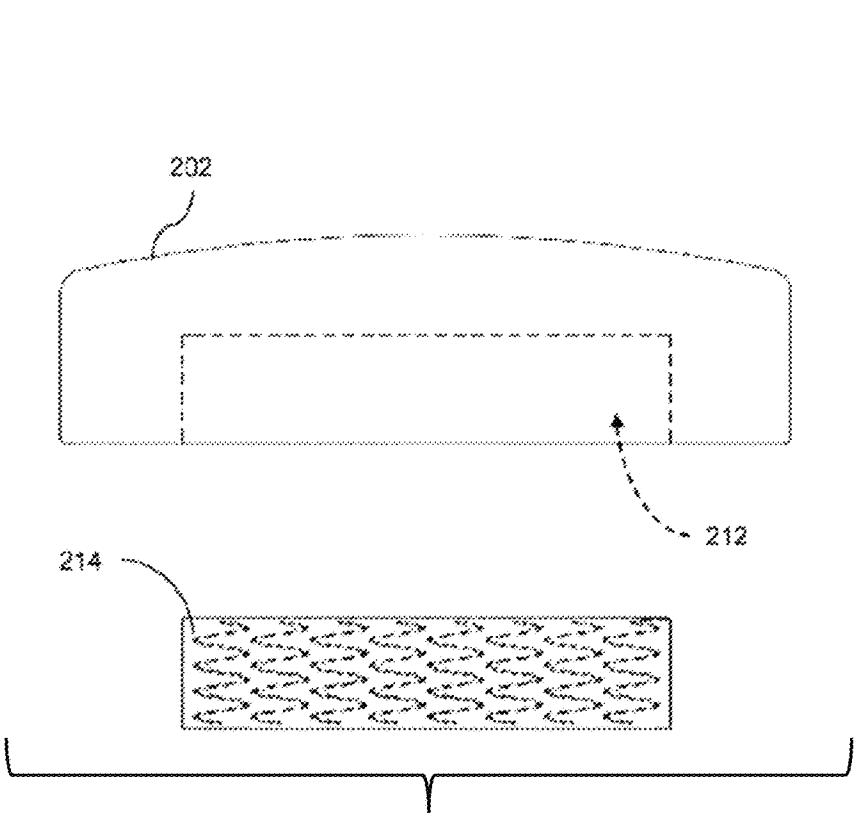
Figure 53
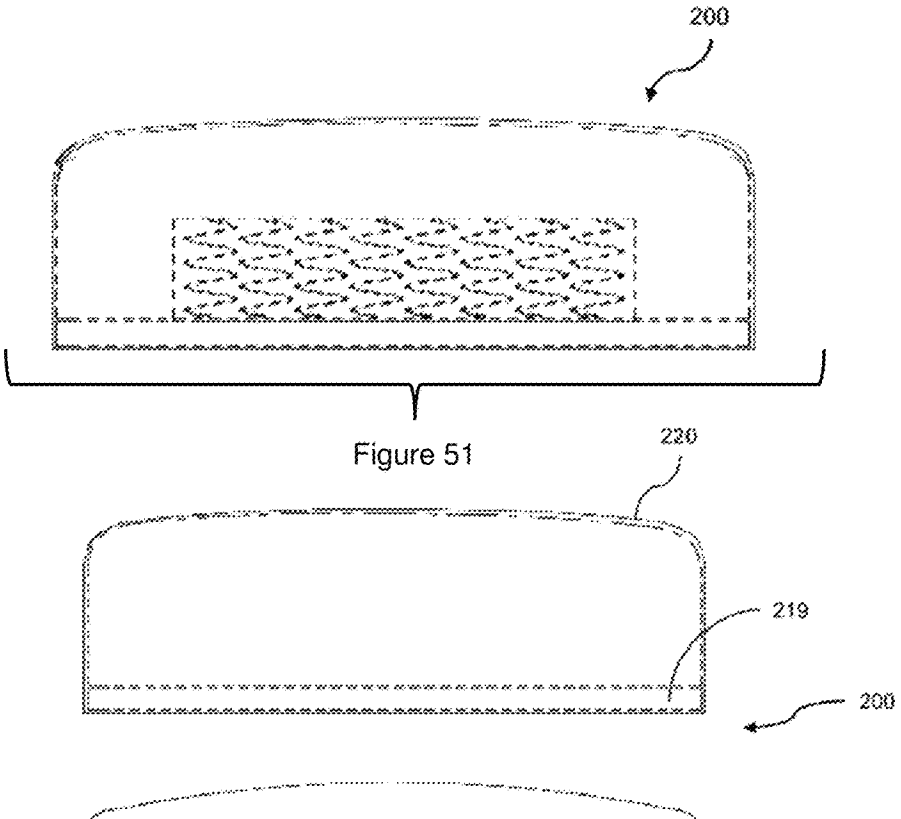
Figure 51
Figure 52

ARTICLE OF FURNITURE

CROSS-REFERENCE TO RELATED APPLICATIONS AND PRIORITY

This patent application claims priority from PCT Application No. PCT/AU2020/000131 filed Nov. 16, 2020, which claims priority from Australian Patent Application Nos. 2019904315 filed Nov. 15, 2019, 2019904839 filed Dec. 19, 2019 and 2020900535 filed Feb. 25, 2020. Each of these patent applications are herein incorporated by reference in their entirety.

FIELD OF THE INVENTION

This invention relates to an article of furniture.

BACKGROUND OF THE INVENTION

It is known that the residential rental market is growing significantly. Generally, currently available articles of furniture, such as sofas, lounge suites, beds and the like do not meet the needs of renters. For example, it can be difficult to reconfigure or refashion such articles of furniture to fit different living areas as renters move from place to place. Such articles of furniture can be difficult to move and often require removalists and are difficult to fit in elevators and corridors. Retail overheads, inefficient shipping, manufacturing and warehouses can exert an upward pressure on the costs of such articles of furniture. It can also be difficult to warehouse wide product ranges in an economic manner. This results in lengthy lead times, making such articles of furniture unavailable when needed by renters.

Residential spaces are growing smaller, particularly close to urban centres. Young urban professionals are becoming more mobile and are making use of rented residential spaces, close to urban centres, between which they can move more often than previous generations. These residential spaces are often in high-rise buildings which can make it difficult to move furniture. Furthermore, it is often necessary for the furniture to be replaced with smaller or larger furniture or even left behind, with the result that more furniture needs to be purchased when moving. As a result, there may be a tendency for relatively cheap, low quality articles of furniture to be selected, which will fill their present, but not their future, needs. This furniture is often simply discarded, which is not environmentally-friendly.

In addition, smaller residential spaces can be challenging to furnish with articles of furniture that cannot be customised to suit certain spaces. For example, furniture that fits one living room may not fit a subsequent living room.

SUMMARY OF THE INVENTION

According to a first aspect of the invention, there is provided an article of furniture that comprises:

- a seat assembly that includes:
  - a rectangular seat support frame; and
  - a rest mount arranged on each of at least two adjacent sides of the seat support frame;
- a rest assembly that includes:
  - a rectangular rest support frame; and
  - a seat mount arranged on at least one side of the rest support frame; and
- at least one elongate connector, the, or each, elongate connector having a first portion that is engageable, in a detachable manner, with either of the rest mounts, and

- a second portion that is engageable, in a detachable manner, with the seat mount, the, or each, elongate connector and the rest and seat mounts being configured so that the, or each, elongate connector is reversible to provide at least two orientations of the seat frame assembly relative to the rest frame assembly, so that the rest assembly can function either as a backrest or an armrest of the article of furniture.

The article of furniture can include any number of seat frame assemblies and rest frame assemblies together with an appropriate number of elongate connectors. Thus, the article of furniture can take various forms depending on the selection of orientation of the seat and rest frame assemblies relative to each other. For example, a two-seater sofa could include two seat frame assemblies and four rest frame assemblies. A consumer could easily upgrade to a three-seater sofa by simply purchasing another seat frame assembly and rest frame assembly. The consumer could also elect to convert the article of furniture to a chaise lounge by appropriate orientation and connection of the seat and rest frame assemblies. In addition, a suitable number of the seat and rest assemblies could be provided so that the sofa could be augmented to include a chaise return on either side of the sofa. It follows that the consumer is not required to purchase an entire new article of furniture and find a way of disposing of an older article of furniture that may not have the desired configuration or size when the consumer moves residences or wishes to move the article of furniture from one room to another.

The portions of the elongate connector may be oriented at an angle relative to each other to govern an orientation of the rest support frame relative to the seat support frame. An included angle defined by the portions may be less than or equal to 90°.

The seat support frame may include four seat frame members that are connected at their ends to define the sides of the seat support frame. The frame members may be configured so that the seat support frame is square. Instead, two opposed frame members may be longer than the remaining frame members so that the seat support frame is elongate.

Each rest mount may include at least two spaced sleeve assemblies mounted on the respective frame member. In other embodiments, one or two of the frame members may be without sleeve assemblies. Each sleeve assembly may be configured to receive either of the portions of the elongate connector. At least one portion of each elongate connector may be releasably engageable with the sleeve assembly.

The sleeve assembly may include a sleeve and a releasable locking assembly to lock the at least one portion of the elongate connector within the sleeve. The at least one portion of the elongate connector may define one or more recesses or grooves. The releasable locking assembly may include a catch mechanism that is configured to engage the, or either of the, recesses or grooves. The catch mechanism may include a spring-operated catch member so that, when the portion is received in the sleeve assembly, the catch member can be biased into the, or one of the, recesses. The, or each, recess may be positioned so that manipulation of the elongate connector can disengage the catch member from the associated recess. Instead, or in addition, the catch mechanism can be manually operable to move the catch member, against a spring bias, out of the recess.

The rest support frame may include four rest frame members in the form of two opposed side frame members, a bottom frame member that interconnects lower ends of the side frame members and an intermediate member that interconnects the side frame members. The rest frame members may be configured so that the rest support frame is square or elongate.

The seat mount may include at least two spaced receiver assemblies mounted on one of the rest frame members. Each receiver assembly may include a sleeve assembly. Either of the portions of the elongate connectors can be received in the sleeve assemblies of the seat mount. Thus, the rest support frame can be connected to the seat support frame with each of the portions of the elongate connectors being received in respective sleeve assemblies of the rest and seat mounts.

Each receiver assembly may include a socket assembly. The socket assemblies may open operatively downwardly and may be positioned to be in substantial front to back alignment with the sleeve assemblies of the receiver assemblies. Thus, either of the portions of the elongate connectors can be received in the socket assemblies of the seat mount. The socket assembly and sleeve assembly of each receiver assembly may diverge downwardly with the sleeve assembly being positioned in front of the socket assembly.

The article of furniture may include at least two legs, each leg having an elongate body that defines at least one substantially flat face so that two legs can be positioned together with their faces in alignment and facing each other. A connector may be arranged on an operatively upper end of each leg so that the leg can be connected to the seat support frame such that, when two of the seat support frames are adjacent each other to form a two-seat arrangement, the flat faces of corresponding legs on each of the support frames are in alignment and face each other.

The article of furniture may include a table assembly which includes a tabletop. A support member may engage the tabletop, to support the tabletop at a suitable height and may have an operatively, substantially vertical support post and a leg that extends from the support post, the leg being detachably engageable with the rest mount with the support post extending operatively upwardly from the leg. An elongate bracing member may extend from the support member and may also be detachably engageable with the rest mount to brace the table assembly against pivotal movement.

The article of furniture may include two corner members arranged on respective sides of the rest support. Each corner member may have a corner-defining structure and may be configured so that the corner-defining structure can bear against an inner surface of a cover of a cushion assembly positioned on the rest support, at a lower edge of the cushion assembly, to neaten the cover at a lower front edge and outside corner of the article of furniture.

Each corner member may be in the form of a swing bracket that is pivotally mounted on each end of a bottom frame member of the rest support frame. The swing bracket may be pivotal between an inoperative position in which the swing bracket is stowed operatively below the rest support frame and an operative position in which the swing bracket is pivoted outwardly away from the rest support frame to bear against the inner surface of the cover of the cushion assembly.

The article of furniture may include a connecting system for connecting the seat assemblies together, the connecting system including:

at least one sleeve assembly that is arranged on the seat support frame, the, or each, sleeve assembly including a sleeve that defines a passageway, the, or each, sleeve assembly being positioned on the seat support frame so that two seat assemblies can be positioned adjacent each other with the passageways of respective sleeve assemblies in alignment;

at least one elongate connector, the, or each, connector including a locking portion that is receivable through a respective pair of aligned passageways; and a locking arrangement that is arranged on the, or each, sleeve assembly, the locking arrangement and the, or each, connector being configured so that the locking portion can be releasably locked in the passageway, such that the seat support frames of the adjacent seat assemblies can be locked to each other, with the locking portion received through aligned passageways, in a releasable manner.

According to a second aspect of the invention, there is provided a kit for an article of furniture, the kit comprising:

a seat assembly that includes:

a rectangular seat support frame; and a rest mount arranged on each of at least two adjacent sides of the seat support frame;

a rest assembly that includes:

a rectangular rest support frame; and a seat mount arranged on at least one side of the rest support frame; and at least one elongate connector, the, or each, elongate connector having a first portion that is engageable, in a detachable manner, with either of the rest mounts, and a second portion that is engageable, in a detachable manner, with the seat mount, the, or each, elongate connector and the rest and seat mounts being configured so that the, or each, elongate connector is reversible to provide at least two orientations of the seat frame assembly relative to the rest frame assembly, so that the rest assembly can function either as a backrest or an armrest of the article of furniture.

According to a third aspect of the invention, there is provided a table assembly for an article of furniture having a seat assembly with a rectangular seat support frame having a rest mount arranged on each of at least two adjacent sides of the seat support frame, a rest assembly with a rectangular rest support frame having a seat mount arranged on at least one side of the rest support frame, and at least one elongate connector, the, or each, elongate connector having a first portion that is engageable, in a detachable manner, with either of the rest mounts, and a second portion that is engageable, in a detachable manner, with the seat mount, the, or each, elongate connector and the rest and seat mounts being configured so that the, or each, elongate connector is reversible to provide at least two orientations of the seat frame assembly relative to the rest frame assembly, so that the rest assembly can function either as a backrest or an armrest of the article of furniture, the table assembly comprising:

a tabletop;

a support member that engages the tabletop, to support the tabletop at a suitable height and having an operatively, substantially vertical support post and a leg that extends from the support post, the leg being detachably engageable with the rest mount with the support post extending operatively upwardly from the leg; and an elongate bracing member that extends from the support member and is detachably engageable with the rest mount to brace the table assembly against pivotal movement.

According to a fourth aspect of the invention, there is provided a leg support system suitable for an article of furniture, the leg support system comprising:

at least two legs, each leg having an elongate body that defines at least one substantially flat face so that two legs can be positioned together with their faces in abutment; and a connector arranged on an operatively upper end of each leg so that the leg can be connected to a seat support frame such that, when two of the seat support frames are adjacent to each other to form a two-seat arrangement, the flat faces of corresponding legs on each of the support frames are in abutment with each other.

According to a fifth aspect of the invention, there is provided a table assembly for use with the article of furniture according to the first aspect of the invention, the table assembly comprising:

a support structure that is configured to engage at least one of the rest mount and seat mount;

a support arm assembly arranged on the support structure, the support structure being configured so that engagement with the at least one of the rest mount and seat mount inhibits pivotal movement of the support arm assembly; and a tabletop arranged on the support arm assembly, the support arm assembly being configured to support the tabletop adjacent to or above the rest assembly, in use.

According to a sixth aspect of the invention, there is provided a cushion assembly for a seat of an article of furniture, the cushion assembly comprising:

a seat insert that includes:

a seat filler body defining an operatively downwardly opening cavity; and a spring assembly that is removably located in the cavity; and a cover assembly, the cover assembly being configured to enclose the seat insert and being fastenable to a seat support structure of the article of furniture.

According to a seventh aspect of the invention, there is providing a connecting system for connecting seat assemblies of an article of furniture together, the seat assemblies including a seat support frame for supporting a cushion assembly, the connecting system comprising:

at least one sleeve assembly that is arranged on the seat support frame, the sleeve assembly including a sleeve that defines a passageway, the, or each, sleeve assembly being positioned on the seat support frame so that two seat assemblies can be positioned adjacent each other with the passageways of respective sleeve assemblies in alignment;

at least one elongate connector, the, or each, connector including a locking portion that is receivable through a respective pair of aligned passageways; and a locking arrangement that is arranged on the, or each, sleeve assembly, the locking arrangement and the, or each, connector being configured so that the locking portion can be releasably locked in the passageway, such that the seat support frames of the adjacent seat assemblies can be locked to each other, with the locking portion received through aligned passageways, in a releasable manner.

BRIEF DESCRIPTION OF THE DRAWINGS

FIG. 51 shows the seat cushion assembly of FIG. 49 in an assembled condition.

FIG. 52 shows an exploded view of a cover assembly and a seat insert of the seat cushion assembly of FIG. 49.

FIG. 53 shows an exploded view of a seat insert of the seat cushion assembly of FIG. 49.

FIG. 94 shows a three-dimensional view, from above, of a table assembly that is detachably engageable with one of the seat support frames.

FIG. 95 shows a front view of the table assembly of FIG. 94.

DETAILED DESCRIPTION

Figure 1A:
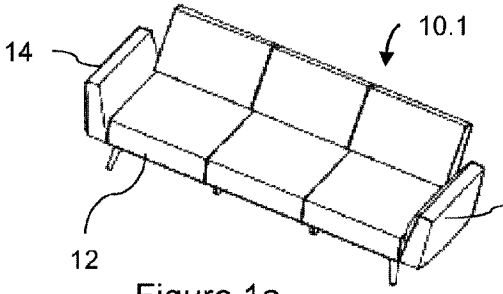
FIGS. 1*a* to 1*i* show an embodiment of various configurations of an article of furniture, in accordance with the invention.
Figure 1B:
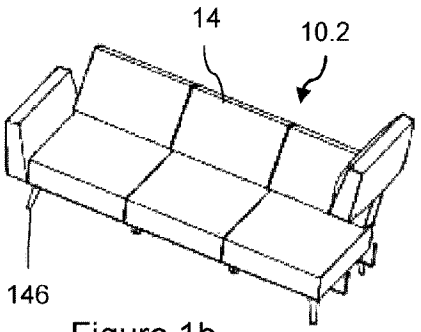
Figure 1C:
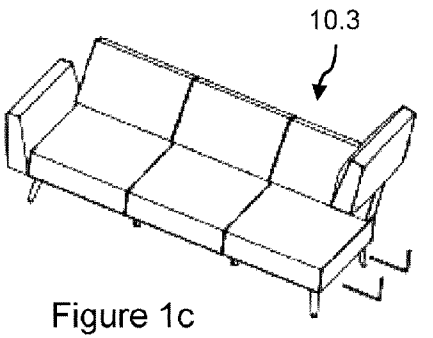
Figure 1D:
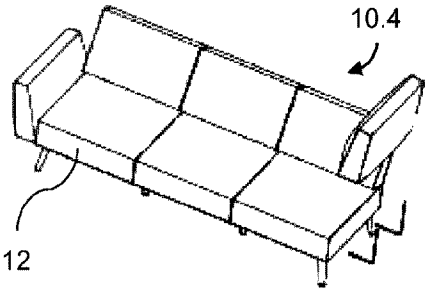
Figure 1E:
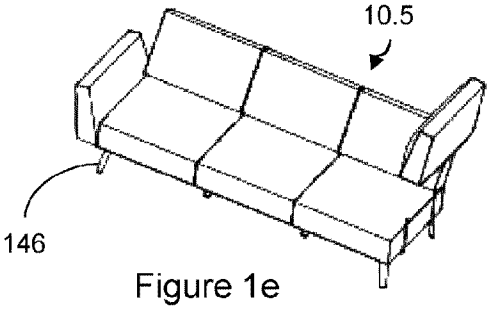
Figure 1F:
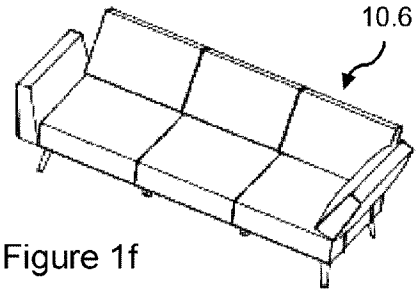

In the drawings, reference numeral 10 generally indicates an embodiment of an article of furniture, in accordance with the invention.

Figure 1G:
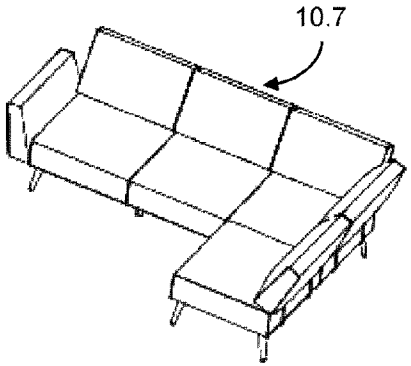
Figure 1H:
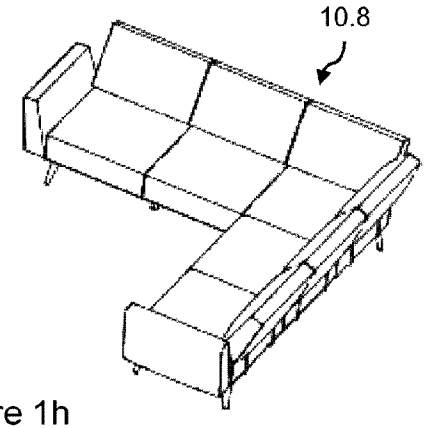
Figure 1I:
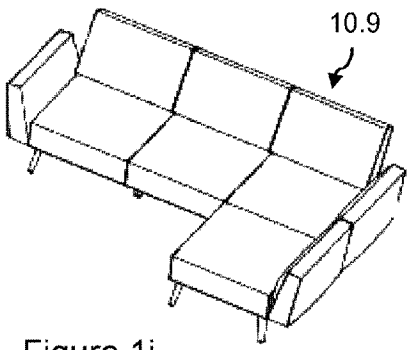

In FIG. 1*a*, reference numeral 10.1 shows one configuration of the article of furniture forming a three-seater sofa. In FIGS. 1*b* to 1*f*, there are shown five stages, 10.2 to 10.6, in the alteration of a position of a rest assembly 14. In FIGS. 1*g* to 1*i*, there are shown, respectively, three different configurations, 10.6 to 10.9, of the article of furniture achieved by positional adjustment, by addition or removal of seat assemblies 12 and the rest assemblies 14. It is to be understood that the article of furniture can take other configurations, such as a two-seater sofa, four-seater sofa, et cetera. The article of furniture can be in various other configurations not limited to those described herein. As is apparent from FIGS. 1*a* to 1*i*, each configuration includes backrests and armrests that are substantially identical. It follows that the various configurations shown, and possibly further configurations, can be achieved with the seat assembly 12 and the rest assembly 14. Thus, a consumer can easily enlarge or reduce the size of the article of furniture 10, for example, by purchasing more seat or rest assemblies 12, 10, without needing to purchase specific fit-for-purpose components. When moving the article of furniture 10, the consumer can easily adjust the configuration of the article of furniture 10 to suit the new location for the article of furniture 10. Furthermore, when moving the article of furniture 10, the rest assemblies 14 and seat assemblies 12 can easily be packed into a configuration, for example, one on top of each other, to facilitate moving. This is particularly useful with containerised transport where regularity of articles is useful for saving space. Irrespective of the size and numbers of the article of furniture 10, the storage area will be occupied mainly by two stacks of components, namely the seat assemblies 12 and the rest assemblies 14. This benefit also applies to warehousing. The commonality of the seat assemblies 12 and rest assemblies 14 reduces the variety of items needed to be stocked in a warehouse while enabling a large variety of settings or configurations to be sold. Thus, the article of furniture 10 can serve to ameliorate or address at least a number of the issues raised in the above Background with other forms of articles of furniture.

Figure 2A:
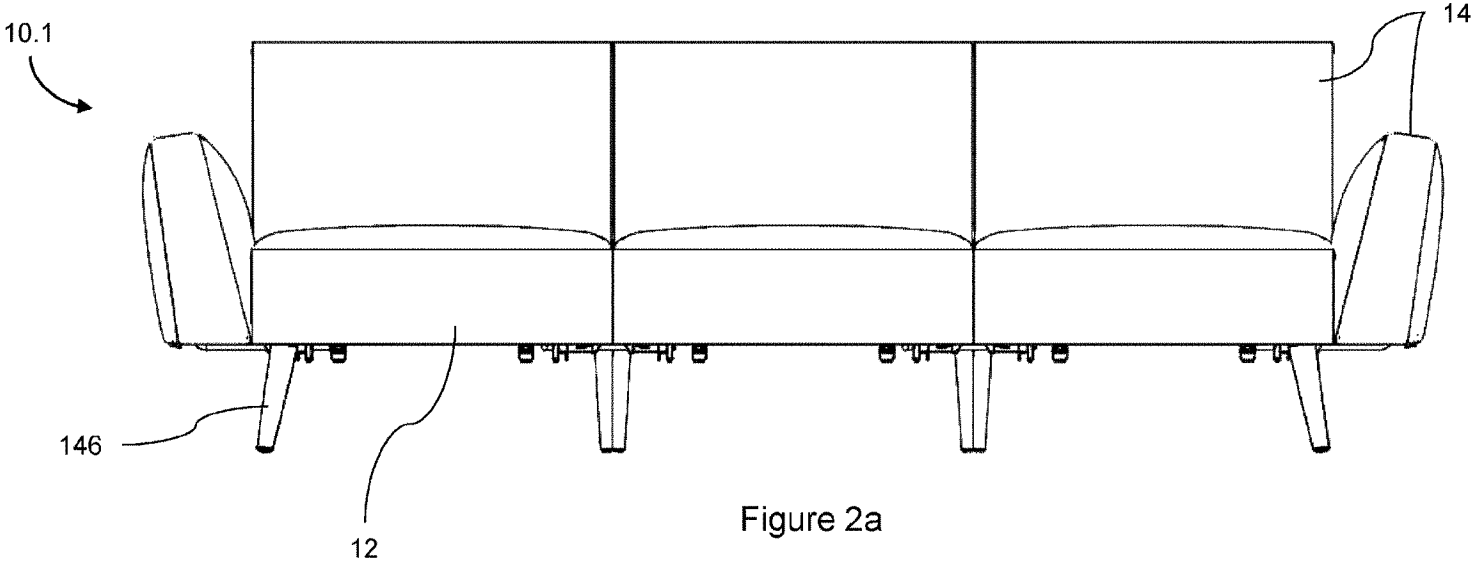
FIGS. 2*a* to 2*b* show two configurations of the article of furniture configured to form a convertible three-seat sofa.
Figure 2B:
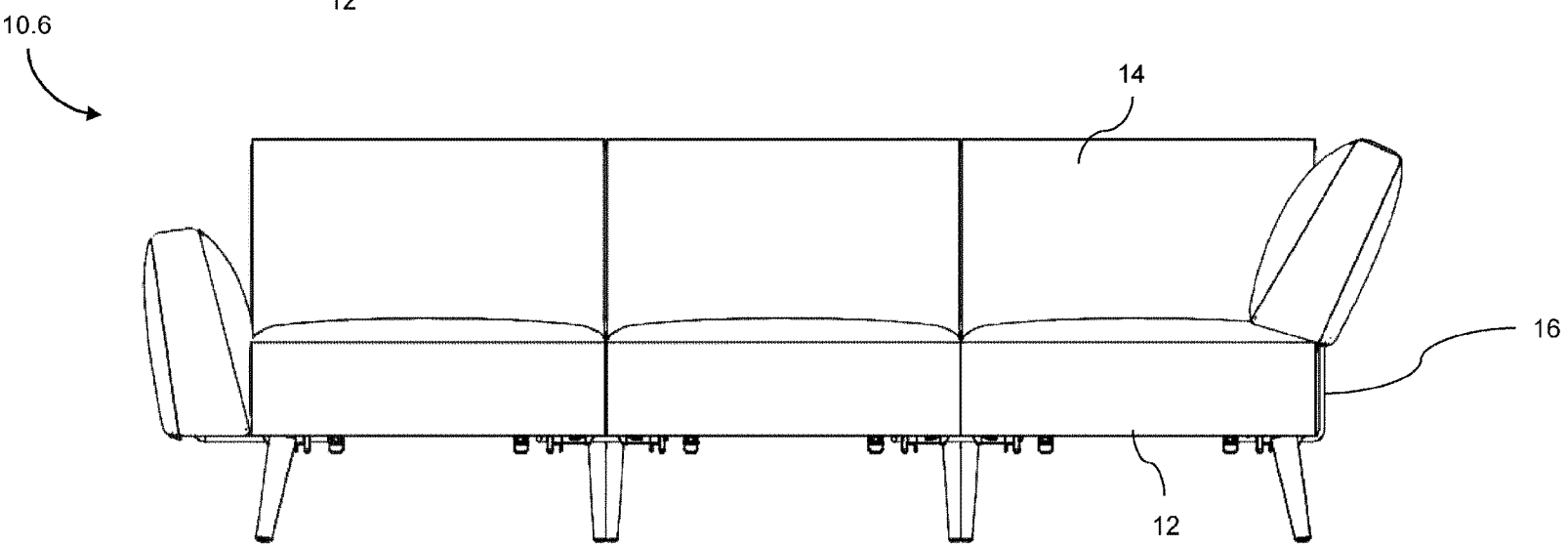

In FIG. 2*a* there is shown the article of furniture 10.1 and in FIG. 2*b* there is shown the article of furniture 10.6. As can be seen, these articles of furniture only differ regarding the position of one of the rest assemblies 14 functioning as armrests. The article 10.1 is a conventional three-seater sofa and the article 10.6 is the three-seater sofa with one of the rest assemblies 14 functioning as an armrest and an opposite rest assembly in a back support orientation, which is achieved by reorientation or flipping of elongate connectors as described below. Thus, the article of furniture 10 is configured so that the position of the rest assembly 14 relative to the seat assembly 12 can determine the function of that rest assembly 14.

The article of furniture 10 is assembled from a kit or a set of components that includes one or more of the seat assemblies 12, one or more of the rest assemblies 14 and a number of elongate connectors 16 that are used to connect any number of seat assemblies 12 and rest assemblies 14 together to form any of the articles of furniture 10.1 to 10.9 or any other variations or configurations thereof.

The seat assembly 12 includes a generally square or rectangular seat support frame 18 with four frame members 20 defining sides of the seat support frame. The frame members 20 can be fabricated from tubular steel or aluminium, or any other material with suitable strength characteristics for furniture. The frame members 20 can be of square or round tubular section. In one embodiment, the frame members 20 are of 40 mm×40 mm square tubular steel.

The rest assembly 14 includes a rest support frame 26 having four frame members in the form of a bottom frame member 28, a top, or intermediate, frame member 30, and two opposed side frame members 32. The bottom frame member 28 interconnects lower ends of the side frame members 32 and the intermediate frame member 30 also interconnects the side frame members 32. The rest support frame 26 is generally square or rectangular. The frame members 28, 30, 32 can be of tubular steel or aluminium, or any other materials with suitable strength characteristics for furniture. The frame members 28, 30, 32 have a square or round tubular cross-section. In one embodiment, the frame members 28, 30, 32 are of 20 mm×20 mm square tubular steel.

Broadly, the elongate connectors 16 have a first portion 34 and a second portion 36. The elongate connectors 16 are in the form of bent steel bars, preferably stainless steel bars. The bars are cylindrical but can have other cross-sectional shapes. As is apparent from the description below, the connectors 16 may be visible in various configurations, particularly when the rest assembly 14 is serving as a backrest. Thus, the elongate connectors 16 can be configured to have an aesthetically pleasing appearance.

A rest mount in the form of sets of two sleeve assemblies 38 is arranged on at least each of two adjacent sides of the seat support frame 18 and, in this example, on each of the frame members 20. The rest mount may include sets of more than two sleeve assemblies 38 arranged on one or each of the frame members 20, if necessary.

Detail of the sleeve assembly 38 can be seen in FIGS. 13 and 16 to 21. Note that in FIGS. 18 to 21, the sleeve assembly 38 is shown separated from the frame member 20 for the purposes of clarity and ease of description.

A gusset 50 is fastened to the frame member 20 to extend inwardly with respect to the frame member 20. The gusset 50 is fastened to an internally facing side of the frame member 20. The gusset 50 can be welded to the frame member 20. A sleeve holder 52 is fastened to, and depends from, the gusset 50. The sleeve holder 52 is tubular. For example, the sleeve holder 52 has a square tubular cross-section. In one embodiment, the sleeve holder 52 is of 20 mm×20 mm tubular steel and is welded to the gusset 50.

The sleeve assembly 38 includes a sleeve insert 54 (FIGS. 17 to 21). The sleeve insert 54 is received in the sleeve holder 52 so that the sleeve insert 54 can be retained in position relative to the frame member 20. A protective sleeve 86 is mounted on a proximal end of the sleeve holder 52, to cover the end of the sleeve holder 52. The sleeve 86 thus serves to impart a suitable appearance to the sleeve assembly 38 by covering any unsightly edges of the holder 52. Those edges could also be sharp, so the sleeve 86 inhibits a user from being cut or scratched. The sleeve 86 is of a plastics material with a suitable finish. The sleeve 86 can have a chamfered opening 87. The opening could also be flat with a small lead in to facilitate guidance of the elongate connector.

The sleeve insert 54 is of tubular square section. The sleeve insert 54 could also be of round cross section. A proximal end portion of the sleeve insert 54 is configured to engage the sleeve holder 52 such that the sleeve insert 54 is restrained from being extracted from the sleeve holder 52. More particularly, the proximal end portion of the sleeve insert 54 includes opposed catches 56 that are configured to be displaced towards each other when the proximal end portion of the sleeve insert 54 is within the sleeve holder 52, and to be displaced away from each other once the proximal end portion extends from the proximal end of the sleeve holder 52. To that end, the proximal end portion of the sleeve insert 54 can be bifurcated. Each catch 56 extends from an end of a respective bifurcation 57 and is shaped to facilitate insertion of the insert 54 into the holder 52, with the bifurcations being urged towards each other. The sleeve member 54 is of a resiliently flexible material, such as a plastics material, so that the displacement of the catches 56 away from each other is as a result of a subsequent release of tension when the catches 56 exit the proximal end of the sleeve 86 and engage the sleeve 86, so retaining the sleeve 86 in position on the holder 52.

Figure 16:
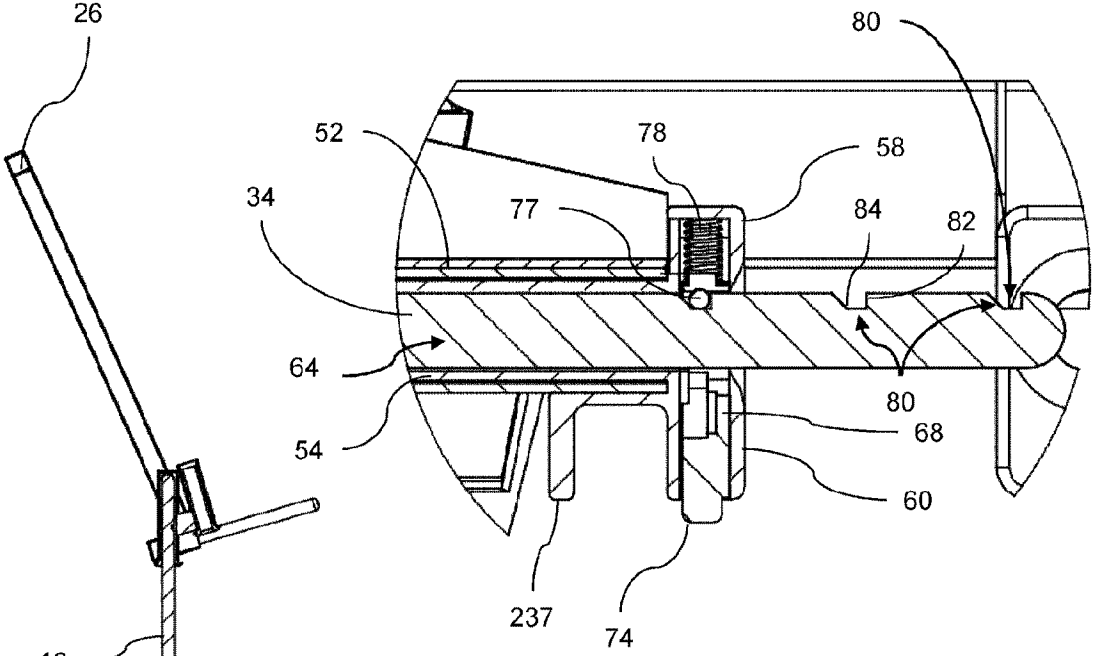
FIG. 16 shows a detailed view of the part C in FIG. 15.
Figure 15:
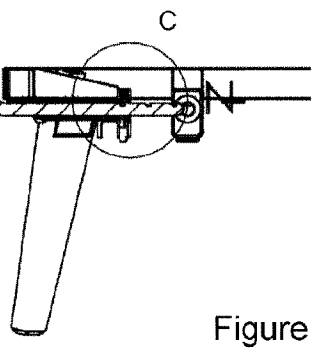
FIG. 15 shows a side sectioned view through M-M in FIG. 14.
Figure 14:
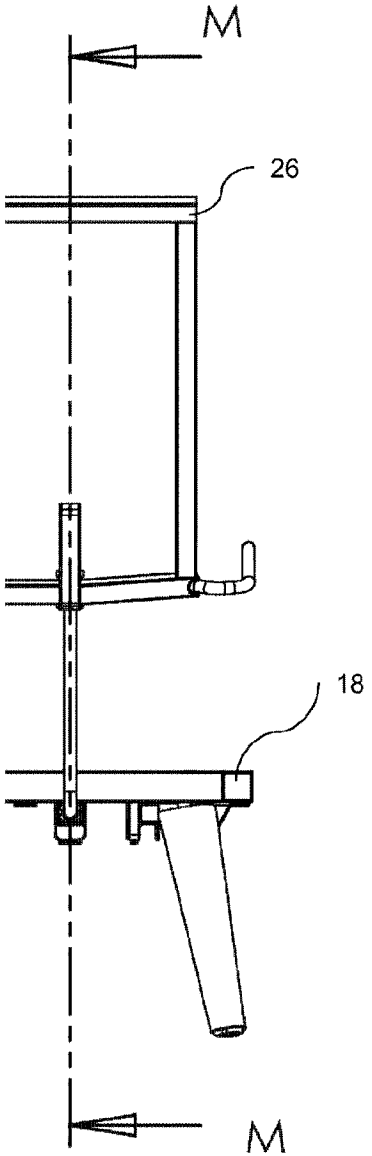
FIG. 14 shows a partial front view of the seat support frame, the rest support frame and one of the elongate connectors of the article of furniture.
Figure 20:
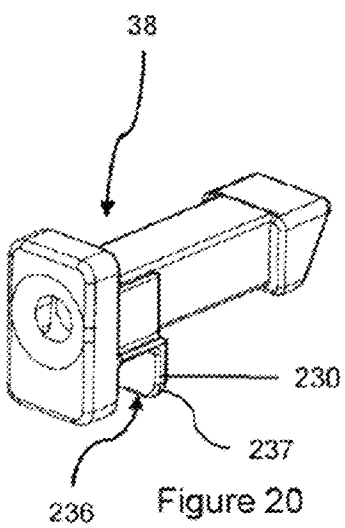
FIG. 20 shows the sleeve assembly of FIG. 18, in an assembled configuration, from an inner side of the seat support frame.

A releasable locking assembly 58 is arranged on a distal end of the sleeve insert 54. The locking assembly 58 includes a housing 60. The housing 60 defines a passageway 62 extending through the housing 60 and in alignment with a passageway 64 defined by the sleeve insert 54 (FIG. 16).

Figure 19:
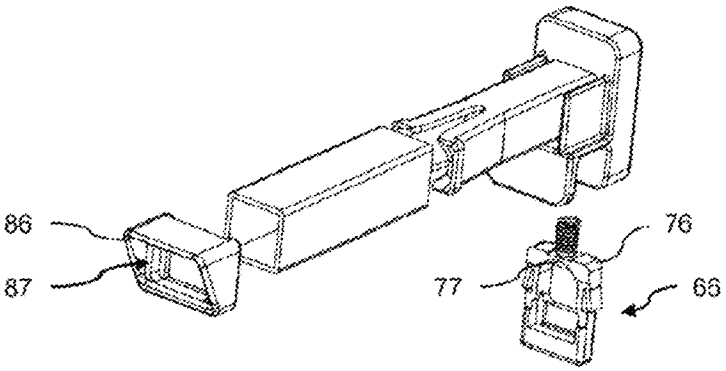
FIG. 19 shows a further exploded view of the sleeve assembly of FIG. 18, from an opposite side.
Figure 21:
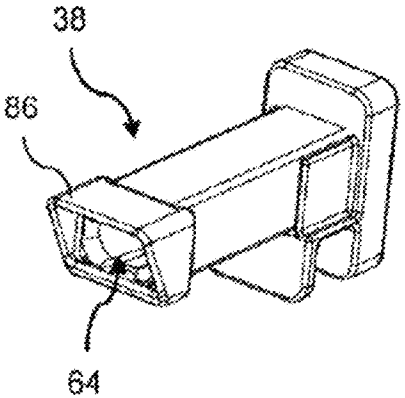
FIG. 21 shows the sleeve assembly of FIG. 20, from an outer side of the seat support frame.
Figure 17:
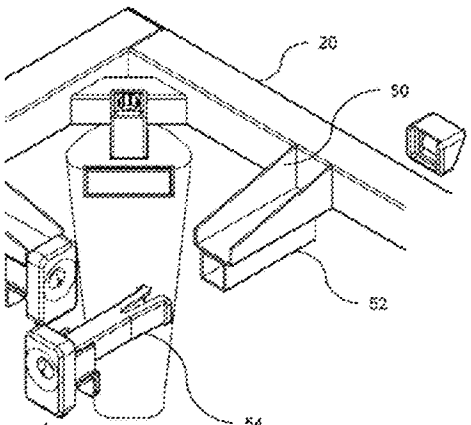
FIG. 17 shows an exploded view of an embodiment of a sleeve assembly of a rest mount of the seat support frame of the article of furniture, in situ.
Figure 18:
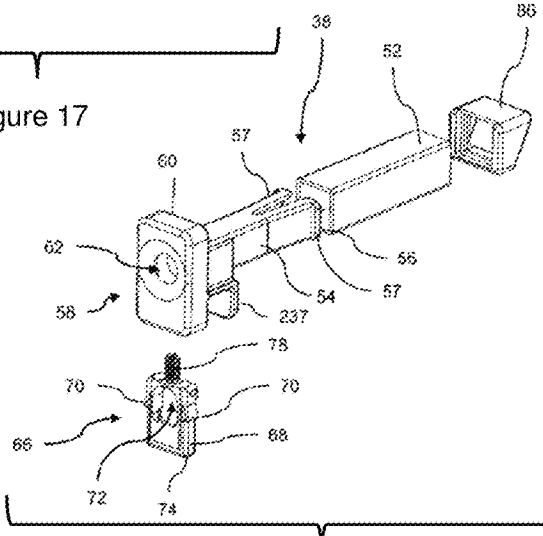
FIG. 18 shows a further exploded view of the sleeve assembly of FIG. 17, from one side, in a detached configuration, for clarity.

A catch mechanism in the form of a catch assembly 66 is positioned in the housing 60. The catch assembly 66 includes a catch insert 68 that is received in the housing 60. To that end, the housing 60 has an open, operatively lower end into which the catch insert 68 can be inserted. The catch insert 68 includes a push member 74 that extends from the housing 60 when the insert 68 is positioned in the housing 60. The catch insert 68 has retaining formations 70 that engage complementary formations within the housing 60 to retain the insert 68 in position in the housing 60. The insert 68 is dimensioned so that it can slide within the housing 60. The insert 68 defines an aperture 72 that is aligned with the passageways 62, 64 once the insert 68 is in position. The insert 68 includes a catch member 76 (FIG. 19). The aperture 72 is interposed between the catch member 76 and the push member 74. A spring 78 is interposed between the catch member 76 and the housing 60 so that the spring 78 biases the catch insert 68 into abutment with the complementary formations within the housing. The catch member 76 can include a pin 77 or some other suitable formation or structure that partially obstructs the passageway 62 and defines an operatively upper side of the aperture 72. Operation of the push member 74 can urge the insert 68, and thus the pin 77, operatively upwardly against the spring 78 so that the pin 77 moves upwardly and clears the passageway 62. The pin 77 can be of a material, such as steel, having suitable structural integrity.

The first portion 34 of the elongate connector 16 includes three recesses 80. Each recess 80 is configured so that the pin 77 of the insert 68 can be received, under action of the spring 78, in either of the recesses 80. A free end of the first portion 34 is rounded or chamfered and the pin 77 is profiled so that, when the first portion 34 is pushed into the passageway 64 and then 62, the insert 68, and thus the pin 77, is urged upwardly, against the spring 78, so that the first portion 34 can extend through the aperture 72. When one of the recesses 80 comes into alignment with the pin 77, the insert 68 is driven downwardly, under action of the spring 78, so that the pin 77 is driven into the recess 80, to retain the elongate connector 16 in position against extraction from the passageway 62 and thus 64. Each recess 80 has a vertical side wall 82 that is spaced from, and distally positioned with respect to, a sloped sidewall 84 of the recess 80. This allows the first portion 34 to be inserted through the aperture 72 until the pin 77 is driven into the selected recess 80 to allow the elongate connector 16 to have three discrete positions. To release the first portion 34, the push member 74 can be urged towards the housing 60 so that the insert 68 is driven upwardly against the spring 78 and the pin 77 moves out of the recess 80 to clear the passageway 62, allowing removal of the portion 34. It will be appreciated that the portion 34 can have any number of recesses for further adjustability of the elongate connector 16 relative to the frame member 20.

The recesses 80 are aligned with each other along the first portion 34. Also, each recess 80 is defined on part of a circumference of the first portion 34, without extending about the circumference, so that manipulation, in the form of rotation, of the elongate connector 16 results in the pin 77 moving out of the recess 80 and thus disengagement of the catch member 76 from the first portion 34, allowing the first portion 34 to be withdrawn from the locking assembly 58. Thus, it is possible to remove the elongate connectors 16 without operating the push member 74. This can be convenient because it obviates the need for a user to reach down under the seat assembly 12 to operate the push member 74. It will be appreciated that the push member 74 will require operation when the second portion 36 is engaged with the rest support frame 26, as described below.

Figure 9:
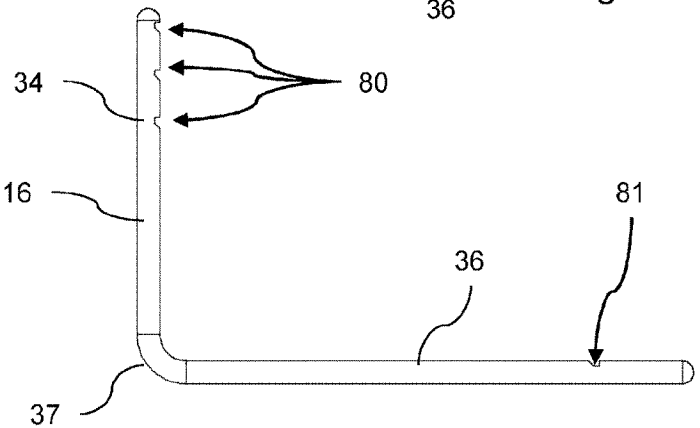
FIG. 9 shows one example of an elongate connector suitable for use with one embodiment of an article of furniture, in accordance with the invention.

Detail of the elongate connector 16 can be seen in FIG. 9. The second portion 36 of the elongate connector 16 has a single recess 81. The recess 81 is identical to the recess 80. A free end of the second portion 36 is also rounded or chamfered to result in the insert 68 being driven upwardly so that the pin 77 clears the passageway 62 to allow the second portion 36 to be pushed through the aperture 72. Thus, the recess 81 can receive the pin 77, in the manner described above, when the pin 77 is brought into alignment with the recess 81. Thus, engagement or disengagement of the second portion 36 with the locking assembly 58 is as described above with reference to the first portion 34. As with the portion 34, the portion 36 can have any number of recesses for further adjustment of the elongate connector 16 relative to the frame member 20.

With two sleeve assemblies 38 mounted on each of the frame members 20 of the seat support frame 18, two of the elongate connectors 16 can be mounted on one or more of the frame members 20 so that the first or second portions 34, 36 of the, or each, pair of elongate connectors 16 can extend from the frame members 20 depending on which portion 34, 36 is received in the sleeve assembly 38. This allows various configurations of one or more rest assemblies 14 relative to the seat assembly 12 to be achieved.

As described, the locking assembly 58 is positioned inwardly or distally with respect to the frame member 20, as opposed to outwardly or proximally. With a reverse orientation, with the locking assembly 58 positioned outwardly, force exerted on the elongate member 16 as a result of leaning back on the rest assembly 14 could damage the locking assembly 58. Furthermore, this position, as shown in the drawings, of the locking assembly 58 makes it less likely to be visible, which could detract from the appearance of the article of furniture 10.

A seat mount is arranged on the bottom frame member 28 of the rest support frame 26 (FIGS. 3 to 6, for example). The seat mount includes two receiver assemblies 96 that are spaced apart and fixed to the bottom member 28.

Figure 5:
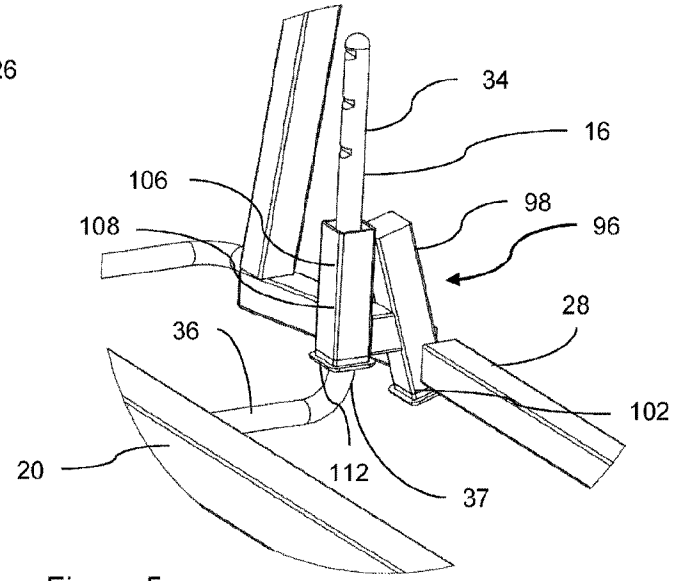
FIG. 5 shows a detailed view of the part A in FIG. 3.
Figure 6:
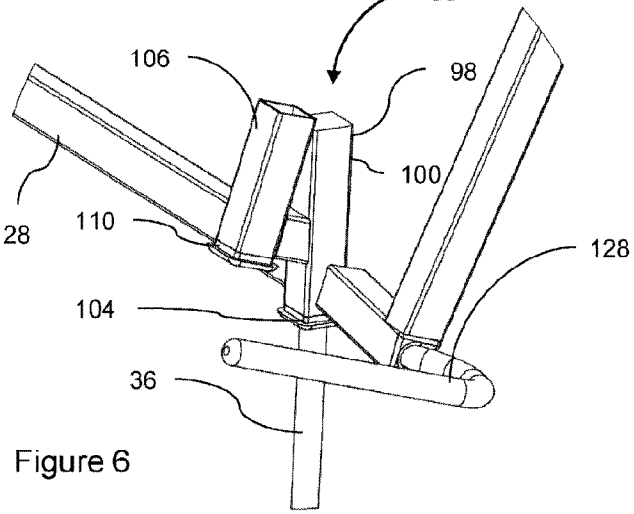
FIG. 6 shows a detailed view of the part B in FIG. 4.

As shown in FIGS. 5 and 6, for example, each receiver assembly 96 includes a socket assembly 98 that is fixed to the bottom member 28. The socket assembly 98 includes an elongate holder 100 in which a socket insert 102 is received. The holder 100 can have a square or round tubular cross section. In one embodiment, the holder 100 is of 20 mm×20 mm tubular steel.

The socket insert 102 includes a head 104 that overlies an opening of the holder 100 and defines a chamfered, rounded or radiused entrance to facilitate location of either the first or second portions 34, 36 in a socket defined by the socket assembly 98. The head 104 need not overlie the opening of the holder 100, since material of a cover may be suitable for reducing the visibility of the hole for aesthetic purposes. The head 104 can also play a protective role by inhibiting damage to the holder 100 by one of the portions 34, 36. The head 104 also serves to cover any sharp edges of the holder 100 so that a user is protected from being cut. The socket insert 102 can be of a plastics material.

Each receiver assembly 96 includes a sleeve assembly 106. The sleeve assembly 106 includes an elongate holder 108 in which a sleeve insert 110 is received. The holder 108 can have a square or round tubular cross section. In one embodiment, the holder 108 is of 20 mm×20 mm tubular steel.

The sleeve insert 110 includes a head 112 that overlies a lower opening of the holder 108 and defines a chamfered, rounded or radiused entrance to facilitate insertion of either the first or second portions 34, 36 through a passageway defined by the receiver assembly 96. The head 112 can also play a protective role by inhibiting damage to the holder 108 by either of the portions 34, 36. The head 112 also serves to cover any sharp edges of the holder 108 so that a user is protected from being cut. The sleeve insert 110 can be of a plastics material. The head 112 need not overlie the opening of the holder 108, since material of a cover may be suitable for reducing the visibility of the hole for aesthetic purposes.

The socket assembly 98 and the sleeve assembly 106 are aligned front to back and diverge downwardly with respect to each other, with the socket assembly 98 being outwardly positioned with respect to the sleeve assembly 106, in use. The socket assembly 98 opens downwardly, in use.

Figure 3:
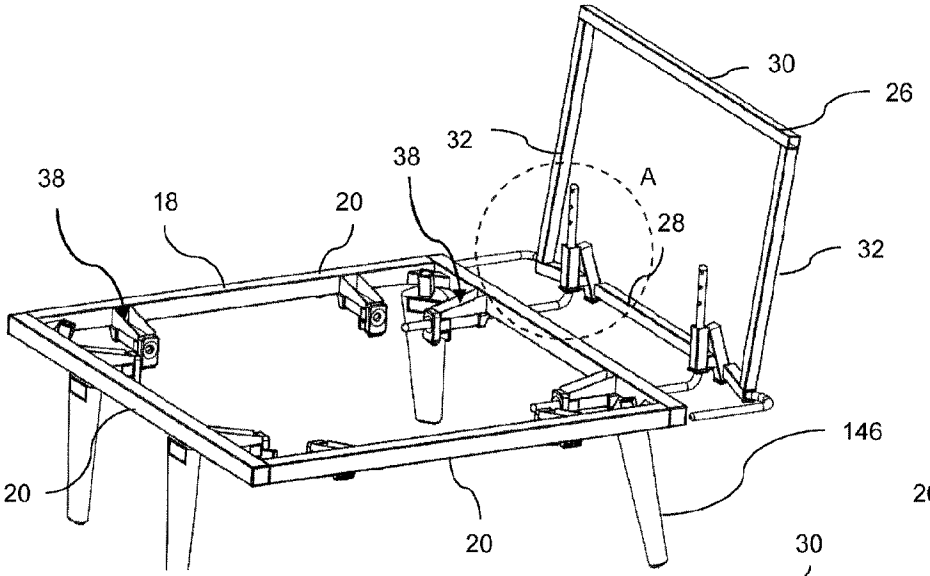
FIG. 3 shows a three-dimensional view of a seat support frame of a seat assembly of the article of furniture connected to a rest support frame of the article of furniture with elongate connectors in an optional orientation.

In use, corresponding first or second portions 34, 36 of two elongate connectors 16 are inserted into two respective socket or sleeve assemblies 98, 106. The rest assembly, with corresponding first or second portions 34, 36 extending therefrom is manipulated so that the first or second portions 34, 36 can be received in respective sleeve assemblies 38 on an appropriate frame member 20, as described above. For example, FIGS. 3 and 5 show the portion 34 extending through the sleeve assembly 106. In that position, the sleeve assembly 106 is supported ata junction of the portions 34, 36. This configuration can be used when the rest assembly 14 is to function as an armrest, with the longer portion 36 allowing the rest assembly 14 to be positioned on the side of the associated seat assembly 12. Furthermore, in this configuration, the rest assembly 14 is more upright than when the portion 36 is received in the socket assembly 98, which is suited for its function as an armrest.

Figure 4:
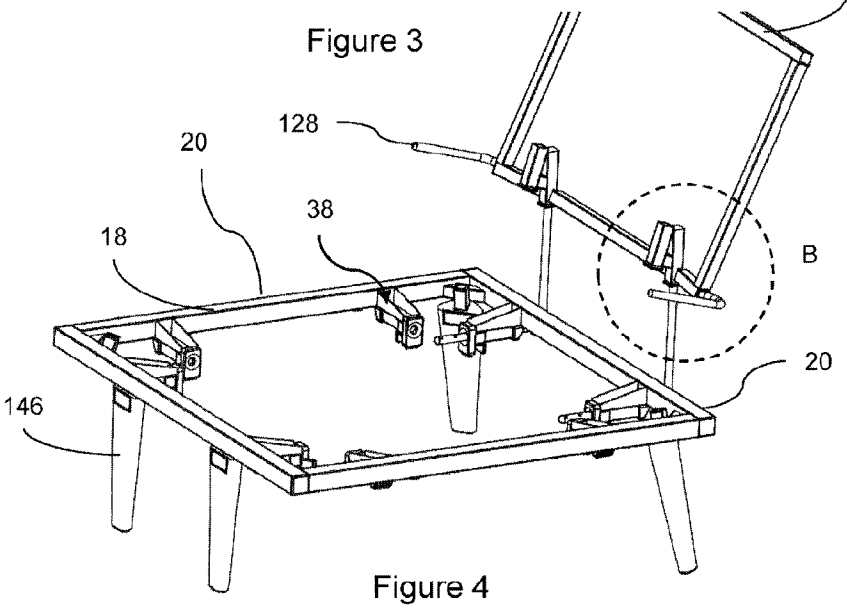
FIG. 4 shows a three-dimensional view of the seat support frame of FIG. 3 connected to the rest support frame with the elongate connectors in another optional orientation.
Figure 8:
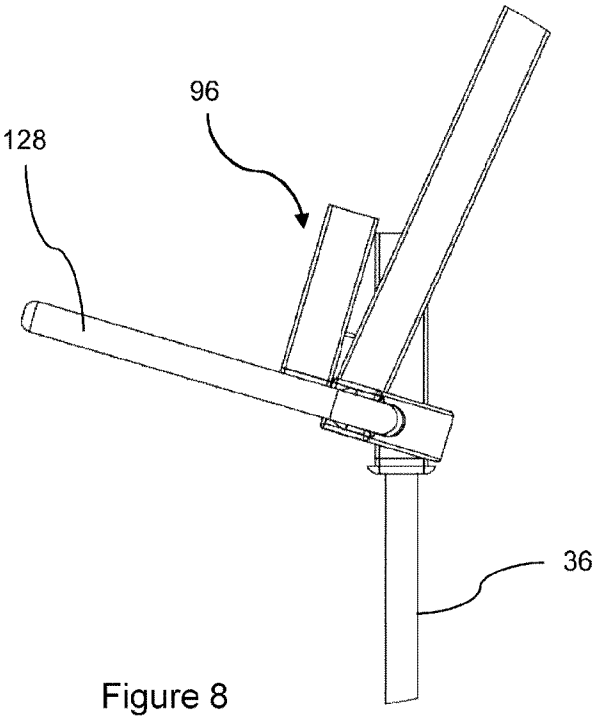
FIG. 8 shows a detailed side view of the elongate connector in the operative condition in the configuration of FIG. 4.

In FIGS. 4 and 6, the portion 34 is received in the sleeve assembly 38 and the portion 36 is received in the socket assembly 98. In that position, the socket assembly 98 is supported on an upper end of the portion 36. When the portions 34 of two of the elongate connectors 16 are received through respective sleeve assemblies 106, the rest support frame 26 is lower than when the portions 36 are received in respective socket assemblies 98. Furthermore, an included angle between the rest support frame 26 and the seat support frame 18 is reduced by selecting the sleeve assemblies 106 as opposed to the socket assemblies 98. Thus, when the portions 36 are received in the socket assemblies 98, the rest assembly 14 is suited for its function as a backrest. It will be appreciated that in other embodiments, the portions 34 can be received in the socket assemblies 98, with appropriate modification to the elongate connectors 16, if necessary.

Figure 12:
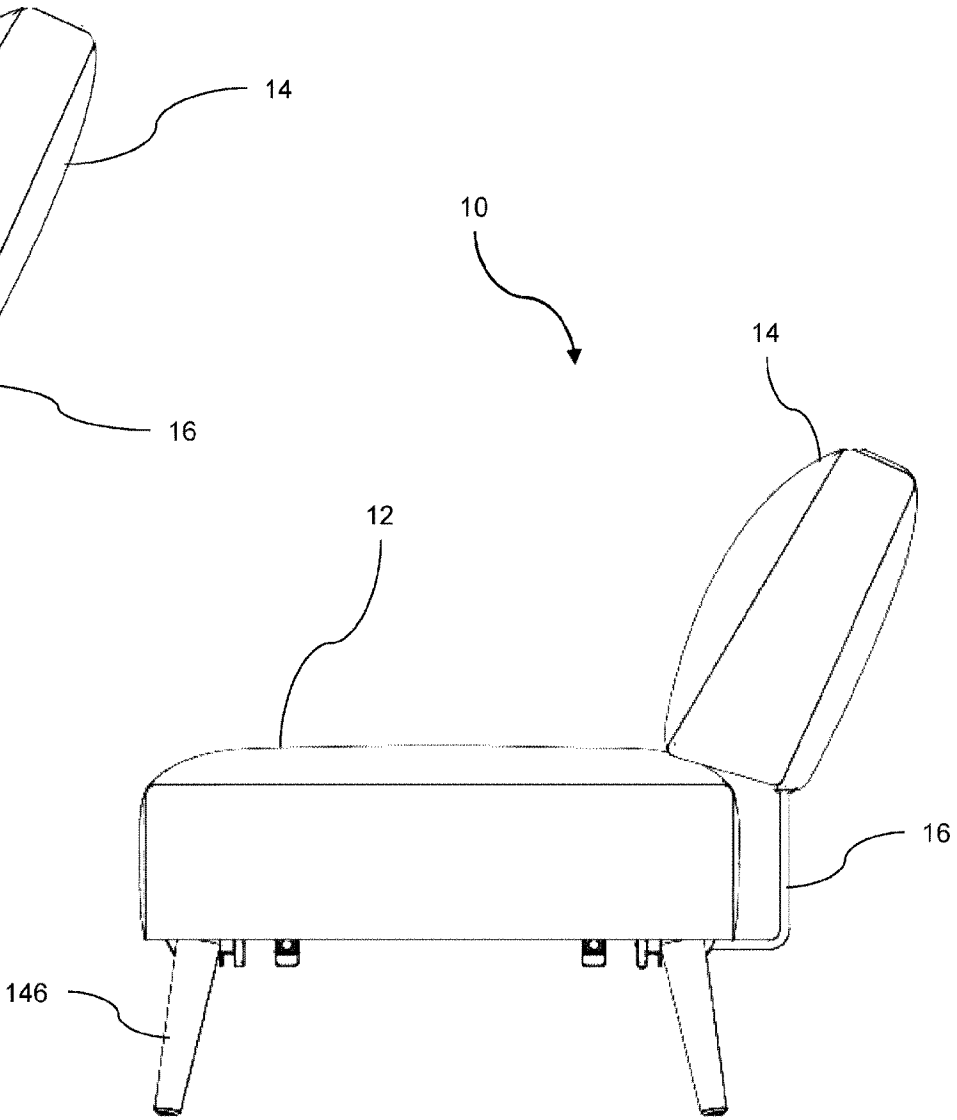
FIG. 12 shows a side view of the article of furniture of FIG. 11 with the elongate connector in an optional orientation.
Figure 11:
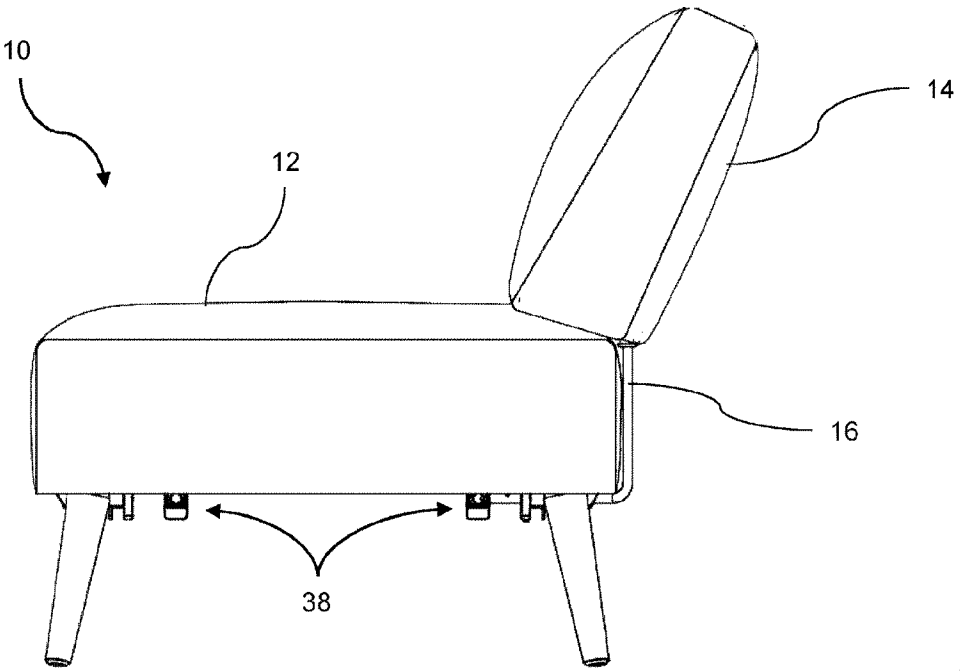
FIG. 11 shows a side view of the article of furniture with the elongate connector in an optional orientation.
Figure 13:
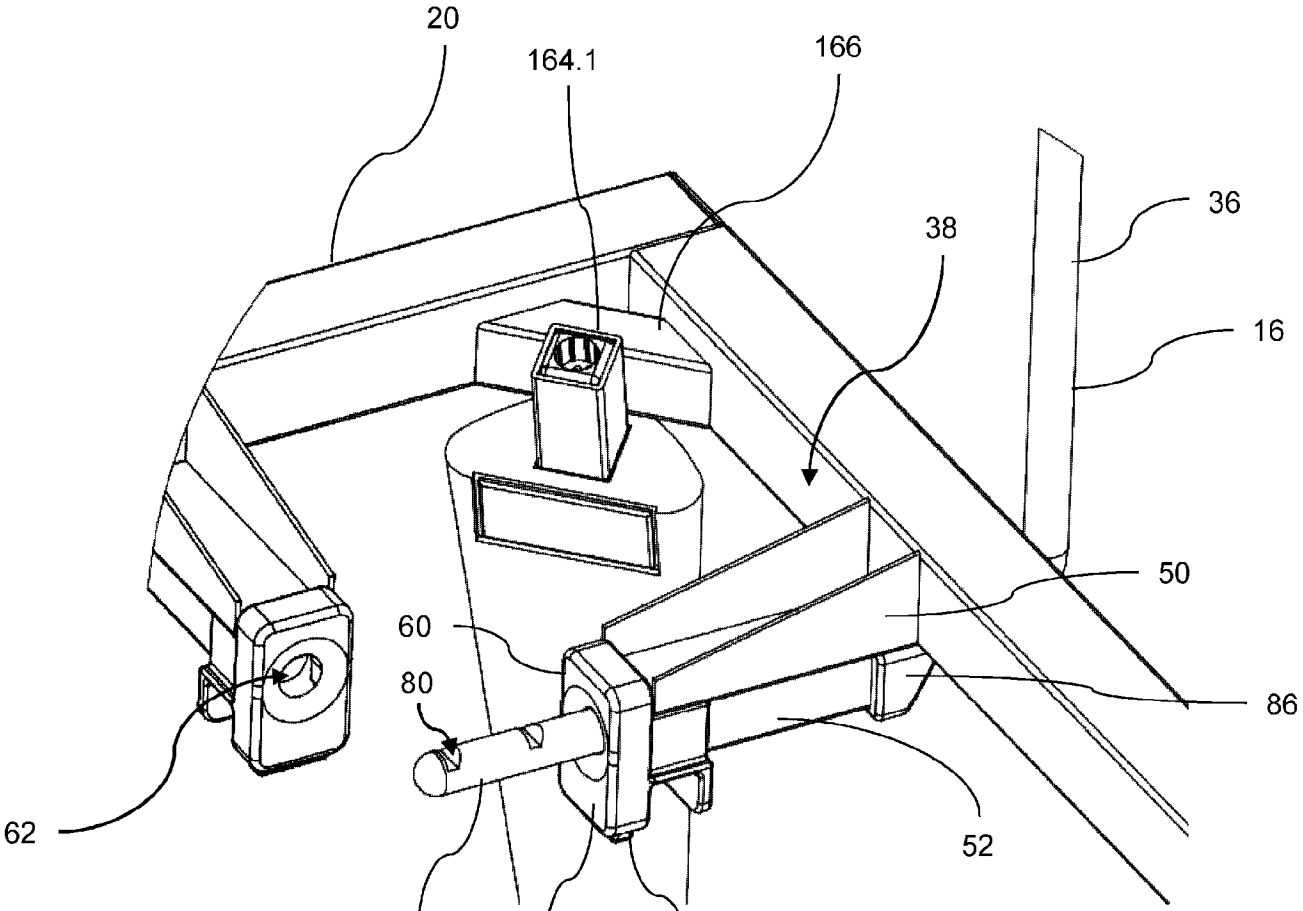
FIG. 13 shows a detailed view of a first portion of one of the elongate connectors engaged with the seat support frame.

As mentioned above, the portions 34 can be positioned in the respective sleeve assemblies 38 on the appropriate side of the seat frame member 20. Then, the portions 36 can be received in either the socket assemblies 98 or the sleeve assemblies 106, in the manner described above with reference to the portions 34. As can be seen in FIG. 9, the portion 34 is shorter than the portion 36. Thus, a height of the rest support frame 26 relative to the seat support frame 18 can be adjusted by flipping or reorienting the elongate connectors 16. The provision of the three recesses in the portion 34 allows the rest assembly, as the backrest, to be adjusted into three different positions on the seat assembly 12, two of which are shown in FIGS. 11 and 12, to suit a user. It will be appreciated that more or less adjustment positions could be achieved by provided more or less recesses on either or both of the portions 34, 36. This depth adjustment is useful when forming a corner and avoiding unsightly squashing of the cushions.

The elongate connector 16 is 12 mm stainless steel bar. The first and second portions are angled with respect to each other so that a suitable appearance is achieved when the rest assembly 14 is operatively positioned with respect to the seat assembly. For example, the angle can be between 84 degrees and 90 degrees, and, more particularly, approximately 86 degrees. The angle is selected so that an acceptable appearance is achieved substantially without jamming of the elongate connector 16 to the associated components. For example, it is desirable that the armrests of an article of furniture do not look too reclined. A curved junction 37 interconnects the first and second portions 34, 36. Thus, when either the first or second portions 34, 36 are received through the sleeve assembly 106, the head 112 bears against the junction 37 to support the weight of the rest support frame 26.

Figure 10:
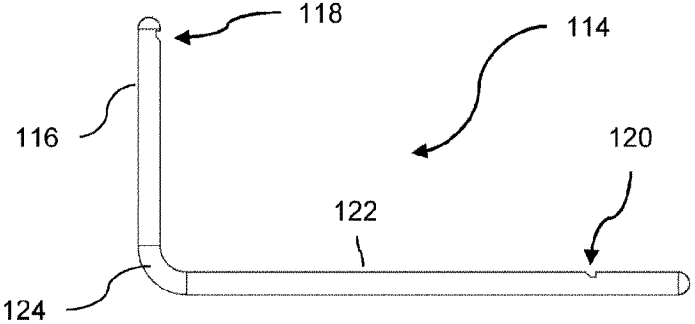
FIG. 10 shows another example of an elongate connector suitable for use with the article of furniture.
Figure 7:
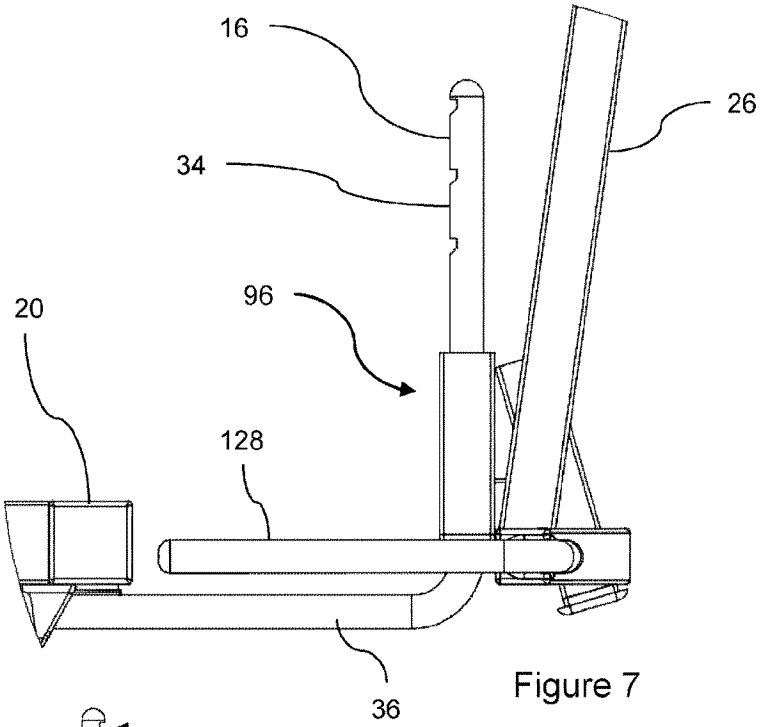
FIG. 7 shows a detailed side view of the elongate connector in the operative condition in the configuration of FIG. 3.

It follows that the elongate connectors 16 and the receiver assemblies 96 allow both height and angular positioning of the seat support frame 18 relative to the rest support frame 26. It will readily be appreciated that the elongate connectors 16 can take various configurations depending on the level of adjustment required. For example, in FIG. 10, reference numeral 114 generally indicates an example of an elongate connector with one recess 118 at or near an end of a first portion 116 and another recess 120 towards an end of a second portion 122. As with the elongate connector 16, the elongate connector 114 includes a curved junction 124 interconnecting the portions 116, 122.

Thus, in use, with the seat and rest support frames 18, 26 being appropriately cushioned, for example, as described below, the various configurations of the article of furniture shown in FIG. 1 can be achieved. Furthermore, other various configurations of the article of furniture, including sofas of various sizes, with or without chaise lounge returns, et cetera, can be achieved.

For example, the article of furniture 10.1 has two rest assemblies 14, serving as armrests, in which the portions 36 are received in the sleeve assemblies 38 on side members 20 of respective frames 18 of outermost seat assemblies 12. The portions 34 are received in the sleeve assemblies 106. FIG. 3 shows the outermost seat support frame 18 and one of the rest support frames 26 of the article of furniture 10.1, in the armrest configuration. In that configuration, the rest assembly 14 is in its lowest orientation relative to the seat assembly 12. Furthermore, the rest assembly 14 is more upright than those rest assemblies 14 serving as backrests.

In the backrest configuration, the rest support frame 26 is mounted on the seat support frame 18, as shown in FIGS. 4 and 6. In that configuration, the portions 34 are received in respective sleeve assemblies 38 with the pin 77 located in a proximal recess 80, as described above. The portions 36 are in respective socket assemblies 98. In that configuration, the rest assembly 14 is less upright than those rest assemblies 14 serving as armrests and may thus be better suited as a backrest. It will be appreciated that it might not be desirable for the rest assembly 14 to be titled back in an armrest configuration. Furthermore, the rest assemblies 14, in the backrest configuration, are higher than the rest assemblies 14 in the arm rest configuration.

The adjustment of one of the rest assemblies 14 from an armrest configuration to a backrest or chaise configuration is shown in FIGS. 1*b* to 1*f*. In the backrest configuration, the portions 34 are received in respective sleeve assemblies 38 so that a bottom of the rest assembly 14 can be positioned on the associated seat assembly 12 and be tilted similarly to its configuration as a backrest to perform a back support function. It will be appreciated that the article of furniture can thus be in the form of a chaise lounge or can include a chaise return.

In use, the rest support frame 26 and the associated receiver assemblies 96 are embedded in a suitable cushion assembly. A cover of the cushion assembly incorporates suitable openings to facilitate access to the receiver assemblies 96 by the portions 34, 36 of the elongate connectors. In certain configurations, it is desirable that lower edges of the rest assembly 14 define a distinctive corner edge when exposed as opposed to those configurations in which the lower edge of the rest assembly 14 abuts a lower edge of an adjacent rest assembly 14, as a backrest.

Figure 24:
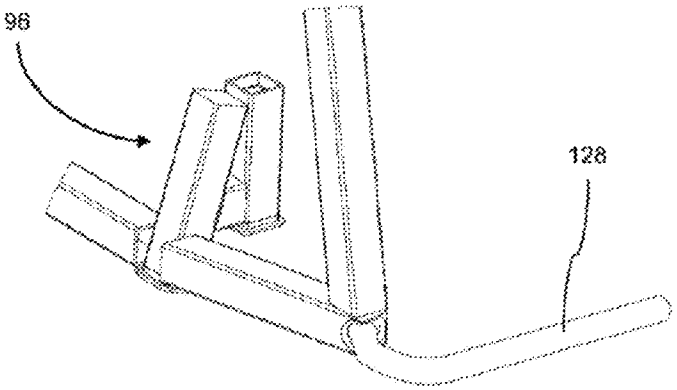
FIG. 24 shows a detailed view of the part D in FIG. 22.
Figure 25:
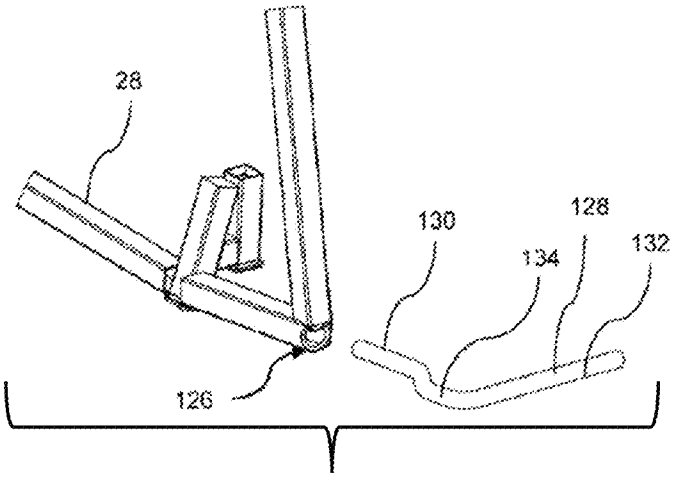
FIG. 25 shows a partially exploded view of the part D in FIG. 22.
Figure 22:
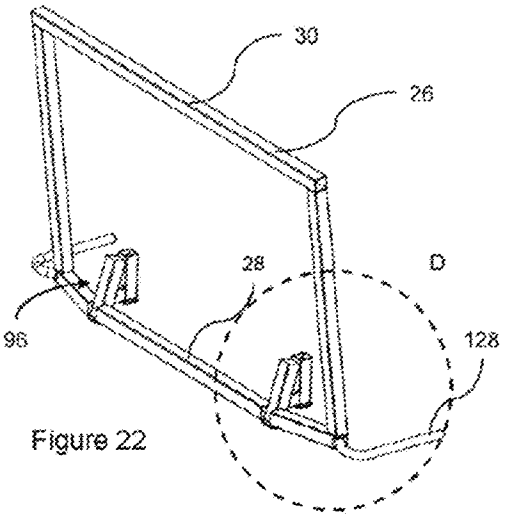
FIG. 22 shows a rest support frame of the article of furniture, with an example of a corner member connected to the rest support frame.

To that end, opposite outer ends of the bottom member 28 of the rest support frame 26 define openings 126 that provide access to a passageway defined by the bottom member 28. For example, as described above, the bottom member 28 is of square tubular section. The article of furniture 10 can include a number of corner members 128 (FIGS. 22, 24 and 25). The corner members 128 can be elongate, cylindrical bars or tubes. Each corner member 128 has a corner-defining structure in the form of a mounting portion 130 and a tensioning portion 132 that extends from the mounting portion 130. The corner member 128 is configured so that, in use, the tensioning portion 132 extends generally parallel to opposed frame members 20 that extend away from the rest support frame 26. The mounting portion 130 is receivable in the passageway, via the opening 126, to locate within the passageway. A locking portion 134 is interposed between the mounting portion 130 and the tensioning portion 132 and is shaped so that, when the mounting portion 130 is in the passageway, the locking portion 134 inhibits rotation of the corner member 128 relative to the frame member 28. Thus, a cover of the rest assembly can be removed and the corner member 128 mounted on the bottom member 28 so that the tensioning portion 132 is positioned away from the bottom member 28 to form a tensioning frame member for the cover. It will be appreciated that this can provide a neat appearance to a bottom edge of the rest assembly 14, particularly when the rest assembly 14 is functioning as an armrest and the bottom edge is visible. It will be appreciated that the corner members 128 can also be used when the rest assembly 14 is functioning as a backrest.

Figure 23:
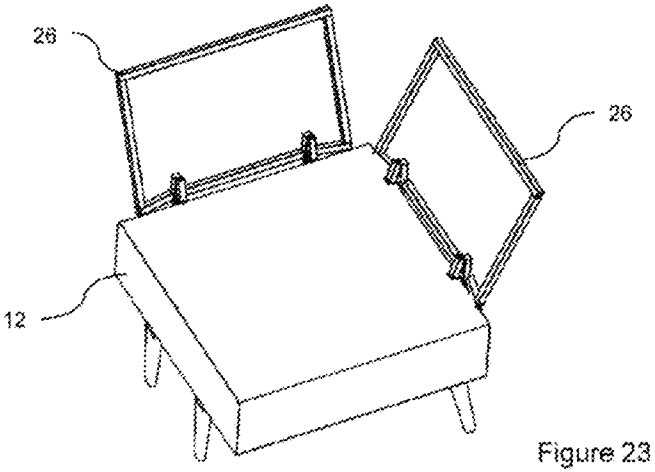
FIG. 23 shows two of the rest support frames of FIG. 22 mounted on a seat assembly with corner members removed from the rest support frames.
Figure 27:
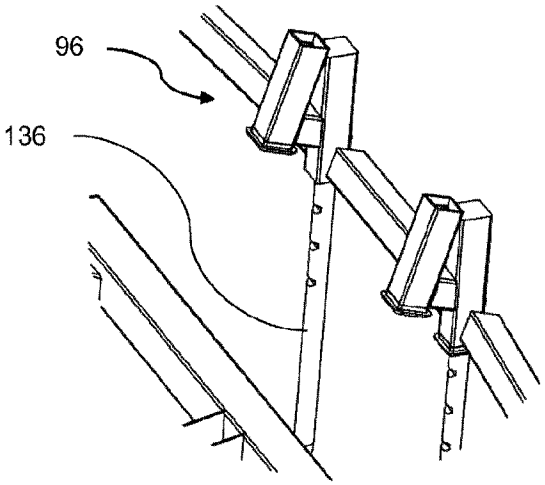
FIG. 27 shows a detailed view of an optional orientation of the rest support frame relative to the seat support frame of FIG. 26.

In use, when the rest assembly 14 is to be located adjacent a further rest assembly 14, the cover can be at least partially removed and the corner member 128 removed providing a configuration as shown in FIG. 23 to avoid adjacent members 128 from clashing.

Figure 28:
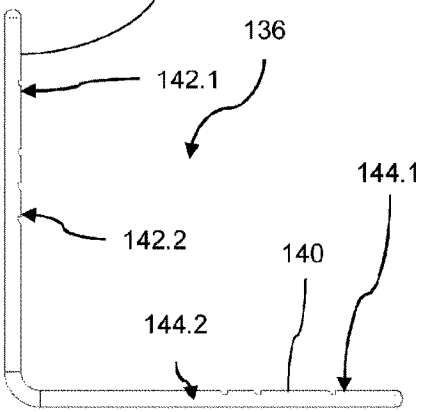
FIG. 28 shows an elongate connector, suitable for use with the seat and rest support frames shown in FIG. 26.
Figure 26:
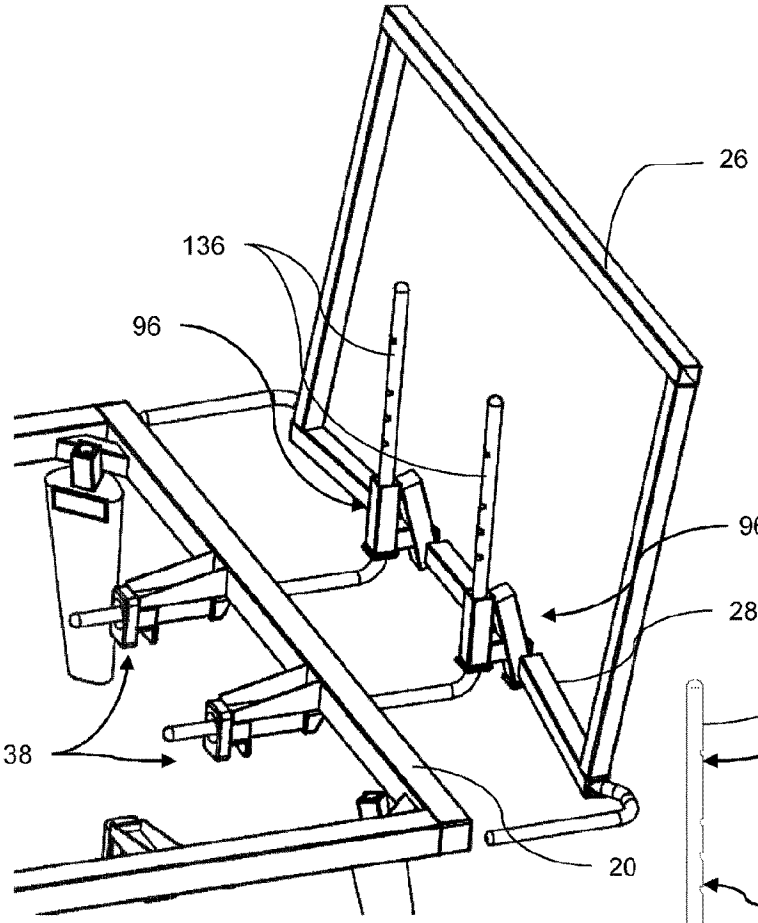
FIG. 26 shows a further example of a rest support frame, of the article of furniture, connected to a seat support frame of the article of furniture.

In the preceding discussion, the elongate connecting members 16, 114 are described as having a first portion that is shorter than a second portion. However, it will readily be appreciated that the first and second portions can be of the same length. For example, FIG. 28 shows an elongate connecting member 136 having first and second portions 138, 140 that are of substantially identical lengths. Furthermore, the first portion 138 has four recesses 142 that are substantially identical to the recesses 80. The second portion 140 has four recesses 144 that are substantially identical to the recesses 81. Furthermore, each set of recesses 142, 144 include a distal recess 142.1, 144.1 and three evenly spaced recesses 142.2, 144.2 that are grouped together with respect to the distal recess 142.1, 144.1. The sets of recesses 142, 144 are identically placed on the portions 138, 140. The need to flip or reorientate the connecting member 136 may be avoided. Furthermore, the connecting member 136 is reversible in the sense that reversing the connecting member 136 has no consequences. Thus, errors in assembly are avoided since it does not matter which of the portions are inserted into the associated sleeves or sockets.

Where the elongate connectors exceed a certain length, there is a risk that they will interfere with each other when adjacent rest assemblies 14 on the same seat are adjusted. Thus, as can be seen in FIG. 26, the sleeve assemblies 38 can be positioned closer together on the respective frame members 20 to avoid such interference. Likewise, the receiver assemblies 96 can also be positioned closer together to correspond with the sleeve assemblies 38.

Figure 29:
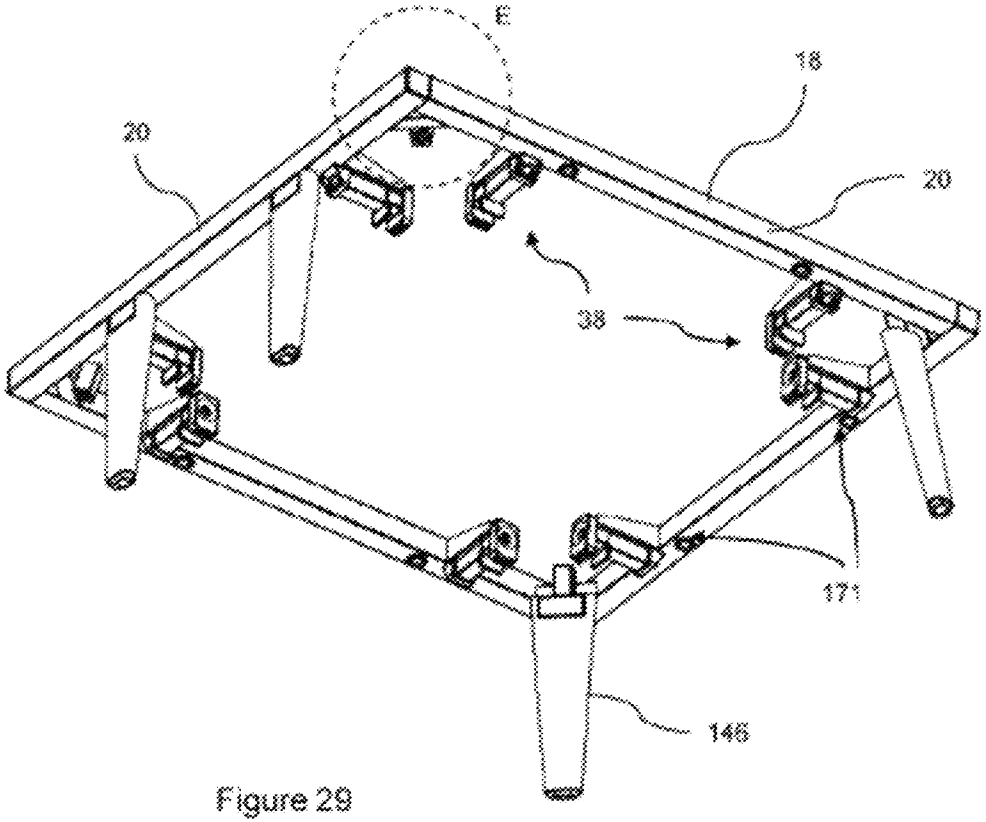
FIG. 29 shows a three-dimensional view, from below, of the seat support frame with legs of the article of furniture in one optional arrangement.

The seat assembly 12 includes a leg support system having four legs 146 (FIG. 29, for example). Details of the legs can be seen in FIGS. 32 and 33. Each leg 146 includes an elongate body 148. The body 148 has a flat side 150 and an opposed curved side 152. The body 148 also tapers inwardly from top to bottom. Two of the legs 146 can be positioned adjacent each other with their flat sides 150 in abutment or with a gap to accommodate tolerances in manufacturing. A temporary fastening arrangement, such as a patch 154 of a hook and loop fastener, for example that known as Velcro (trade mark), is arranged on the flat side 150 so that a cover of the seat assembly can be fastened in position, as described below.

Figures 31, 32, 33, 34, 35:
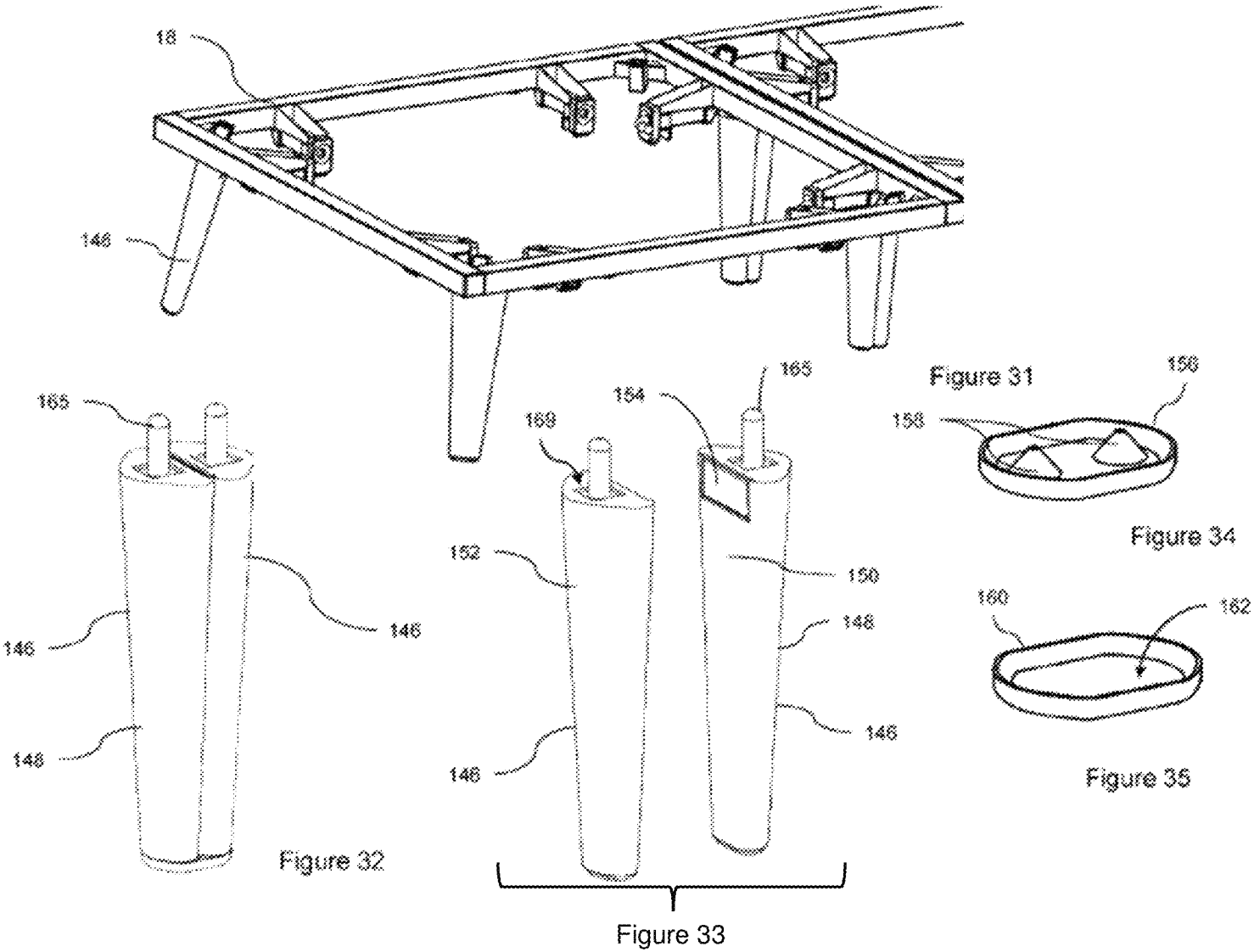
FIG. 31 shows two seat support frames connected together.
FIG. 32 shows respective legs of the two seat support frames arranged cooperatively.
FIG. 33 shows the two legs of FIG. 32 spaced apart, for illustrative purposes.
FIG. 34 shows one embodiment of an end cap for the legs in abutment with each other, as shown in FIG. 32.
FIG. 35 shows another embodiment of an end cap for the legs in abutment with each other, as shown in FIG. 32.
Figure 37:
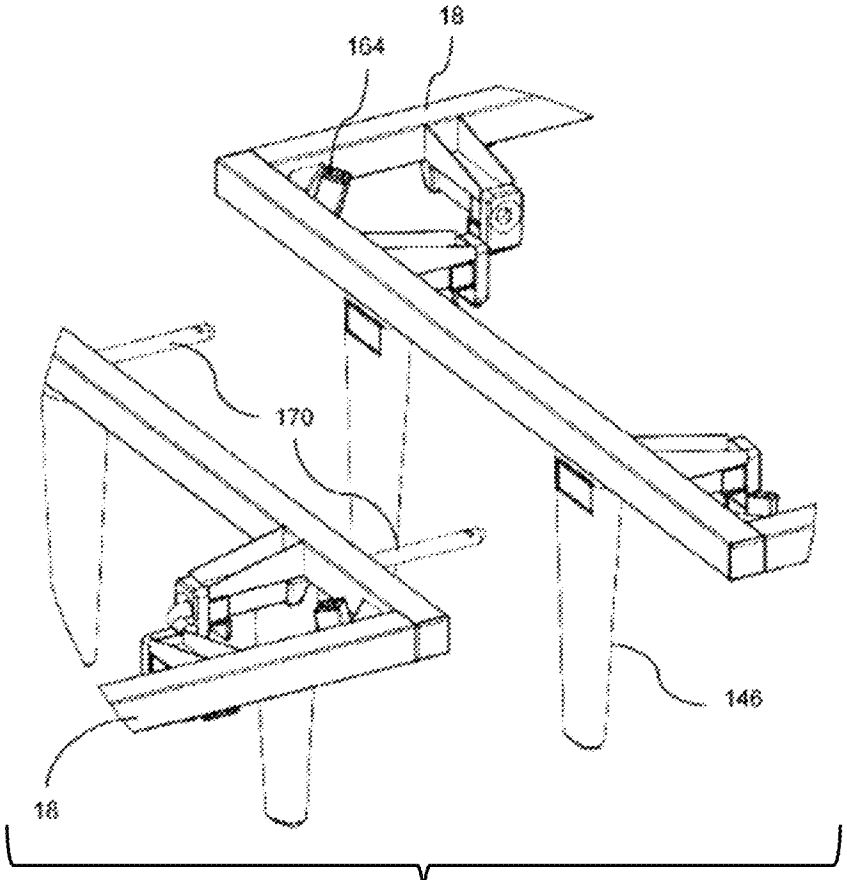
FIG. 37 shows the seat support frames of the seat assemblies of FIG. 36.
Figure 36:
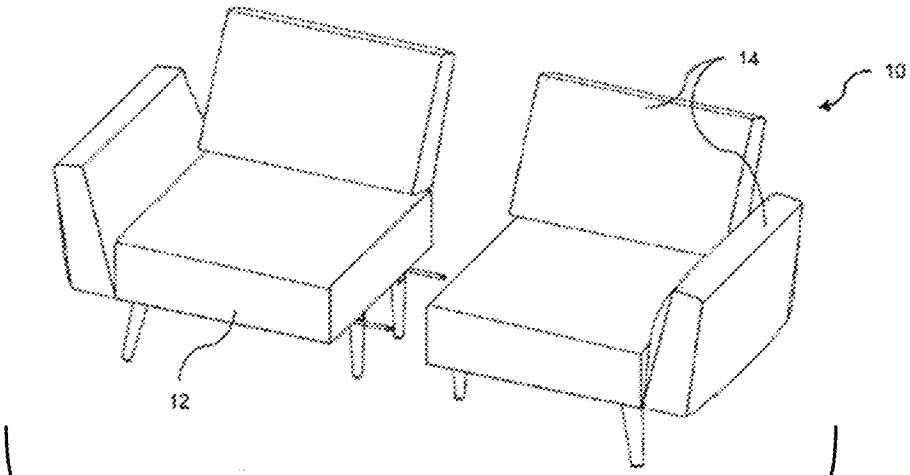
FIG. 36 shows a pair of seat assemblies immediately prior to connection to each other to form a two-seat sofa.

In FIG. 34, reference numeral 156 indicates an example of a suitable end cap that is engageable with both lower ends of the legs 146 when positioned adjacent each other, as described above. In this embodiment, the end cap 156 has two projections 158 that can be received in respective lower ends of the legs 146 for providing a suitable finish to the combined leg assembly and to assist in holding the legs 146 together. In FIG. 35, reference numeral 160 indicates another example of a suitable end cap that defines a receptacle 162 in which both lower ends can be received for providing the suitable finish and to assist in holding the legs 146 together.

Figure 30:
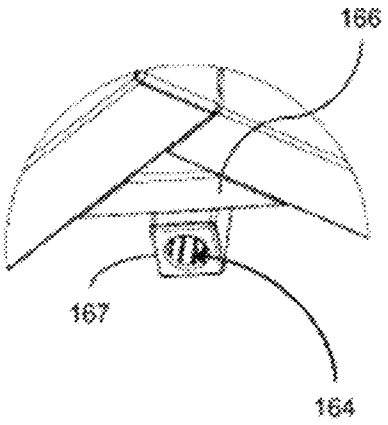
FIG. 30 shows a detailed view of the part E in FIG. 29.

Each leg 146 has a connector, in the form of a peg 165 so that the leg 146 can be connected to, or mounted on, the seat frame member 20. To that end, the seat frame member 20 has a number of sleeves 164 for receiving respective pegs 165. Detail of one of the sleeves 164 can be seen in FIG. 30. The sleeves 164 are arranged on respective corner brackets 166, as can be seen in FIG. 30. The sleeves 164 each include a sleeve body 167 that extends downwardly from the bracket 166. The corner brackets 166 interconnect adjacent frame members 20. Thus, a leg 146 can be mounted at each corner of the frame 18, slightly inwardly of the corner to allow fastening of a cushion assembly to the frame members 20.

Each peg 165 is in a square recess 169. Each sleeve body 167 has a square profile, the recess 169 and the sleeve body 167 being dimensioned so that the sleeve body 167 can nest in the recess 169 to inhibit subsequent rotation of the leg 146 relative to the frame 18. The recess 169 is oriented so that the curved sides 152 of the legs 146 face diagonally outwards.

It will be appreciated that, when placed side-by-side to provide a sofa, chaise lounge, or the like, it would not be aesthetically desirable for each of the frame members 20 to have the legs 146 at each corner. The appearance would be simply of single seats placed side-by-side with too many legs 146 being visible. Thus, each of the members 20 has two sockets 171 positioned inwardly from the respective ends of the members 20 to receive the pegs 165. Thus, where two or more members 20 are positioned side-by-side, legs 146 can be mounted on the adjacent members 20 using the sockets 171. Those legs 146 can be oriented so that corresponding legs 146 of adjacent members 20 can have their flat sides 150 put together to provide, with the curved sides 152, the appearance of a single leg. The sockets 171 are positioned so that the flat sides 150 of corresponding legs 146 are brought into face-to-face alignment and face each other for location purposes and the legs 146 are also spaced inwardly to have reduced visibility. As a result, the article of furniture has a composite or one-piece appearance rather than the appearance of articles of furniture simply placed side-by-side. Furthermore, with legs 146 at the corners of the frame 18, the legs 146 are aesthetically acceptable.

Currently, other adaptable sofas use a single leg that is located between adjacent seat support structures. This can provide a similar look to that described above. However, the use of a single leg restricts adaptability of the sofa. For example, the single leg would have no use if the sofa were to be converted to two single seaters. Such a conversion would require the user to purchase additional legs.

The way adjacent seat assemblies are connected is illustrated in FIGS. 36 to 40.

Figure 38:
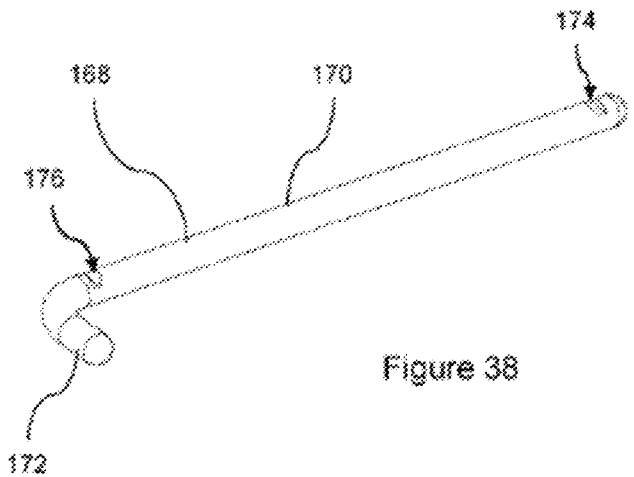
FIG. 38 shows an elongate connector used for connecting the seat support frames together.
Figure 40:
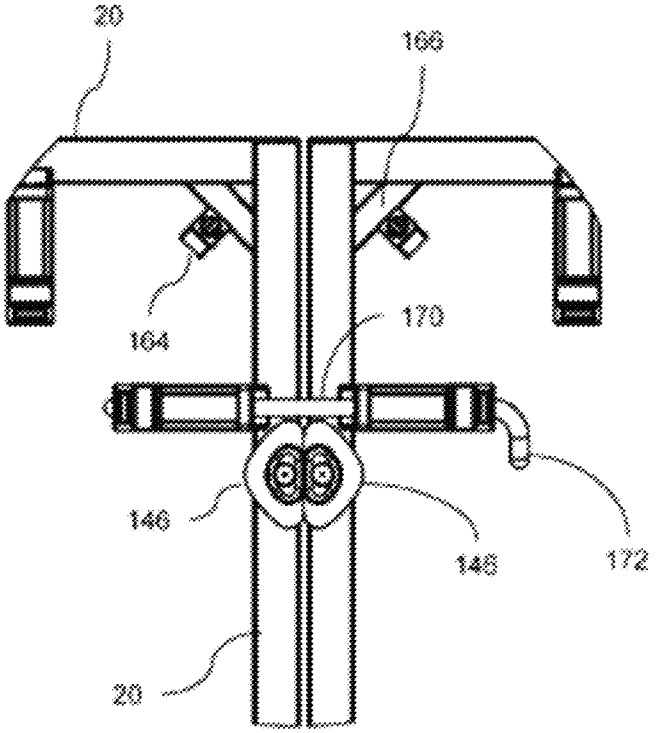
FIG. 40 shows a bottom plan view of the seat support frames of FIG. 39 connected together illustrating the way the elongate connector is used.
Figure 39:
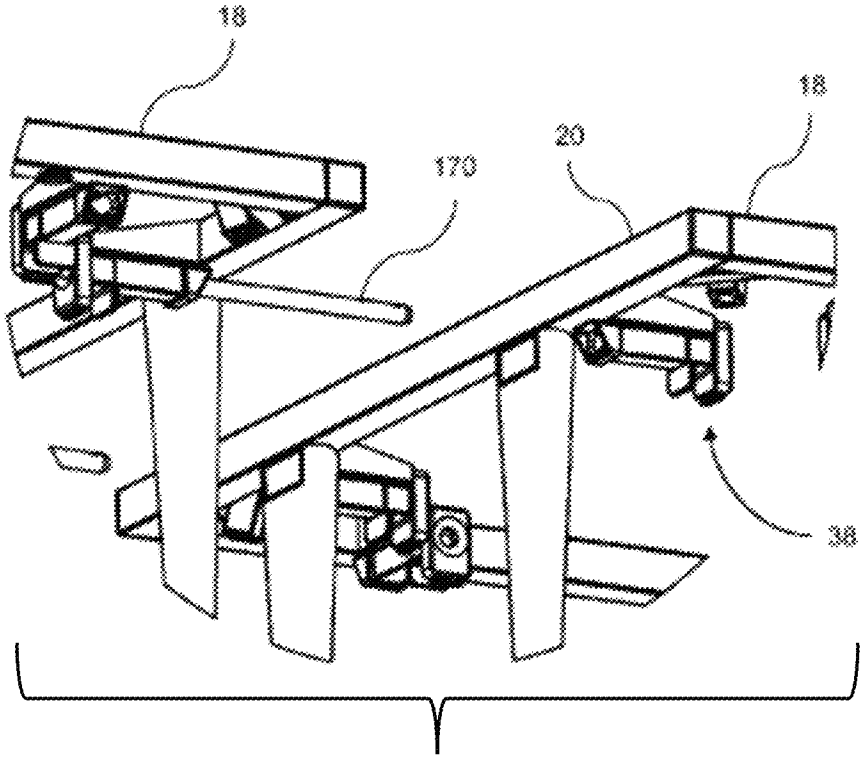
FIG. 39 shows the seat support frames of FIG. 37 from underneath, with the elongate connector of FIG. 38 in an operative position.

When the adjacent seat assemblies 12 are brought together, the sets of two sleeve assemblies 38 on each frame member 20 are brought into alignment with each other. The article of furniture includes a number of elongate seat connectors 168, one of which is shown in FIG. 38. The seat connector 168 has a major locking portion 170 and a minor handle portion 172 that is angled with respect to the locking portion 170 to facilitate manipulation of the connector 168. The seat connector 168 has cross sectional dimensions that are similar to those of the elongate connectors 16, 114, 136. A free end of the locking portion 170 is rounded or chamfered so that the locking portion 170 can act on the catch assemblies 66 of corresponding sleeve assemblies 38 in the manner described above with reference to the locking assembly 58.

The locking portion 170 includes a distal recess 174 and a proximal recess 176. The recesses 174, 176 are positioned so that, when the frame members 20 are brought into side-by-side abutment to form the article of furniture, the locking portion 170 can be inserted through the aperture 72 and the passageway 64 of one sleeve assembly 38 and into the passageway 64 and through the aperture 72 of the aligned sleeve assembly 38. The recesses 174, 176 are positioned so that the pins 77 of the associated locking assemblies 58 can be received in the recesses 174, 176 to retain the locking portion 170 against subsequent withdrawal and so releasably fasten the adjacent seat frame members 20 together. Removal of the locking portion 170 can be achieved by manipulation in the form of partial rotation, of the locking portion 170 by manipulation of the handle portion 172 so that the recesses 174, 176 rotate out of engagement with the pins 77. The handle portion 172 is positioned about 90° out of alignment with the recesses 174, 176. Thus, when the seat connector 168 is in the operative, locked condition, the handle portion 172 is angled upwardly and so does not interfere with an area or volume beneath the frame members 20 and has a reduced visibility.

The fact that the support frames 18 are locked together in the manner described above inhibits rocking of the article of furniture 10. If the support frames 18 were not locked together and the legs 146 were spaced inwardly, as described above, to achieve the aesthetically pleasing result, the seat and associated rest assembly 12, 14 would tend to rock back, in use, because it would not have support at all four corners.

The caps 156, 160 can be useful for locating the seat assemblies 12 together for connection in the manner described above. In use, the legs 146 of one seat assembly 12 that depend from the sockets 171 can be positioned in the caps 156, 160. Corresponding legs 146 from the seat assembly 12 that is to be connected are then also positioned in the caps 156, 160. Given that the position of the legs 146 relative to the sleeve assemblies 38 is fixed, this serves to accurately locate the sleeve assemblies 38 relative to each other for insertion of the elongate connectors 170. It is to be noted that the caps 156, 160 can be dispensed with in those cases in which the seat assemblies 12 are slid towards each other.

Figure 41:
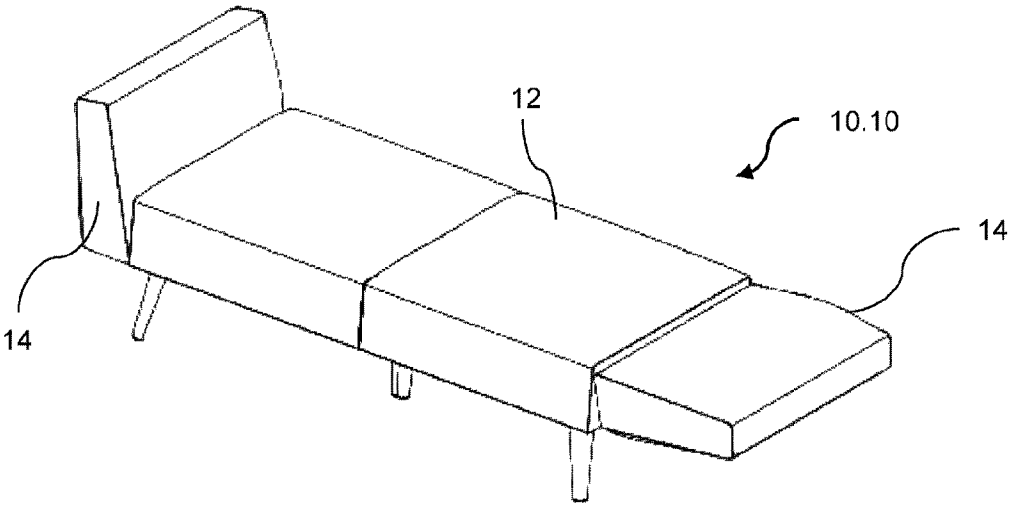
FIG. 41 shows a three-dimensional view of the article of furniture, in accordance with the invention, forming a single bed assembly.
Figure 42:
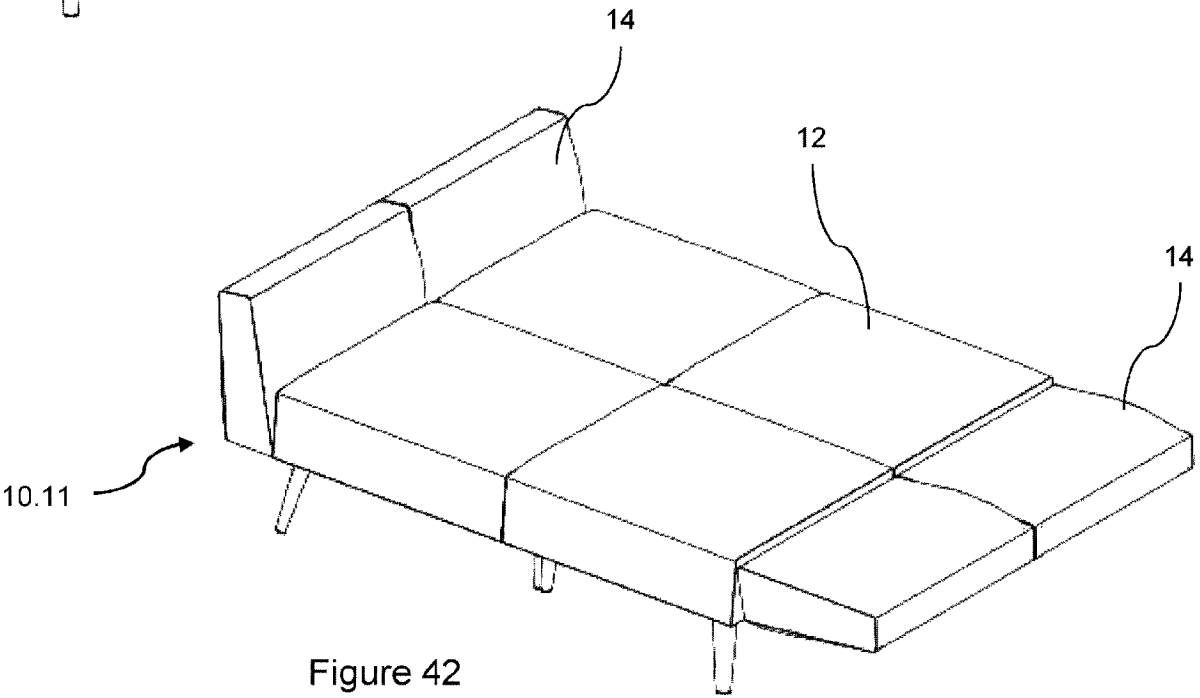
FIG. 42 shows a three-dimensional view of the article of furniture, in accordance with the invention, forming a double bed assembly.
Figures 43, 44:
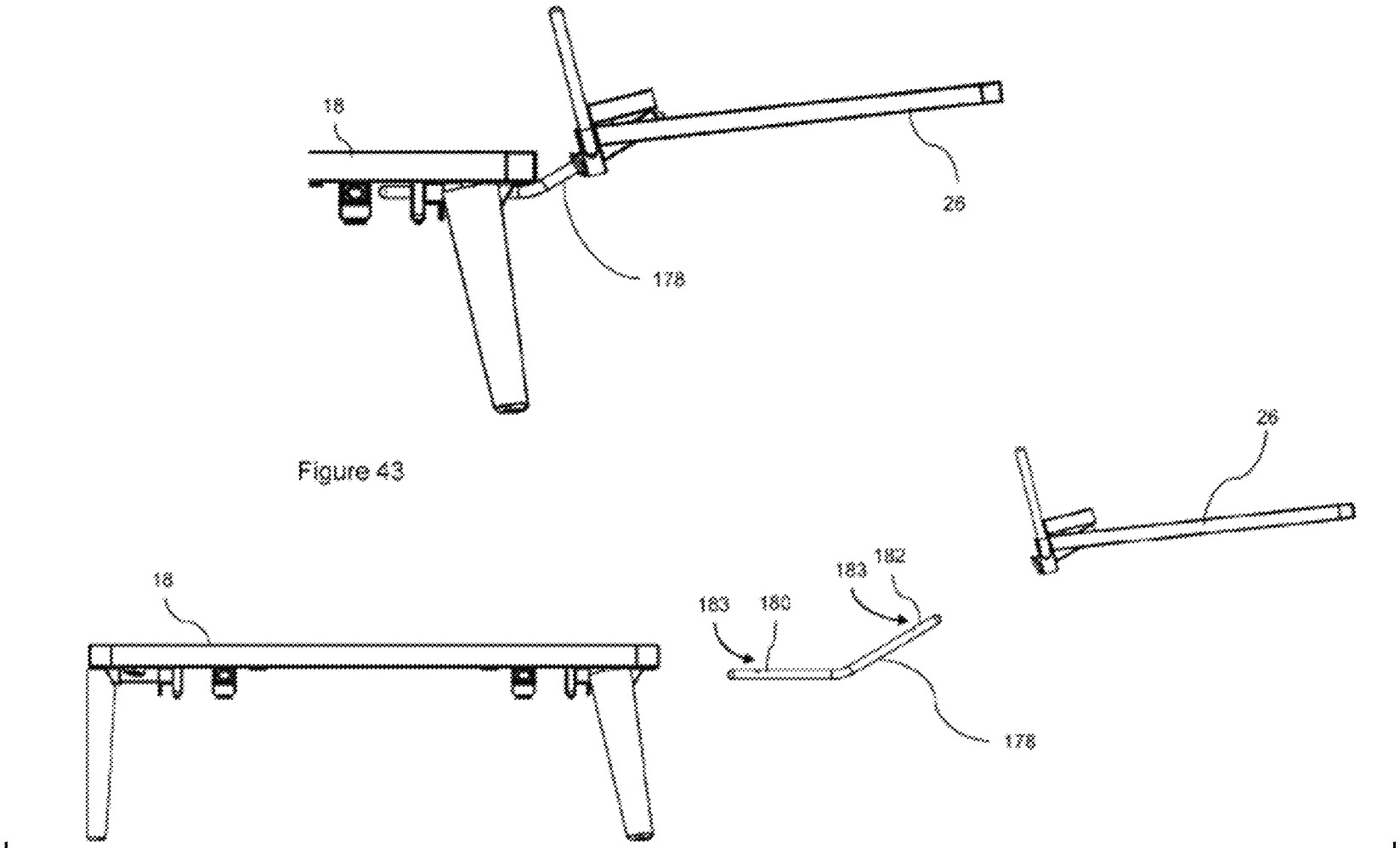
FIG. 43 shows a side view of a seat assembly and rest assembly connected together for either the single or double bed assembly.
FIG. 44 shows a side view of the seat assembly and rest assembly of FIG. 45 in an exploded condition.
Figure 46:
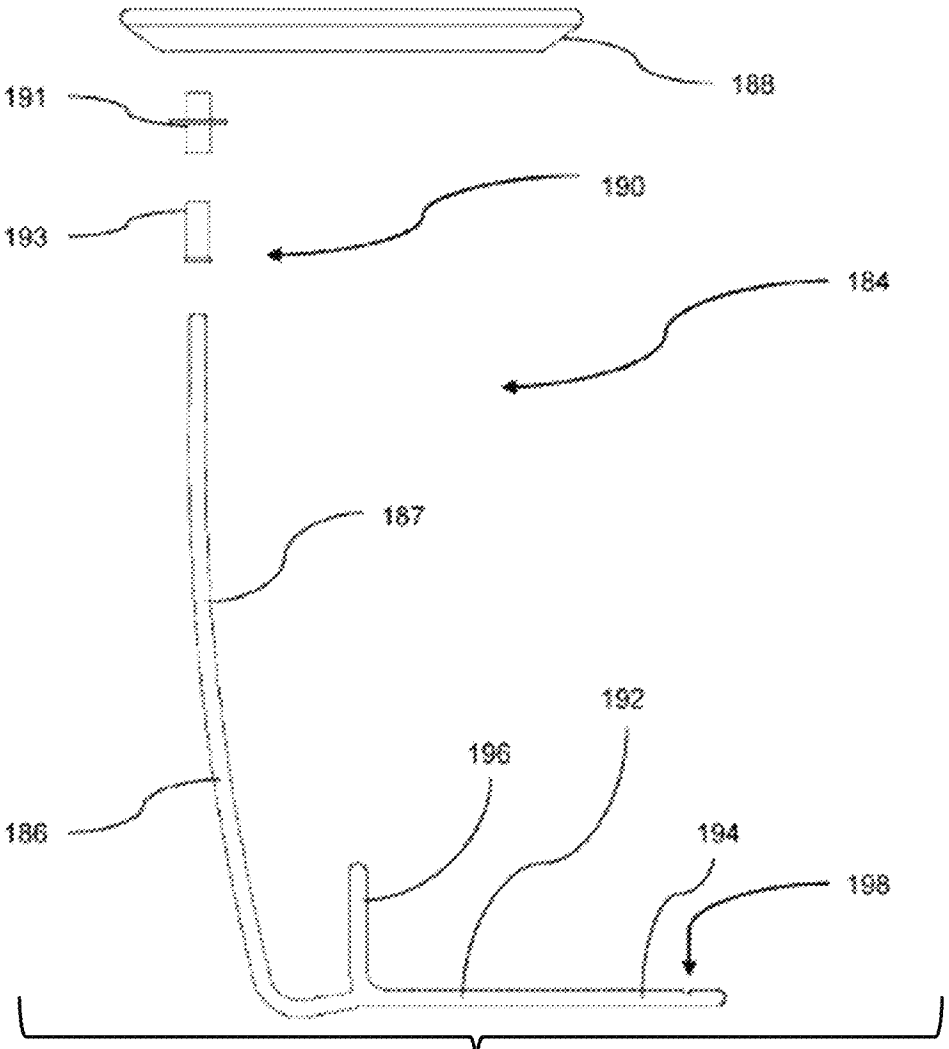
FIG. 46 shows a side exploded view of the table assembly of FIG. 45.
Figure 45:
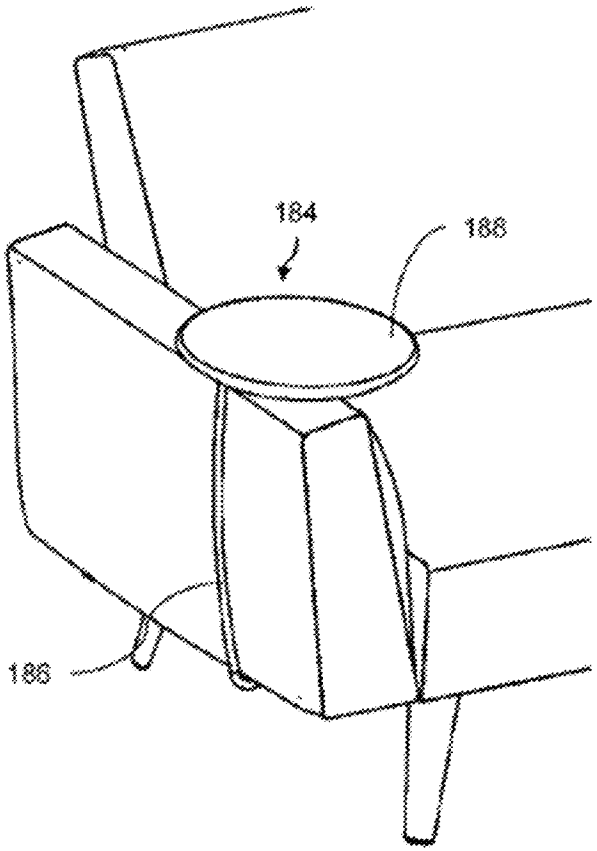
FIG. 45 shows a three-dimensional view of an embodiment of a table assembly connected to the article of furniture in the form of a seat, chair or sofa.
Figure 48:
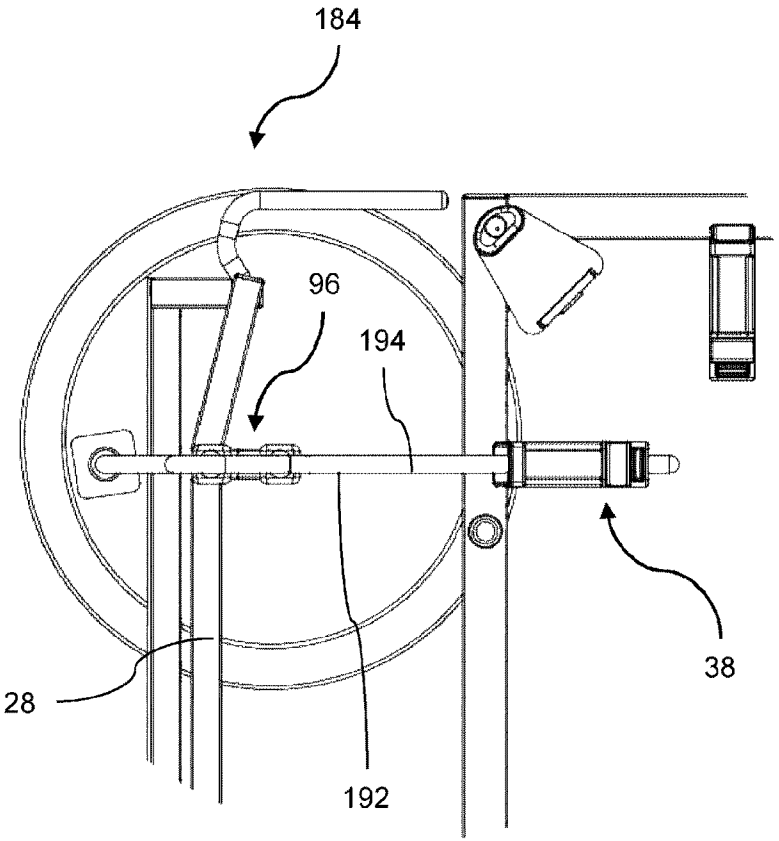
FIG. 48 shows an underneath plan view of the table assembly connected to the seat support frame.
Figure 47:
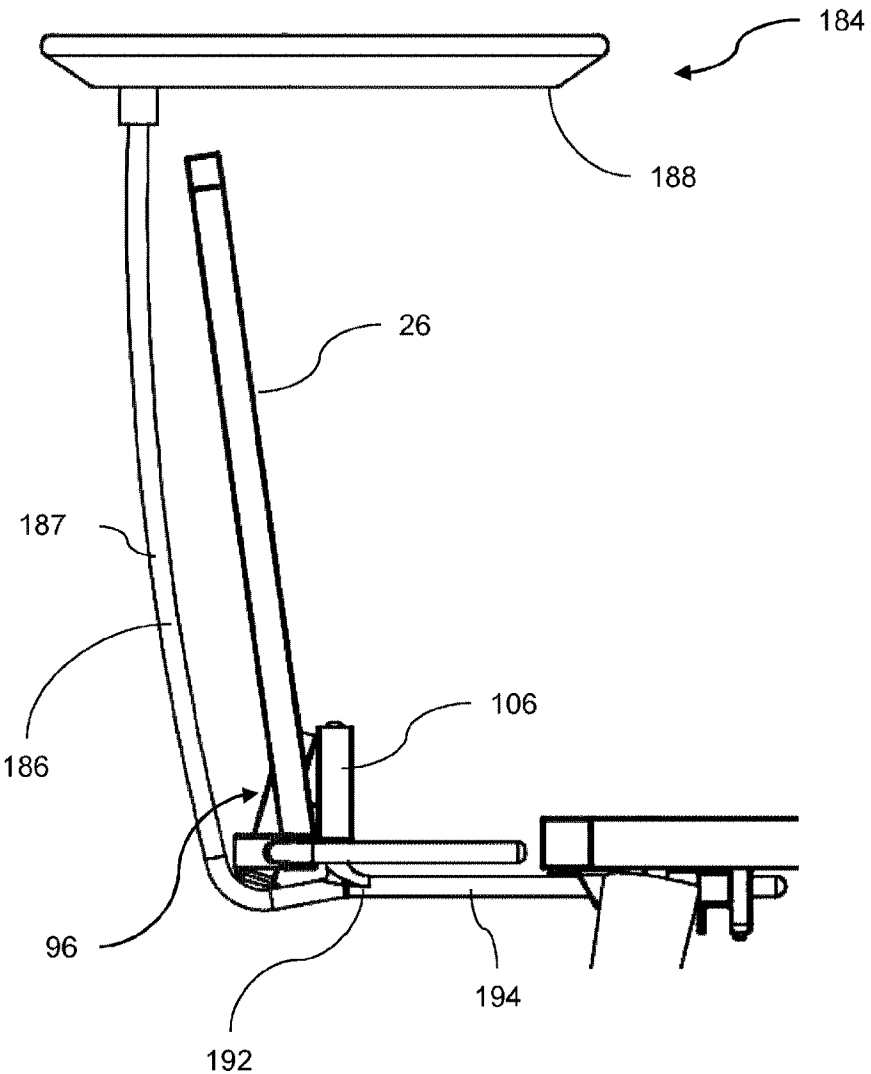
FIG. 47 shows a side view of the table assembly connected to a seat support frame of the article of furniture.

In FIGS. 41 to 44, there is shown an example of an article of furniture, in the form of a single or double bed that can be achieved with the components described above, and using elongate connectors 178 in which an angle between a first portion 180 and a second portion 182 is selected so that rest assemblies 14 can be positioned generally horizontally as can be seen in FIGS. 41 and 44. Thus, the angle between the first and second portions 180, 182 is greater than the angle between the first and second portions of the elongate connectors 16, 114, 136. In this example, a single bed, shown in FIG. 41, can be achieved with two seat assemblies 12 connected together, in the manner described above. A rest assembly 14, in an armrest function, is connected to one of the seat assemblies 12 and a rest assembly 14, in a generally horizontal orientation, is connected to the other of the seat assemblies 12, using the elongate connectors 178, in the manner described above with reference to the elongate connectors 16. The rest assemblies 14 and the seat assemblies 12 are connected along a line to define the single bed. In FIG. 42, the seat assemblies 12 of one single bed are connected to the seat assemblies 12 of another single bed, in the manner described above, using the elongate seat connectors 168, to provide a double bed. It will be appreciated that a width of the bed can be increased further depending on the number of rest assemblies 14 and seat assemblies 12 utilised.

As can be seen in FIGS. 43 and 44, the first portion 180 of the elongate connector 178 is received in the sleeve assembly 38, in the manner described above with reference to the first portion 34 of the elongate connector 16. The second portion 182 of the elongate connector 178 can be received in either the socket assembly 98 or the sleeve assembly 106, in the manner described above with reference to the second portion 36 of the elongate connector 16. In FIG. 43, the second portion 182 is received in the socket assembly 98.

Both portions 180, 182 of the elongate connector 178 define recesses 183 such that the portions 180, 182 are identical. The recesses 183 are identical to the recesses described above. Thus, the user is prevented from incorrectly inserting a portion into the sleeve assembly 38. It will readily be appreciated that the portions 180, 182 can have different lengths, if required.

In FIGS. 45 to 48, reference numeral 184 generally indicates a table assembly for use with the article of furniture 10.

The table assembly 184 includes an elongate support arm assembly 186. The support arm assembly 186 includes a mounting assembly 190 to facilitate the mounting of a tabletop 188 onto the support arm assembly 186. The mounting assembly 190 includes a connector 191 that is fastened to an underside of the tabletop 188. The connector 191 can be of steel. An insert 193 interconnects an operatively vertical portion 187 of the support arm assembly 186 and the connector 191 to secure the tabletop 188 to the support arm assembly 186. A support structure 192 extends from an operatively lower end of the vertical portion 187 and is configured to engage with at least one of a socket assembly 38 and a sleeve assembly 106 to secure the support arm assembly 186 to the article of furniture.

More particularly, the support structure 192 includes a generally horizontal section 194 that can be received in one of the sleeve assemblies 38 and an operatively upwardly extending section 196 that can be received in the corresponding sleeve assembly 106 of the rest assembly 14, such that the vertical portion 187 extends upwardly along an outside of the rest assembly 14 to support the tabletop 188 above the rest assembly 14. The support structure 192 can thus function as one of the elongate connectors 16, as described above. To that end, the horizontal section 194 defines a recess 198 that is substantially identical to either of the recesses 80, 81 found on the elongate connector 16. This allows the horizontal section 194 to be releasably locked to the seat frame member 20 in the manner described above with reference to the elongate connector 16. Furthermore, the generally vertical section 196 is received through the sleeve assembly 106 as described above with reference to the elongate connector 16. In this configuration, the support arm assembly 186 is inhibited from rotation.

Given the location of the sleeves 38 and the corresponding receiver assemblies 96, it is possible to locate the table assembly 184 either towards the front or the rear of the rest assembly 14.

It will be appreciated that the table assembly 184 integrates with the existing componentry of the article of furniture 10. Thus, no additional manufacturing cost is added to the seat assembly 12 and rest assembly 14 to accommodate the table assembly 184.

Figure 49:
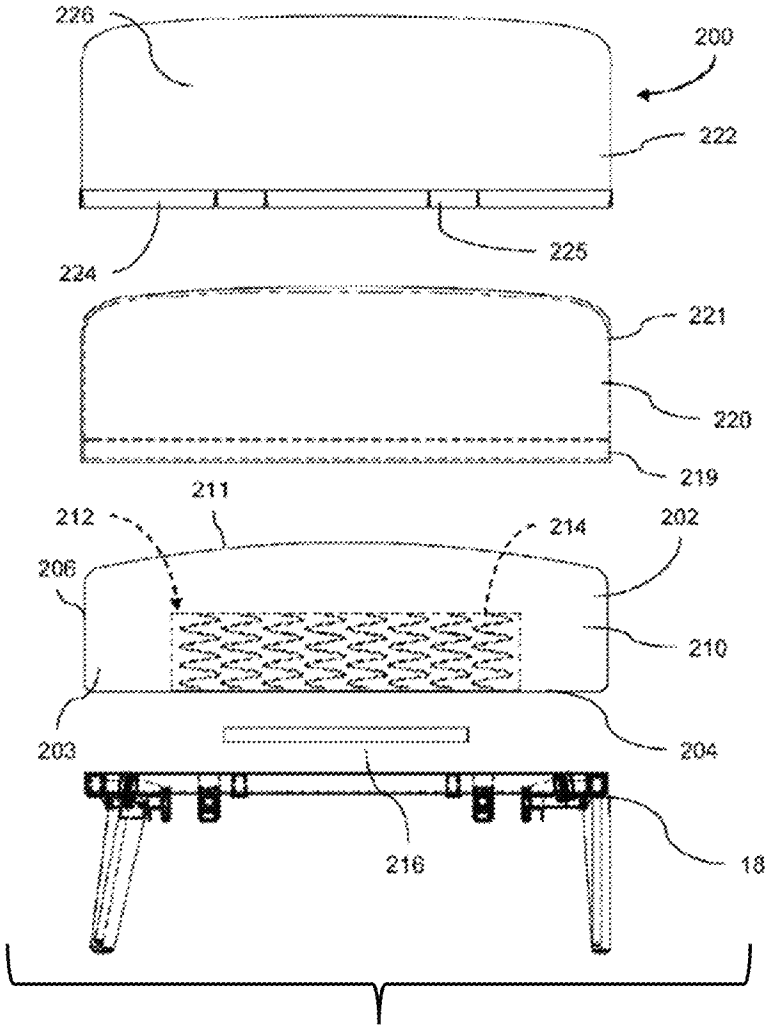
FIG. 49 shows a seat cushion assembly, in an exploded or disassembled configuration, of the seat assembly of the article of furniture.
Figure 56:
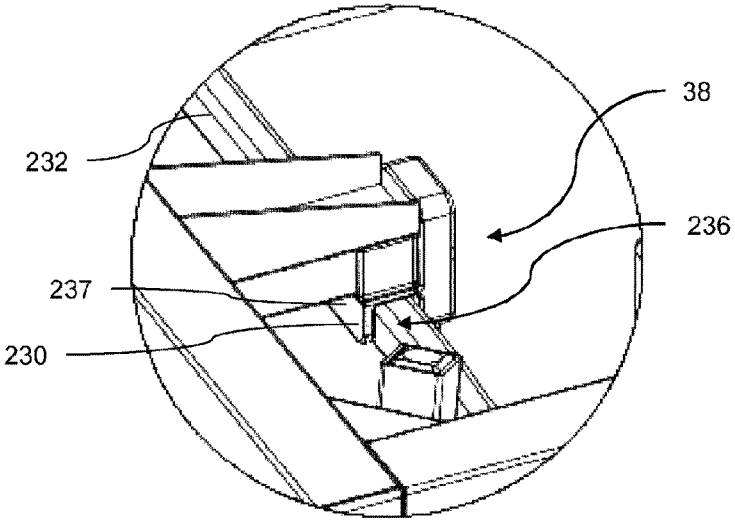
FIG. 56 shows a detailed view of the part F in FIG. 55.

In FIGS. 49, 51 and 52, reference numeral 200 generally indicates a cushion assembly for use with the article of furniture. The cushion assembly 200 forms part of the seat assembly 12.

The cushion assembly 200 includes a seat insert 202 having a body 203 of a conventional seat filler. The body 203 has a generally flat bottom and sides 204, 206 and a top 211 with an upwardly curved profile.

The body 203 defines an internal cavity 212. The cavity 212 opens at the bottom 204. A self-contained spring assembly 214 is received in the cavity 212 and is configured for removal and replacement. The seat insert 202 does not include pocket springs that are glued to the filler material as is often the case with conventional cushion assemblies. Thus, the spring assembly 214 can be removed for replacement or recycling as a separate component to the body 203.

The seat insert 202 is configured for location on the seat support frame 18. Thus, the foam core 202 is dimensioned so that the sides 206 can be positioned in general alignment with outer edges of the side frame members 20. A spring bolster 216 is optionally interposed between the spring assembly 214 and the seat support frame 18.

The seat insert 202 is received in an insert cover 220 and is secured within the insert cover 220 with a zip, for example.

The insert cover 220 incorporates quilting or lining, for example of polyester wadding such as that called Dacron (Trade Mark), so that the insert cover 220 can be removed and refitted or replaced repeatedly without damage to the quilting or lining. Thus, a cushion cover, as described below, can be repeatedly removed and replaced, for example for washing, with little damage to any lining or wadding which would usually be positioned over the insert. Conventionally, such lining or wadding can be damaged as a result of removal and refitting of cushion covers.

The lining cover 220 includes a skirt 219 that depends from a cover portion 221. Fastening material, for example that known as tricot fabric, is attached to an underside of the frame 18. The skirt 219 includes a complementary fastening material, such as the hook material of a hook and loop fastener known as Velcro (Trade Mark), that is fastenable to the tricot fabric on the underside of the frame, thus securing the lining cover 220, containing the insert 202, to the frame 18.

A cushion cover 222 is configured to fit over the liner 220 and the seat insert 202. As with the liner 220, the cover 222 is configured for repeated fitting and removal. The cover 222 can be of any suitable material, such as luxury material or material suited for repeated washing and replacement.

The cushion cover 222 includes a hem 224 that extends from a lower edge of a body 226 of the cover 222. The hem 224 incorporates a fastening material that is complementary to the fastening material of the skirt 219. Thus, the hem 224 can be releasably fastened to the side frame members 20, by being releasably fastened to the fastening material of the skirt 219.

The hem 224 includes discrete flaps 225 that can be fastened to the patches 154 on the legs 146 further to secure the cover 222 in position.

The cushion assembly 200 lends itself to recycling. For example, the spring assembly 214 can be removed without destroying the foam core 202, allowing the spring assembly 212 to be recycled as a metal object. With conventional cushion assemblies, it is usually necessary to discard the foam with the metal spring assembly embedded in the foam such that recycling of the spring assembly is not possible.

Furthermore, assembly and disassembly of the entire cushion assembly 200 is relatively simple, allowing a user to easily wash or replace the separate components of the cushion assembly 200.

Figure 50:
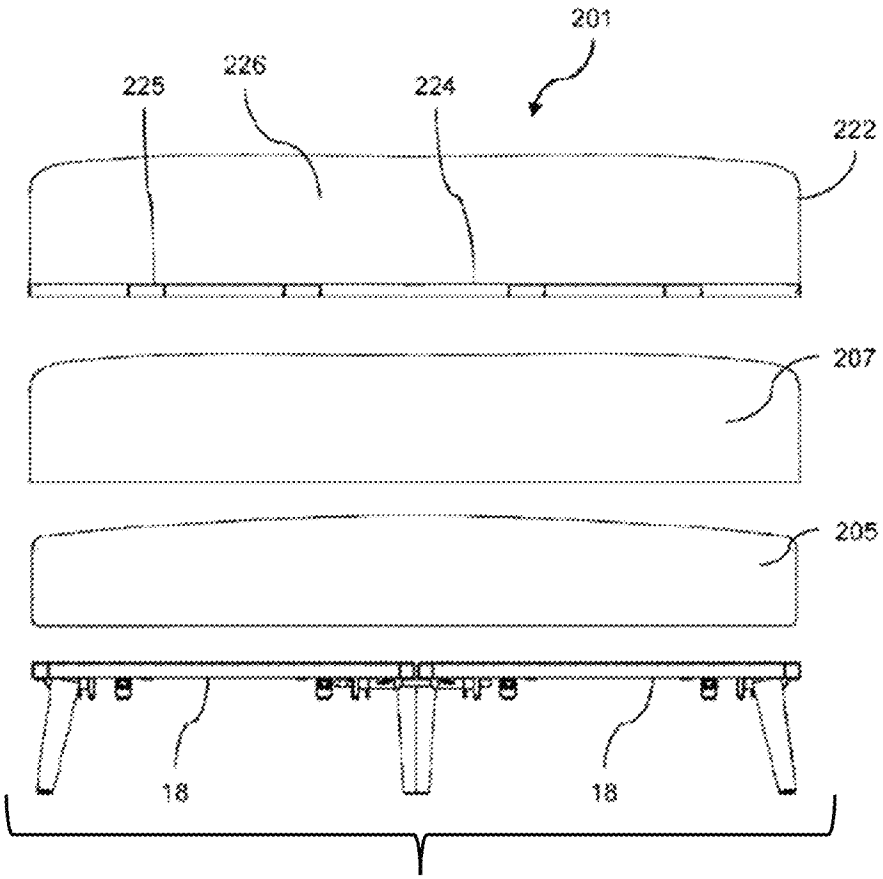
FIG. 50 shows another example of a seat cushion assembly, in an exploded view.

In FIG. 50, reference numeral 201 generally indicates a cushion assembly for use with two seat support frames 18 that are connected. The cushion assembly 201 provides a single piece component with a length of two of the cushion assemblies 200.

The cushion assembly 201 includes a seat insert 205 that is similar to the seat insert 202 apart from being longer. The seat insert 205 can include one or two self-contained spring assemblies that are similar to the spring assembly 214 and located in one cavity or two respective discrete cavities.

The seat insert 205 can be received in a wadding/liner cover 207 that is similar to the cover 220. Likewise, the wadding/liner cover 207 containing the seat insert 205 can be received in a cushion cover in a similar fashion as is the seat insert 202 and cover 220 received in the cover 222.

The cushion assembly 201 provides users with an option of purchasing a single rectangular cushion that can be shipped and transported in packages that would be as small as those used for the cushion assembly 200. As a result, this allows stocked inventory lists not to be overly increased by supplying the cushion assembly 201. The cushion assembly 201 provides users with a further option of converting two single seats on a sofa into a single double seat.

It will be appreciated that the cushion assembly 200, 201 is particularly configured for disassembly and reassembly by the consumer. This allows the consumer to replace individual components of the cushion assembly 200, 201. For example, the covers could be replaced when worn or when the user wishes to upgrade the article of furniture or wishes to use the article of furniture in a high-wear environment, such as a playroom. Furthermore, this replacement could be useful if a user wishes to change a colour scheme of a particular room or if the article of furniture is to be moved to a room with a colour scheme that does not match that of the article of furniture. This adaptability is particularly useful for those users who move homes frequently, as is becoming more and more common as property prices increase and residents rent for longer periods.

The ability to selectively replace the components of the cushion assembly 200, 201 also results in a convenient and cost-effective manner of storage and transport. For example, with the spring assembly 214 removed, the cover 209, 222, the cover 207, 220 and the seat filler can be vacuum bagged to save space and thus provide for efficient transport.

Figure 54:
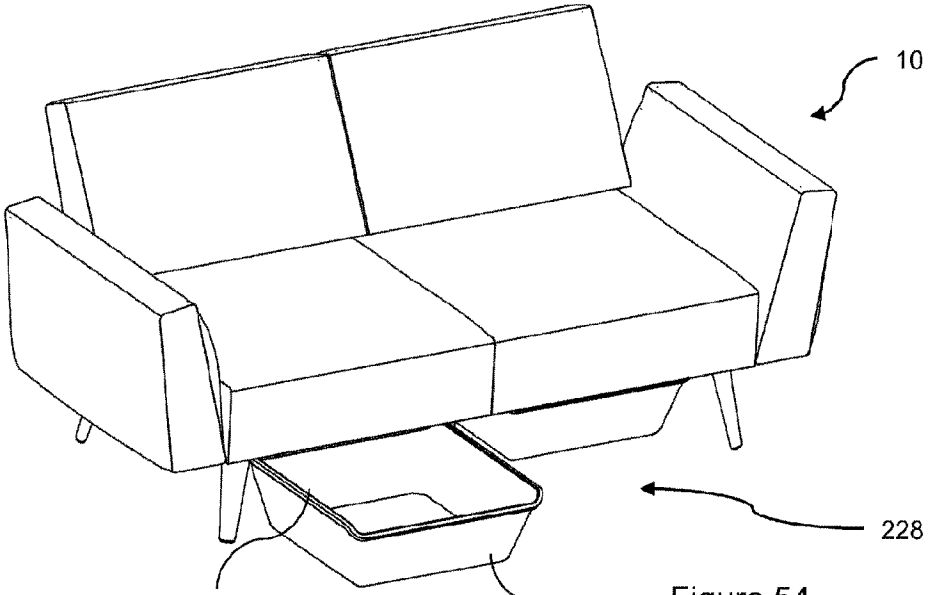
FIG. 54 shows the article of furniture with a storage system including two storage receptacles.
Figure 55:
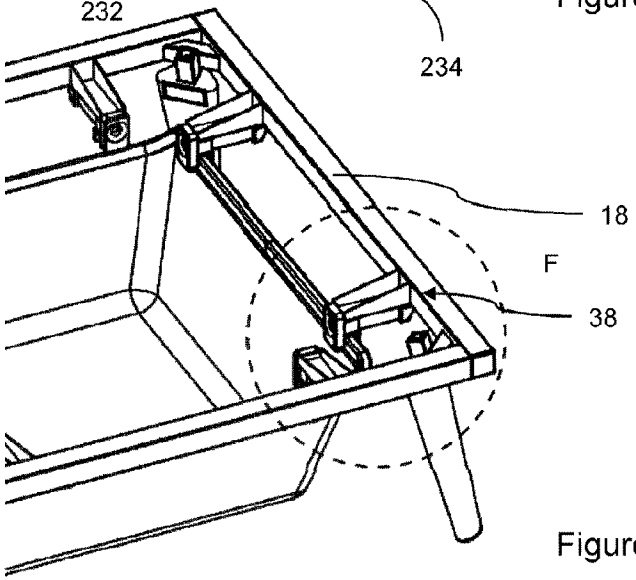
FIG. 55 shows a three-dimensional view, from above, of the receptacle in position under a seat support frame.

In FIG. 54, there is illustrated a storage system, generally indicated with reference numeral 228 for the article of furniture 10.

The storage system 228 utilises a runner formation 230 which is arranged on each sleeve assembly 38, as can be seen clearly in FIGS. 16 to 21. The runner formation 230 is configured to engage with an upper lip 232 of a storage tray 234 that is received under the seat support frame 18 and between the legs 146. It will be appreciated that each frame member 20 includes two aligned runner formations 230. Thus, the runner formations 230 on opposite sides can engage with lips 232 on opposite sides of the storage tray 234.

Each runner formation 230 is in the form of a channel 236 defined by the housing 60 of the locking assembly 58 and an operatively downwardly extending wall 237 (as can also clearly be seen in FIGS. 16 to 21) spaced outwardly from the housing 60. The channels 236 open downwardly to receive the lip 232 so that movement of the storage tray 234 in and out from underneath the seat support frame 18 can be guided by the channels 236. The storage tray 234 can be wheeled to facilitate movement to and fro with respect to the seat support frame 18.

The wall 237 also protects the locking assembly 58 in the event of the seat support frame 18, without legs, being dropped which could damage the locking assembly 58 without protection. The wall 237 is positioned below the holder 52, which is of steel. Thus, the wall 237 is able to transfer the impact to the holder 52 which is capable of absorbing the impact. To that end, the wall 237 extends at least as far downwardly as the housing 60.

In FIGS. 57 to 60, there is shown an alternative seat support frame 238 and rest support frame 240 that can be connected in various ways to achieve different configurations of an article of furniture.

Figure 62:
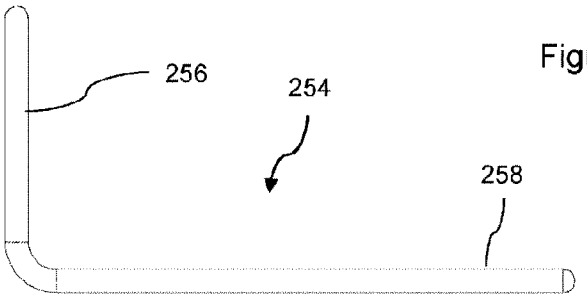
FIG. 62 shows another example of an elongate connector for connecting the seat support and rest support frames together, as shown in FIG. 60.
Figure 61:
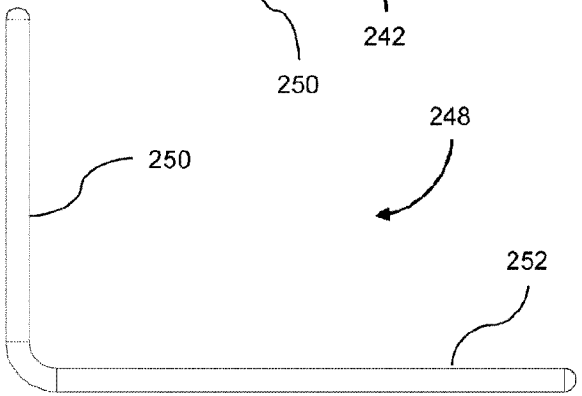
FIG. 61 shows one example of an elongate connector for connecting the seat support and rest support frames together, as shown in FIG. 57.
Figure 63:
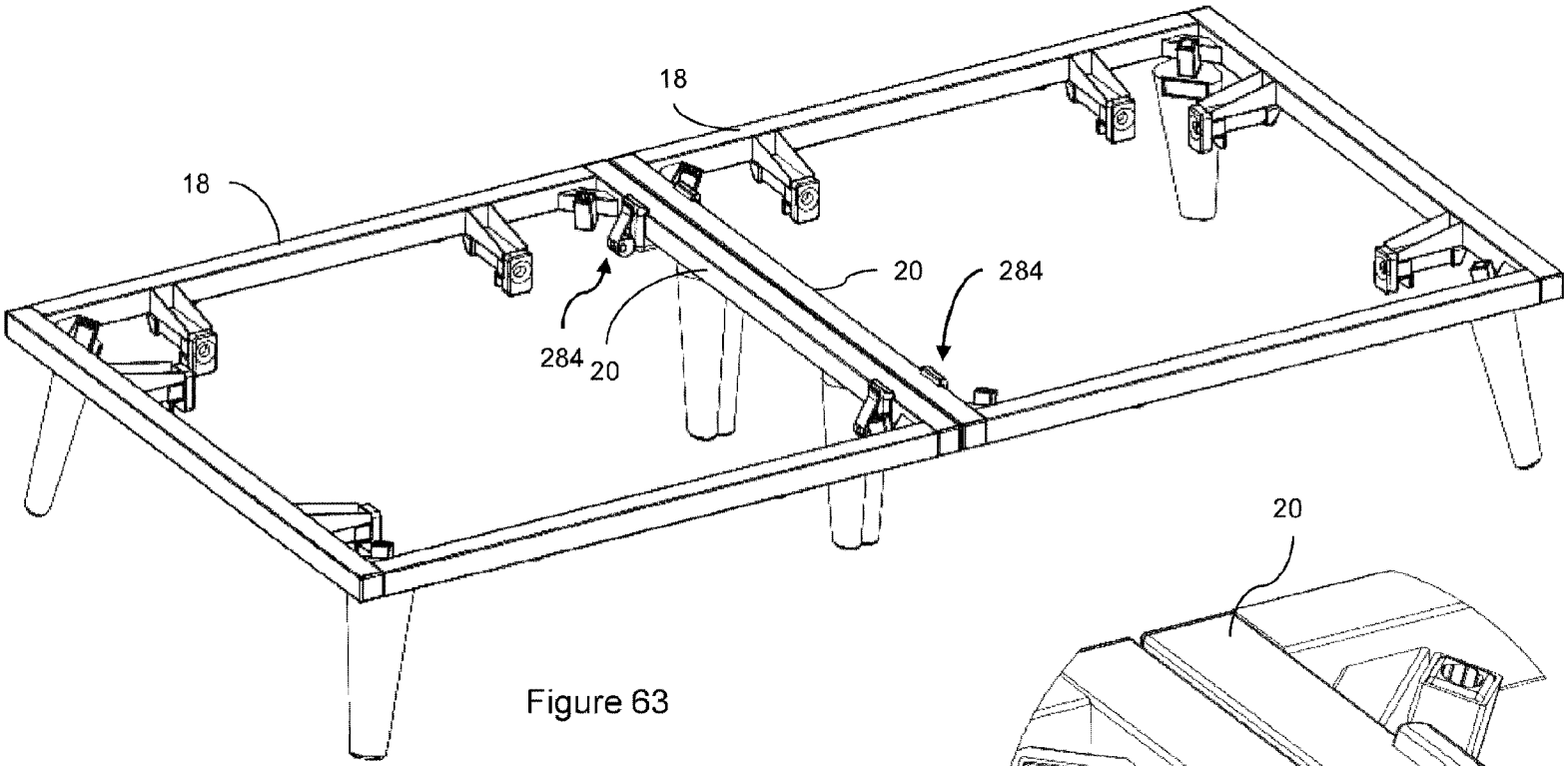
FIG. 63 shows two seat assemblies connected together with a clamp assembly.
Figure 64:
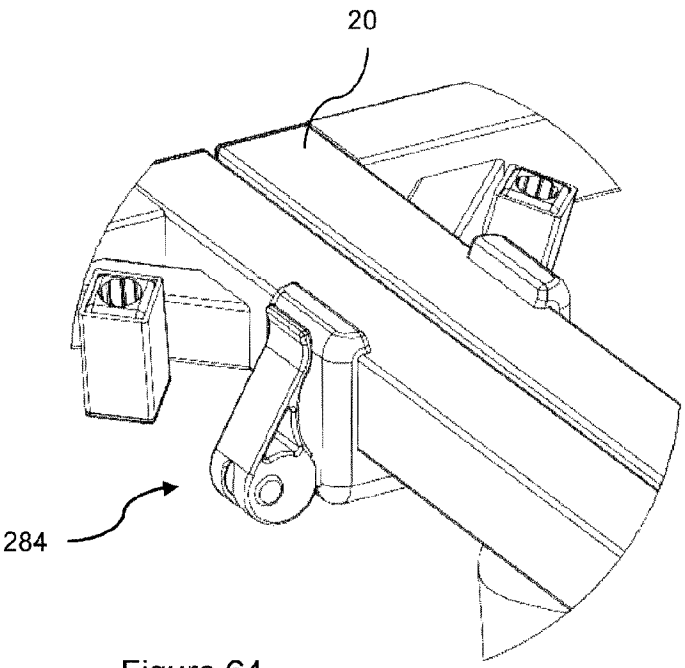
FIG. 64 shows a detailed view, from above, of the clamp assembly, in use.

In FIG. 61, reference numeral 248 generally indicates an elongate connector with a first portion 250 and a second portion 252 that are angled with respect to each other, as with the portions 34, 36. However, the angle between the first and second portions 250, 252 can vary depending upon the application required. In FIG. 62, reference numeral 254 generally indicates a further elongate connector with a first portion 256 and a second portion 258 that are also generally orthogonal to each other. Again, the angle between the first and second portions 256, 258 can vary depending upon the application required. The elongate connectors 248, 254 are identical in cross section. However, the first portion 250 of the elongate connector 248 is longer relative to the second portion 252 than is the first portion 256 relative to the second portion 258 of the elongate connector 254.

The seat support frame 238 includes two sleeve assemblies 242 mounted on each frame member 20. Each set of two sleeve assemblies 242 are mounted so that they converge distally. Each sleeve assembly 242 is mounted on its associated frame member 20 with a gusset 244. Each sleeve assembly 242 includes an elongate sleeve holder 246 of square or round tubular section and a sleeve insert located within the sleeve holder 246. The sleeve insert can be of a plastics material. The holder 246 can define a chamfered, radiused or rounded opening to receive either of the first and second portions of either elongate connector 248, 254.

Each holder 246 can be welded to an associated gusset 244 which, in turn, is welded to an associated frame member 20.

The rest support frame 240 has two sleeve assemblies 260, each sleeve assembly 260 being positioned at or near an end of the bottom member 28. Each sleeve assembly 260 includes an elongate sleeve holder 262 fastened to the bottom member 28. A sleeve insert 264 is positioned in the sleeve holder 262 and has a head 266 that overlies a bottom end of the sleeve holder 262. The head 266 defines a chamfered, radiused or rounded opening for one of the first and second portions of either of the elongate connectors 248, 254. The head 266 need not overlie the bottom end of the sleeve holder, since material of a cover may be suitable for reducing the visibility of the hole for aesthetic purposes. The head 266 may serve to cover sharp edges, so preventing a user from being cut or scratched.

The rest support frame 240 also has two sets of inner and outer socket assemblies 268, 270. Each set is positioned proximate a respective end of the bottom member 28 and inwardly of the sleeve assemblies 260. The socket assemblies 268, 270 of each set are generally parallel to each other, but angled with respect to the socket assemblies 260. Operatively, an angle defined between the socket assemblies 268, 270 and the seat support frame 238 is less than an angle defined between the sleeve assemblies 260 and the seat support frame 238. Thus, assuming a common elongate connector, engagement of elongate connectors with the sleeve assemblies 260 provides a more upright position of the rest assembly 14 relative to the seat assembly 12 as opposed to the condition where the elongate connectors are engaged with either of the socket assemblies 268, 270. That more upright position is suitable for the armrest function of the associated rest assembly 14.

Each socket assembly 268, 270 includes an elongate holder 272, 274 that is fastened to the bottom member 28. A socket insert 276, 278 is received in each holder 272, 274. Each socket insert 276, 278 has a head 280, 282 that defines a chamfered, radiused or rounded opening to provide a guide for either of the first and second end portions of either elongate connector 248, 254.

Figure 58:
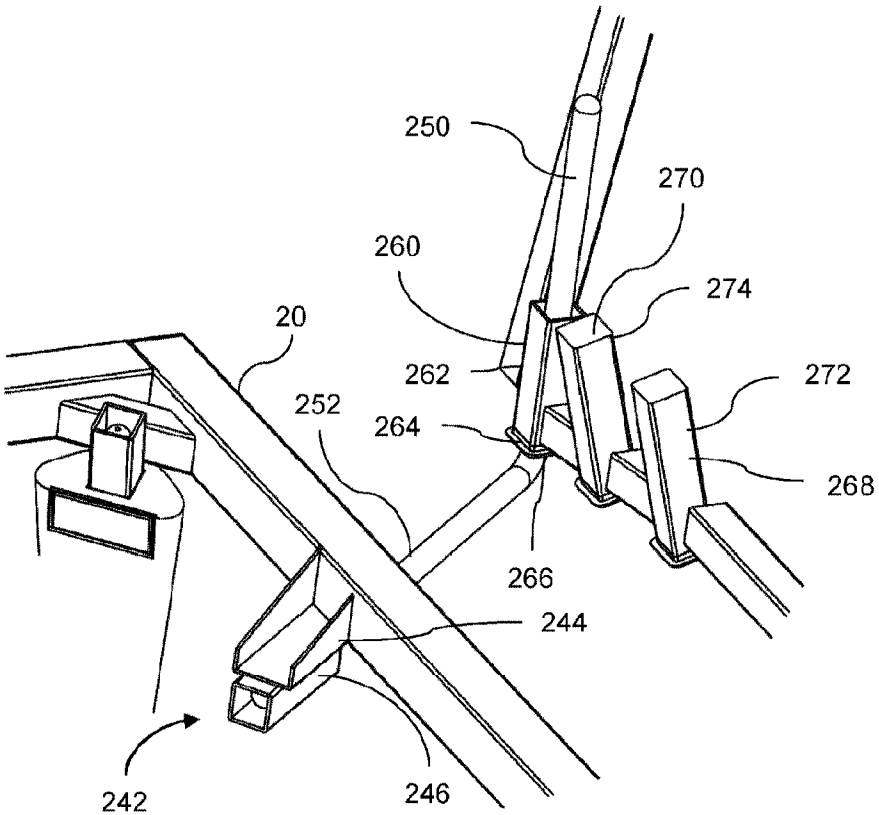
FIG. 58 shows a detailed view of the way the seat support frame is connected to the rest support frame in FIG. 57.
Figure 57:
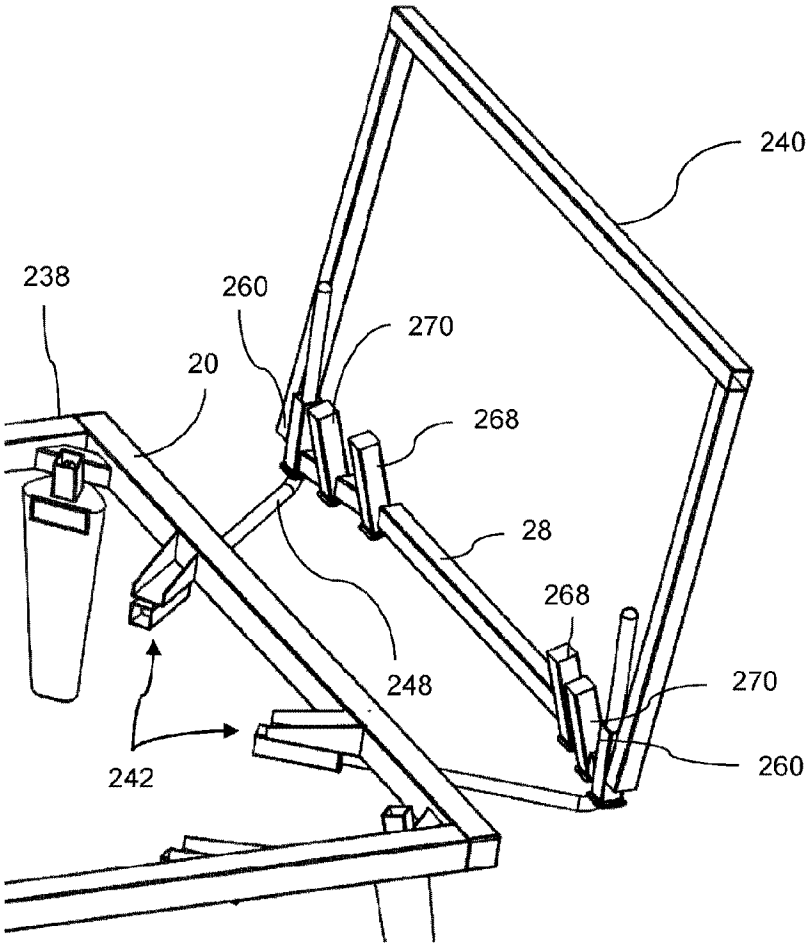
FIG. 57 shows an example of a seat support frame of the seat assembly connected to an example of a rest support frame of the rest assembly.

As can be seen in FIG. 58, the second portions 252 of the elongate connector 248 can be received in the respective sleeve assemblies 242. More particularly, end sections of the second portions 252 are located within the sleeve assemblies 242. This utilises a maximum length of the second portions 252 that are longer than the first portions 250. The first portions 250 are received through respective sleeve inserts 264 of the sleeve assemblies 260. It will be appreciated that once both first portions 250 are received through the respective sleeve inserts 264, the fact that the second portions 252 diverge from each other as a result of the orientation of the sleeve assemblies 242, as described above, inhibits the second portions 252 from being withdrawn together from the seat support frame 18. This serves to secure the rest assembly 14 to the seat assembly 12. In order to withdraw the second portions 252, it is necessary first to lift the rest assembly 14 so that the sleeve assemblies 260 clear the first portions 250. In that position, the rest assembly 14 is maximally spaced from the seat assembly 12 and in its lowest position with respect to the seat assembly 12. This suits the armrest function referred to above.

It will be appreciated that the relative positions of the seat assembly 12 and the rest assembly 14 is fixed because any divergence from those positions will inhibit the first portions 250 from being received through the sleeve assemblies 260.

Figure 59:
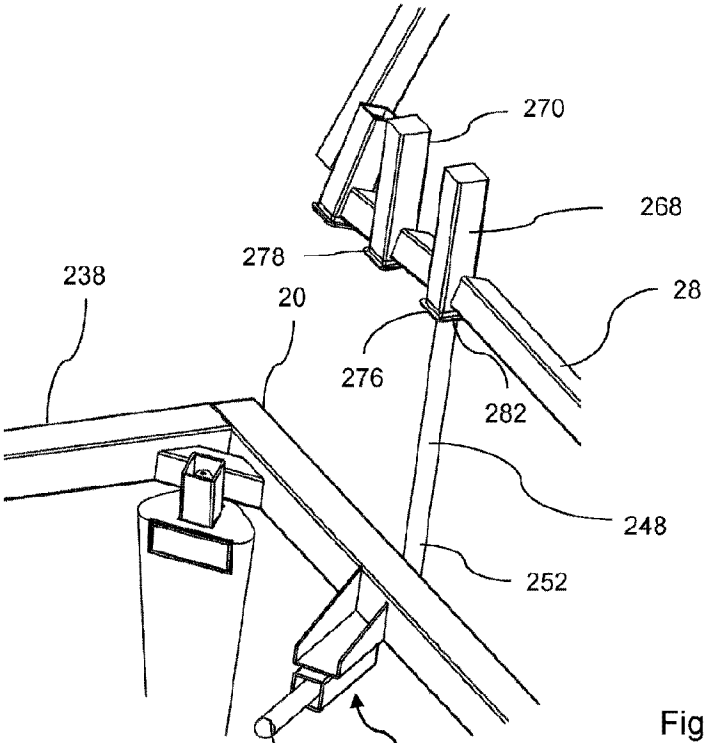
FIG. 59 shows a detailed view of another way in which the seat support frame can be connected to the rest support frame in FIG. 57.

As can be seen in FIG. 59, the first portions 250 of the elongate connectors 248 are received through respective sleeve assemblies 242. The associated second portions 252 are received in the respective socket inserts 276 of the inner socket assemblies 268 so that the rest support frame 240 is supported a predetermined height above the seat support frame 238. The use of the inner socket assemblies 268 is mandated by the fact that the portions 256 are inserted a maximum extent into the sleeve assemblies 242. This provides a predetermined position of the rest assembly 14 relative to the seat assembly 12 for the same reasons as the predetermined position of the rest assembly 14 relative to the seat assembly 12, as described above. In this example, the rest assembly can function as a backrest having a standard depth for a seat or sofa.

Figure 60:
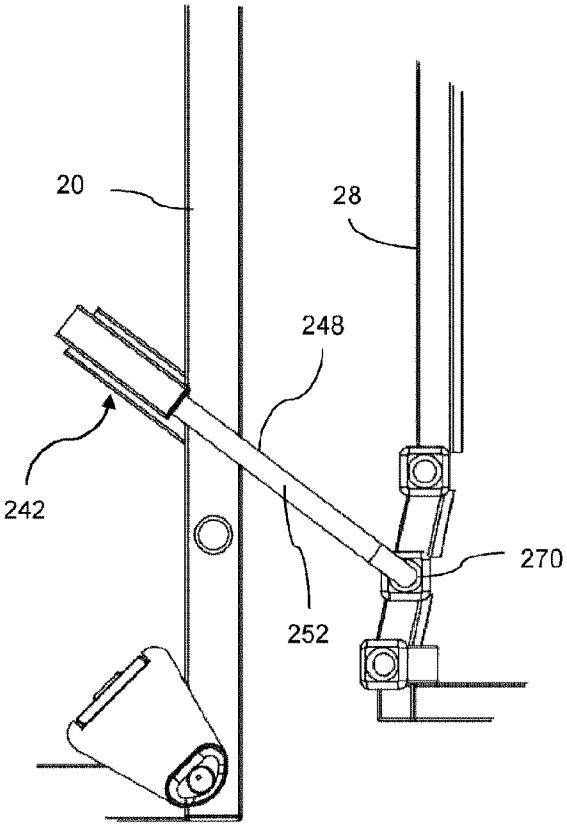
FIG. 60 shows a plan view from underneath of another way in which the seat support frame can be connected to the rest support frame in FIG. 57.

In FIG. 60, the first portions 250 of the connectors 248 are received in the sleeve assemblies 242 while the associated second portions 252 are received in the outer socket assemblies 270. The use of the outer socket assemblies 270 is mandated by the fact that the first portions 252 are somewhat withdrawn from the associated sleeve assemblies 242 when compared with the condition shown in FIG. 59. In this configuration, the rest assembly 14 can function as a backrest having an extended depth.

The elongate connectors 254 can be used with second portions 258 being received in respective inner socket assemblies 268. As set out above, the first portion 256 of the elongate connector 254 is comparatively shorter than the first portion 250 of the elongate connector 248, relative to their respective second portions 258, 252. Thus, the first portion 256 is not able to be withdrawn to permit the second portion 258 to be placed in the outer socket assembly 270. Thus, the elongate connectors 254 are used for a non-depth-adjustable orientation of the rest assembly 14 as a backrest.

In FIGS. 63 to 71, there is illustrated an alternative manner of releasably fastening the seat support frames 18 together.

The article of furniture 10 can include at least one clamping mechanism that is operable to clamp adjacent frame members 20 together when the seat assemblies are brought together to form the article of furniture, such as a sofa or chaise lounge.

The clamping mechanism includes two over-centre clamping devices 284 that are configured to engage the adjacent frame members 20 and are operable to clamp the adjacent frame members 20 together.

Figure 66:
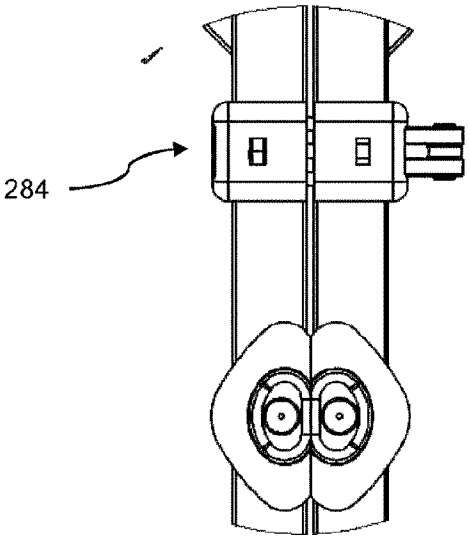
FIG. 66 shows a plan view, from below, of the clamp assembly, in use.
Figure 65:
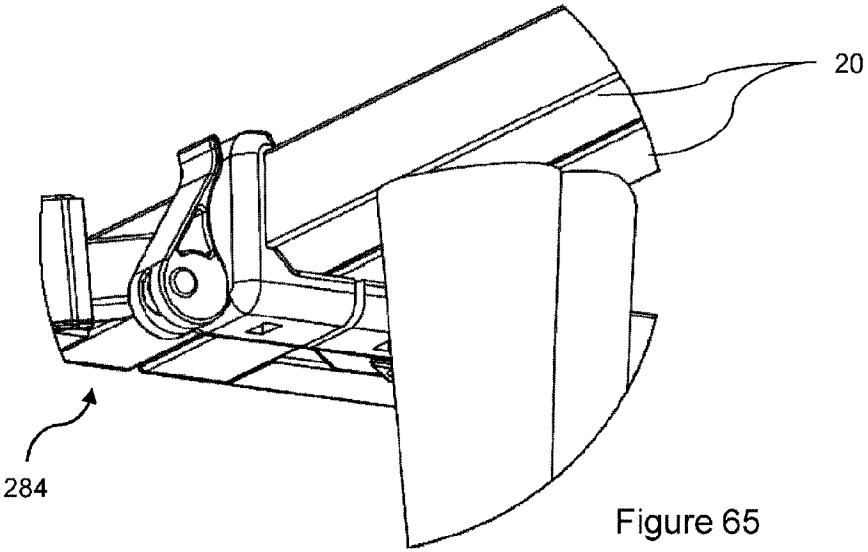
FIG. 65 shows a detailed view, from below, of the clamp assembly, in use.
Figure 68:
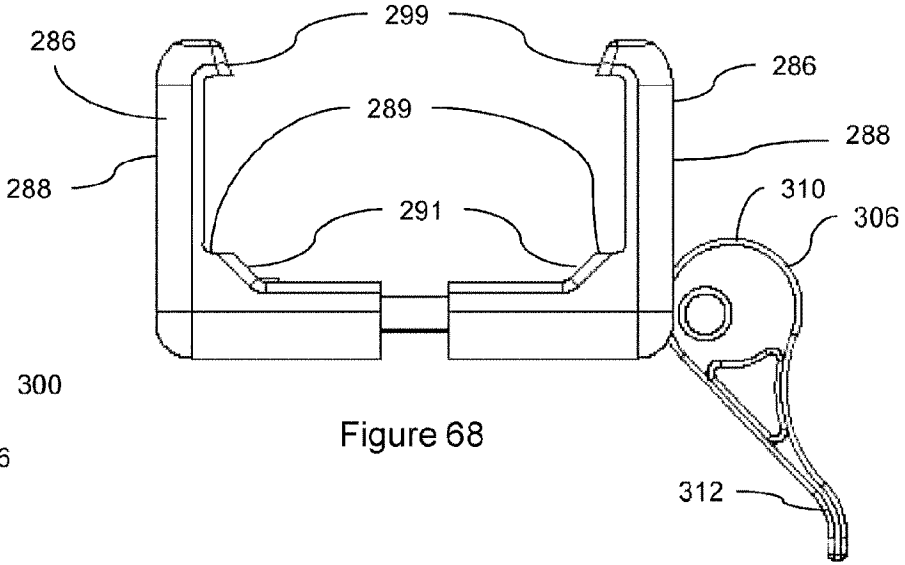
FIG. 68 shows a front view of the clamp assembly in an open condition.
Figure 67:
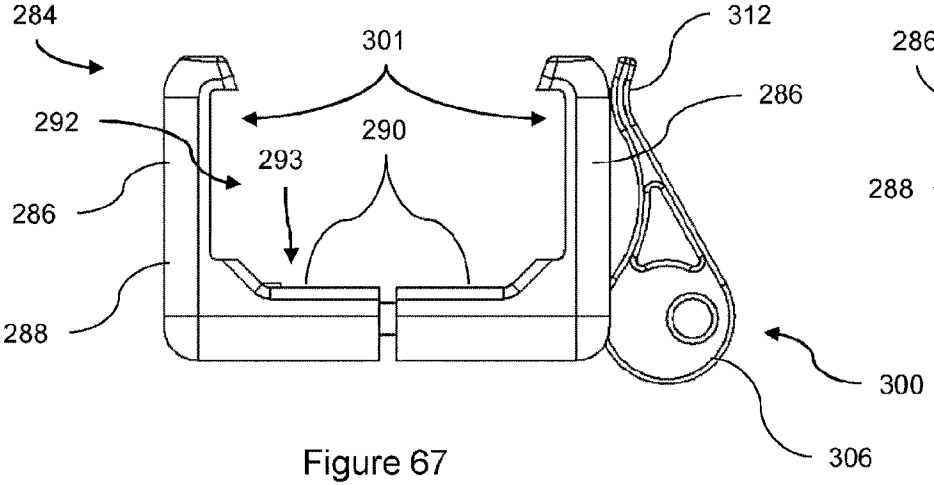
FIG. 67 shows a front view of the clamp assembly in a closed condition.
Figure 71:
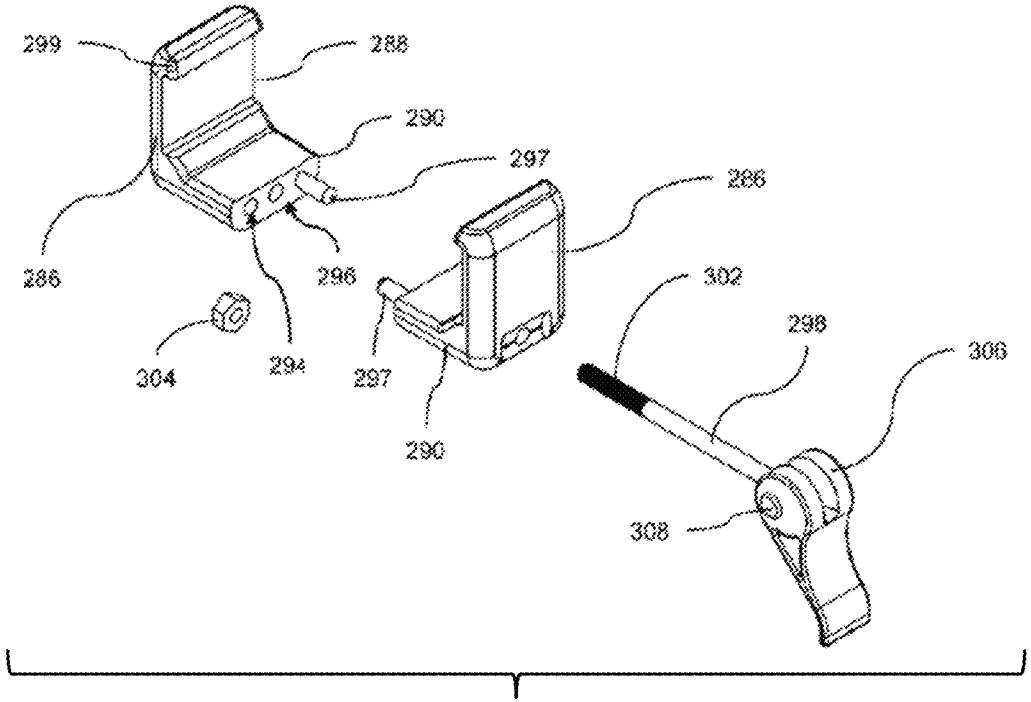
FIG. 71 shows a three-dimensional, exploded view of the clamp assembly.
Figure 69:
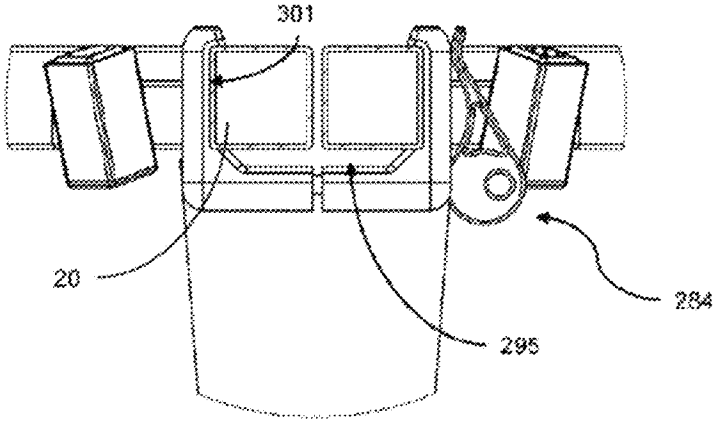
FIG. 69 shows a front sectioned view of two frame members of adjacent seat assemblies clamped together with the clamp assembly.
Figure 70:
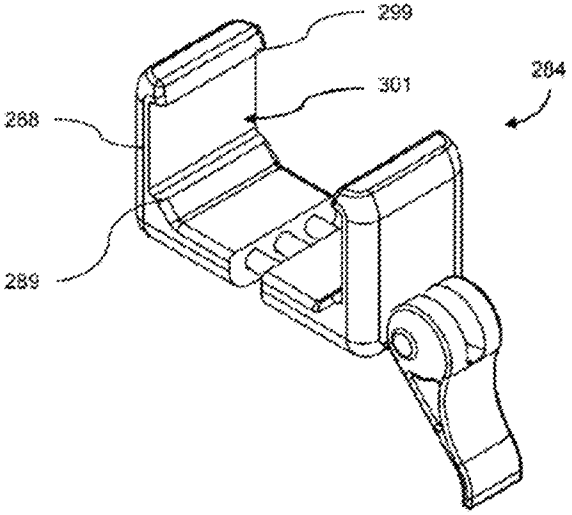
FIG. 70 shows a three-dimensional view, from above, of the clamp assembly in an open condition.
Figure 73:
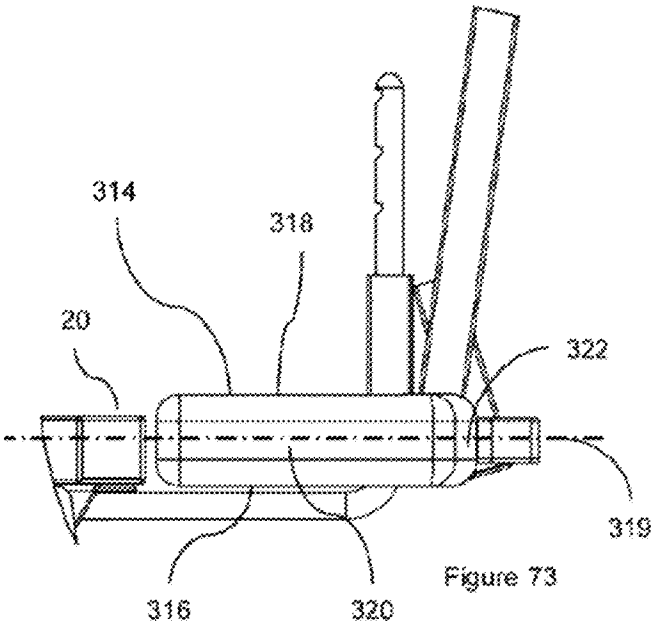
FIG. 73 shows a detailed view of the part G in FIG. 72.
Figure 76:
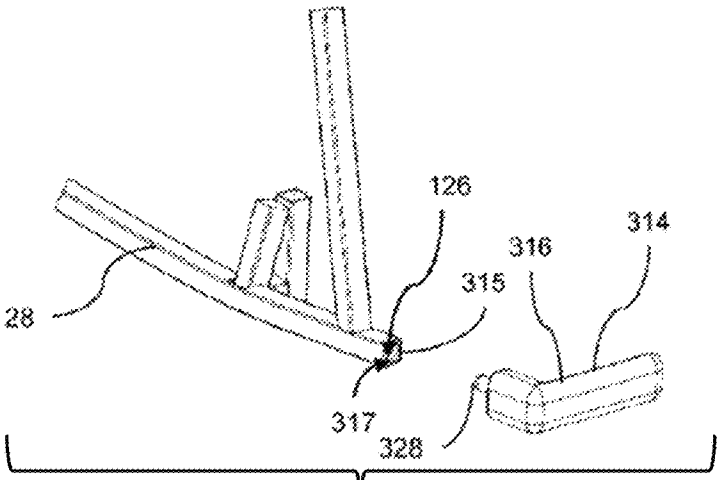
FIG. 76 shows a detailed view of the part I in FIG. 74.
Figure 72:
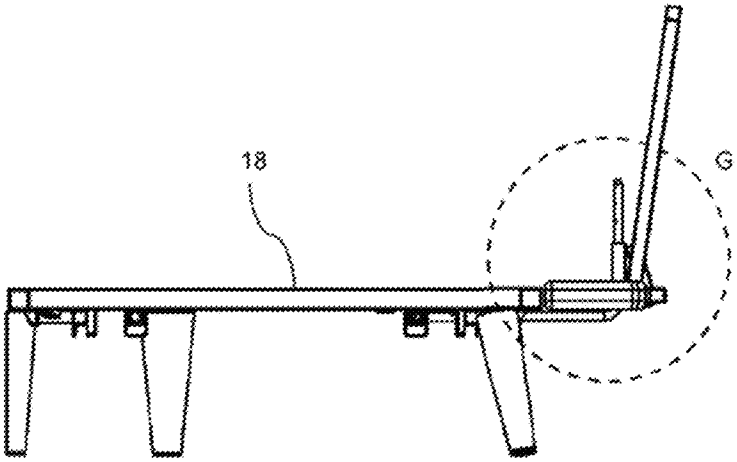
FIG. 72 shows a side view of a rest support frame mounted on a seat support frame, with another example of corner members mounted on the rest support frame.
Figure 75:
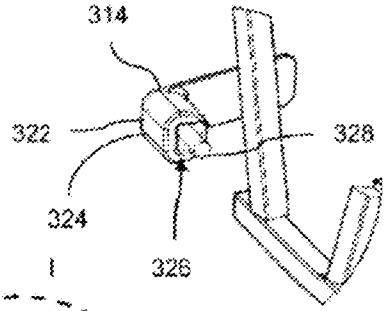
FIG. 75 shows a detailed view of the part H in FIG. 74.
Figure 74:
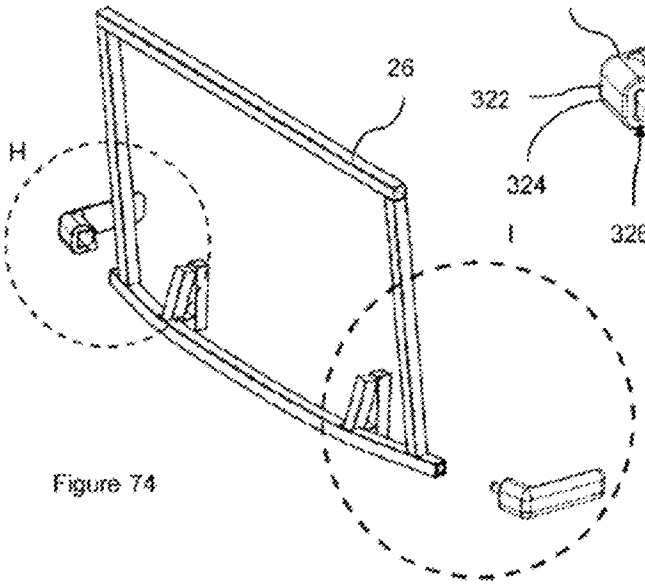
FIG. 74 shows the rest support frame of FIG. 72 with the corner members detached.

Each clamping device 284 includes two clamp members 286 that are displaceable relative to each other between a clamping position for example as shown in FIGS. 66 and 67 and an un-clamped position for example as shown in FIGS. 68 and 70.

Each clamp member 286 includes a side wall 288 and a floor section 290 that extends orthogonally from the side wall 288. The side walls 288 and the floor sections 290 are configured so that they can be bought together to define a channel 292 with a cross-sectional profile that corresponds with that of the two frame members 20 when in abutment with each other.

Each floor section 290 defines a shoulder 289 that transitions to a stepped portion 291 that steps downwardly and away from the respective side walls 288. Thus, when the floor sections 290 are brought together, the floor sections 290 together define a recess 293. The adjacent frame members 20 can be positioned on the shoulders 289 when the clamp members 286 are clamped together. Thus, a cavity 295 (see FIG. 69) is defined beneath the frame members 20. The cavity 295 can accommodate seat cover material, such as leather, that is fastened to the frame members 20.

Each side wall 286 defines an inwardly projecting upper lip 299. The upper lip 299 and the shoulder 289 on each wall 286 provide the wall 286 with an inwardly-opening recess 301 to receive a side of a frame member 20. Thus, the recesses 301 serve to properly locate the clamping device 284 with respect to the frame members 20 that are to be clamped together.

Each floor section 290 has a bore 296 extending therethrough and generally orthogonally with respect to the side wall 288. A shaft 298 of an over-centre mechanism 300 is received through the bores 296 of aligned floor sections 290. The shaft 298 has a threaded end portion 302 onto which a nut 304 can be threaded to secure the over centre mechanism 300 to the clamp member 286.

A camming member 306 is connected to an opposite end portion of the shaft 298 with a suitable pivot pin 308. The pivot pin 308 is offset with respect to a centre of the camming mechanism 306. Once the camming member 306 is secured to the clamp members 286, a camming surface 310 of the camming member bears against one of the clamp members 286. A handle 312 extends from the camming member 306 so that the camming member 306 can be rotated in one direction so that the camming member 306 acts on the pivot pin 308 to draw the shaft 298 away from one of the clamp members 286 such that the clamp members 286 are urged towards each other to clamp the frame members 20 between the sidewalls 288. When rotated in an opposite direction, the clamp members 286 are released from each other allowing the clamping device 284 to be removed from the frame members 20 so that the seat frames, and thus the seat assemblies 12 can be manipulated relative to each other. It will be appreciated that a level of tension exerted by the mechanism 300 can be adjusted by appropriate rotation of the shaft 298 relative to the nut 304, which is locked on the associated clamp member 286, against rotation.

The handle 312 is positioned so that when the camming member 306 is rotated to exert the clamping effect, the handle 312 is positioned alongside the associated side wall so as not to interfere with objects beneath the seat support frame 18. The handle 312 is dimensioned so as not to extend past an upper end of the clamp members 286. It will be appreciated that the handle 312 and associated camming member 306 could be positioned so that the handle operates horizontally.

A socket 294 is defined by each floor section 290, on one side of the bore 296, and extends generally orthogonally with respect to the side wall 288. The sockets 294 in respective floor sections 290 are rotationally symmetrical, through 180 degrees, relative to each other. A dowel 297 extends from each floor section 290, generally orthogonally with respect to the side wall 288, on an opposite side of the bore 296. Thus, the dowels 297 are also rotationally symmetrical, through 180 degrees, relative to each other. The dowels 297 are slidably received within subsequently aligned respective sockets 294 so that they serve to guide the clamp members 286 towards and away from each other when the over centre mechanism 300 is operated.

In FIGS. 72 to 76, there is shown a corner member 314, which is an alternative to the corner member 128 described above with reference to FIGS. 22, 23 and 25.

The corner member 314 has a corner-defining structure in the form of a corner piece 316 that has a cross sectional profile shaped to suit a cushion assembly mounted on the rest support frame 26. The corner piece 316 includes a distally projecting plate 318 having an outward facing shaping surface 320 that can be positioned against an inner surface of a side panel of a cover of the cushion assembly, at or near a lower edge of the cushion assembly. The corner piece 316 also includes an inwardly projecting frame mount 322 that extends from the plate 318. The frame mount 322 has a rearwardly facing shaping surface 324 that can be positioned against an inner surface of a back panel of the cover of the cushion assembly, at or near the lower edge of the cushion assembly. The shaping surfaces 320, 324 are configured to provide a lower corner of the cushion assembly with an aesthetically acceptable appearance when the lower corner is visible in particular configurations of the article of furniture 10 particularly when the rest assembly performs the armrest function.

As with the corner member 128, the corner member 314 is removable to avoid clashing with adjacent corner members 314 in certain configurations. A socket insert 315 of a plastics material is fitted into each end of the member 28 and defines a socket 317.

A free end of the frame mount 322 defines a socket 326. The socket 326 is shaped and dimensioned so that the associated end of the bottom frame member 28 can nest in the socket 326 with the corner member 314 being inhibited from rotation relative to the frame 26. A locating pin or peg 328 extends centrally from the socket 326 and can be received in the socket 317 to facilitate location of the corner member 314

As can be seen in the drawings, the plate 318 is symmetrical about a centre line 319. This allows the corner member 314 to be used on either side of the member 28, without the need for two different components.

In the embodiment shown, the member 28 projects beyond the side members 32. In some instances, that may not be the case. To cater for this, the frame mount 322 may define opposed slots to accommodate the side members 32, irrespective of which side the corner member 314 is mounted.

Figure 77:
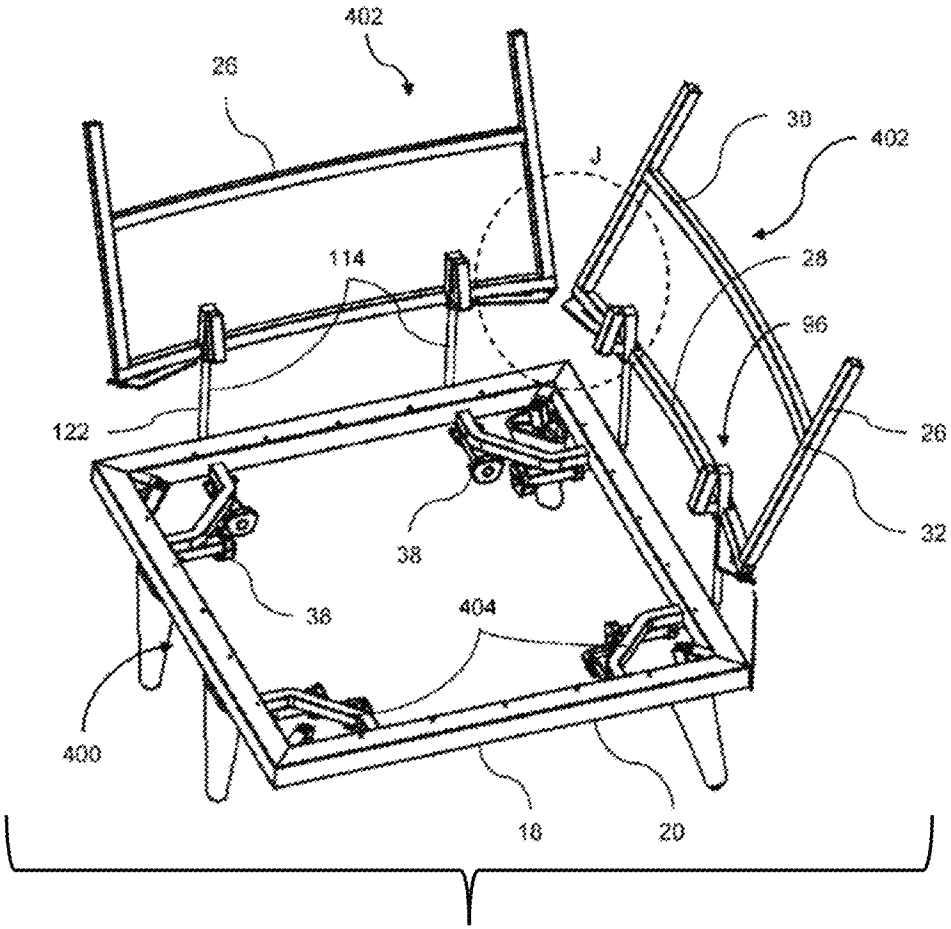
FIG. 77 shows a three-dimensional view, from above, of a seat support frame and two rest support frames of an embodiment of an article of furniture, in accordance with the invention.
Figure 79:
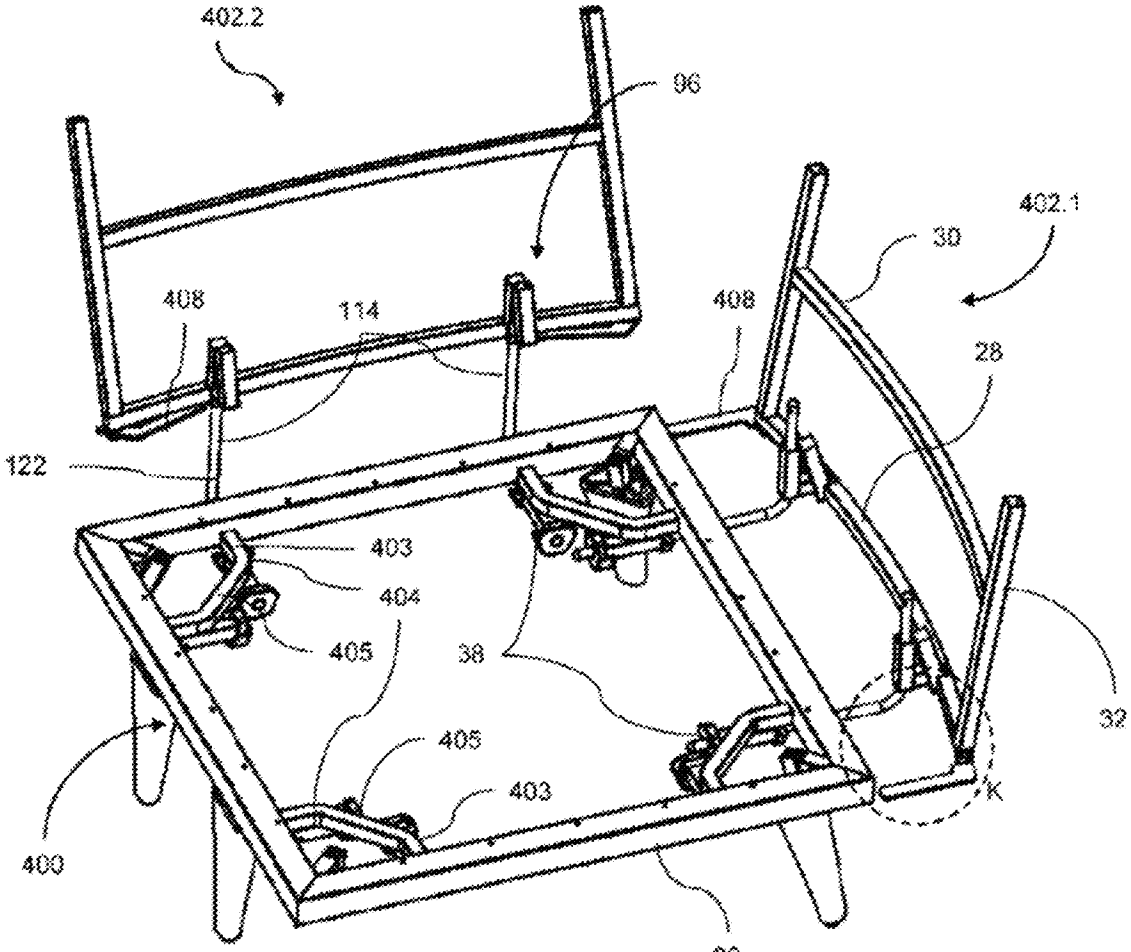
FIG. 79 shows the seat support frame and the rest support frames of FIG. 77 in different configurations.

In FIGS. 77 and 79, reference numeral 400 generally indicates a seat support frame of an embodiment of an article of furniture, in accordance with the invention. Also, in FIGS. 77 and 79, reference numeral 402 generally indicates a rest support frame of the article of furniture.

The seat support frame 400 includes four bracing members 404. The bracing members 404 extend between and are fastened to adjacent frame members 20 at each corner of the support frame 400. Each bracing member 404 includes opposed end portions 403 that extend inwardly and generally orthogonally with respect to the associated frame member 20. An intermediate portion 405 interconnects the end portions 403. Each sleeve assembly 38 is welded to one respective end portion 403. Thus, in this embodiment, the end portions 403 replace the gussets 50. This serves to inhibit bending of the sleeve assemblies 38 when a user leans back against the rest assembly 14.

A corner member having a corner-defining structure in the form of a swing bracket 406 is pivotally mounted on each side of the rest support frame 402. More particularly, swing brackets 406 are pivotally mounted on respective ends of the bottom frame member 28 and are pivotal between an inoperative position (FIG. 81), in which the swing bracket 406 is stowed operatively below the rest support frame 402, and an operative position (FIG. 83), in which the swing bracket is pivoted outwardly away from the rest support frame 402 to bear against an inner surface of a cover of the cushion assembly. Each swing bracket 406 includes a swing arm 408. The swing arm 408 has an inner portion 410 and an outer portion 412 that extends from the inner portion 410. The portions 408, 410 are oriented at greater than 90° relative to each other.

The swing arm 408 is generally planar. For example, the swing arm 408 is of metal plate. The metal plate may have a thickness of about 4 mm but could be thinner or thicker depending on requirements.

Figure 84:
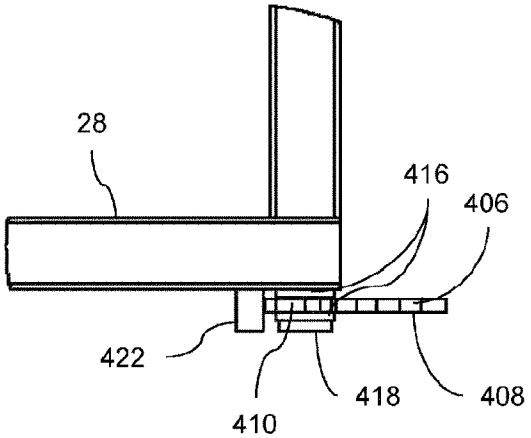
FIG. 84 shows a rear view of the swing bracket of FIG. 81 in the operative position.

The inner portion 410 is pivotally mounted to the bottom frame member 28, via a suitable connector, that interconnects the inner portion 410, intermediate ends of the inner portion 410, to the bottom frame member 28. As described above, the bottom frame member 28 is of square tubular section. Thus, the connector can be a pivot member 414 that extends through an opening 416 in a bottom wall of the frame member 28 and is fixed to the frame member 28. The pivot member 414 extends through the inner portion 410 so that the swing bracket 406 can pivot about the pivot member 414. The pivot member 414 can be a shank of a bolt or rivet that connects the inner portion 410 to the frame member 28. As can be seen in FIG. 84, the inner portion 410 can be interposed between washers 416, for example, of nylon. In that case, a head 418 of the bolt or rivet can bear against a lower washer 416, while the other washer 416 is interposed between the frame member 28 and the inner portion 410 In the case of a bolt, the shank can engage a threaded insert on the lower wall of the frame member 28. The shank may be cut to a length that permits it to bottom out on an opposite, upper wall of the frame member 28 so that the bolt is not over-tightened, which would inhibit pivotal movement of the swing arm 408. A suitable adhesive such as Loctite (trade mark) could be used to inhibit loosening of the bolt over time.

A free end of the inner portion 410 terminates at a narrowed lug 420. A stop 422 extends from the lower wall of the frame member 28, inwardly of each pivot member 414. The stop 422 is positioned so that, when the swing arm 408 is in the operative position, the lug 420 bears against the stop 422 to inhibit further outward pivoting of the swing arm 408. The stop 422 can be the end of a rivet or a rod welded to the frame member 28. The inner portion 410 also includes a shoulder 411 (FIG. 81) that is positioned to bear against the stop 422, to inhibit further inward pivoting of the swing arm 408.

Figure 80:
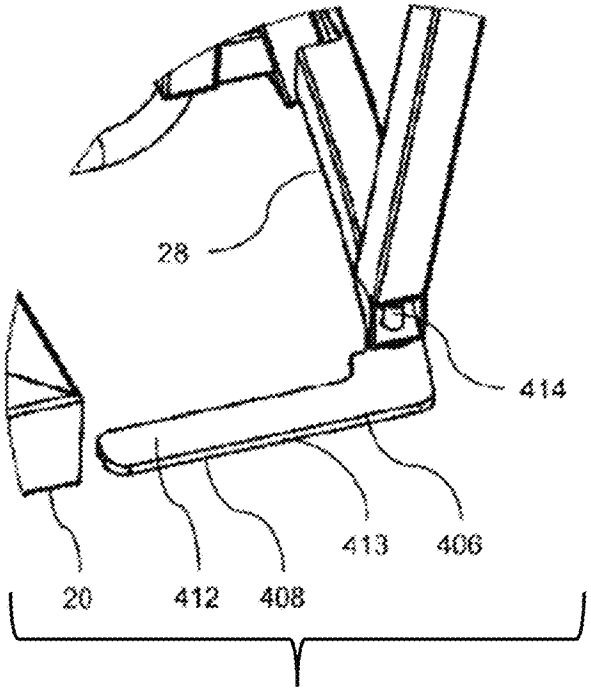
FIG. 80 shows a detailed view of the part K in FIG. 79.
Figure 83:
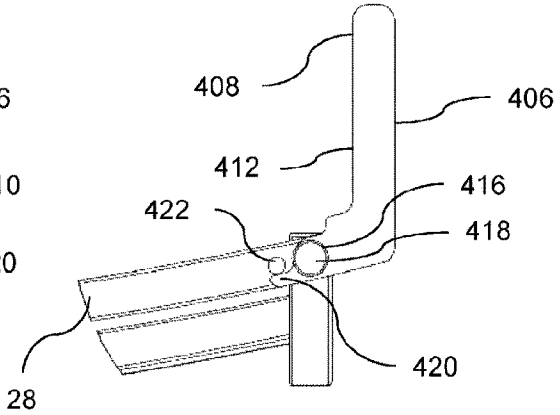
FIG. 83 shows the swing bracket of FIG. 81 in an extended, operative position.

As can be seen in FIGS. 80 and 83, when the swing arm 408 is in the operative position, an edge 413 of the outer portion 412 is generally aligned with a side of the seat support frame 400. Thus, when the rest support frame 402 is located within a rest cushion assembly, the edge 413 can bear against an inner surface of a cover to impart a neat edge to an exposed lower front edge and corner of the rest cushion assembly, which will be aligned with the front edge of the seat assembly 12. Thus, when the swing arms 408 of a rest assembly are in the operative position, the associated rest assembly could be functioning as an armrest for the article of furniture 10, with front and rear sides exposed and lower front edge and corners of those sides having an aesthetically acceptable appearance as a result of the position of the swing arm 408. The stop 422 is positioned so that the swing arm 408 does not over-extend, creating a bump that would spoil the look of the cushion assembly.

Figure 78:
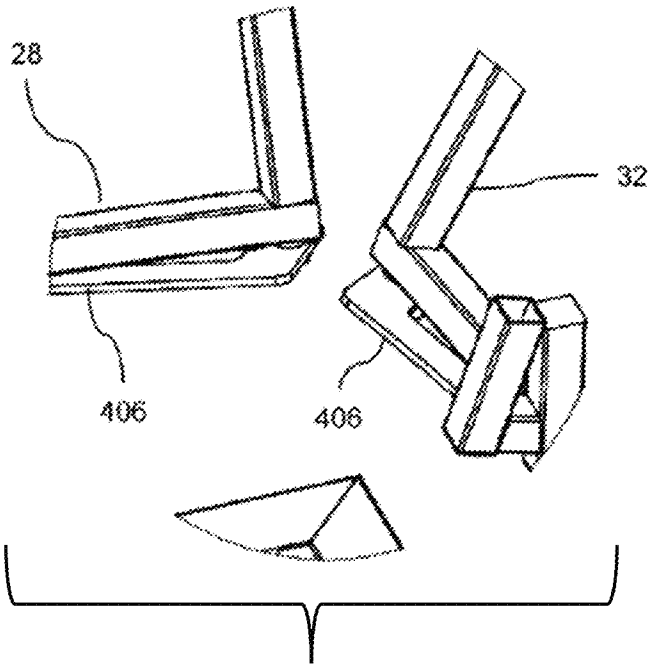
FIG. 78 shows a detailed view of the part J in FIG. 77.

In FIGS. 77 and 78, adjacent swing arms 408 at a corner of the article of furniture 10 defined by two of the rest assemblies 14, both functioning as backrests, are in their inoperative positions. In those positions, the outer portion 412 is positioned largely below the frame member 28. That is necessary to avoid clashing of the swing arms 408. However, where adjacent rest support frames 402 are functioning as backrests, the adjacent swing arms 408 of the rest support frames 402 can be left in their operative positions to provide a neater appearance than if the swing arms 408 were stowed in their inoperative positions. This neater appearance is achieved by minimising holes that could appear in the article of furniture between the backrests if the swing arms 408 were in their inoperative positions. Thus, the user can have the option of keeping those adjacent swing arms 408 in their operative positions. In a further possible embodiment, the swing brackets 406 can be configured so that, when the rest assemblies 14 are positioned adjacent each other to define the corner, the pressure can cause the swing arms 408 to move towards their inoperative positions.

The pivotal connection between the swing arm 408 and the frame member 28 is such that there is sufficient resistance to movement to facilitate the formation of a shaped corner for the cushion assembly. In one embodiment, the level of resistance to movement is sufficiently low so that when the adjacent swing arms 408 of two cushion assemblies are in the operative position and the cushion assemblies are placed side-by-side, the arms 408 can swing inwardly towards the inoperative position. Thus, if a user forgets to displace the swing arm 408 into the inoperative position, pressure between the cushion assemblies can ensure that the swing arm 408 moves towards the inoperative position to avoid interference.

In FIG. 77, the area marked J shows two adjacent swing arms 408 in their inoperative or stowed positions so that interference between those swing arms 408 is avoided.

In FIG. 79, the swing arms 408 of one of the rest support frames 402.1, functioning as an armrest, are in the operative position. On the other hand, the swing arms 408 of an adjacent rest support frame 402.2, functioning as a backrest, are in the operative position. Thus, corners of the cushion assembly of the armrest are suitably shaped for aesthetic purposes.

Figure 82:
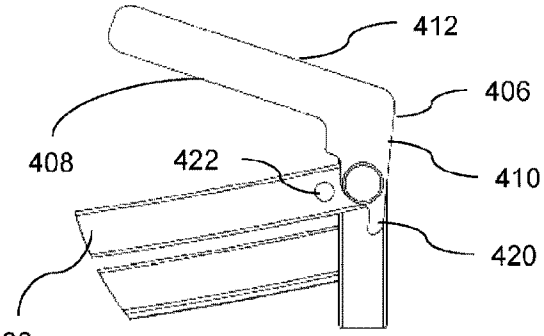
FIG. 82 shows the swing bracket of FIG. 81 in a partially extended position.
Figure 81:
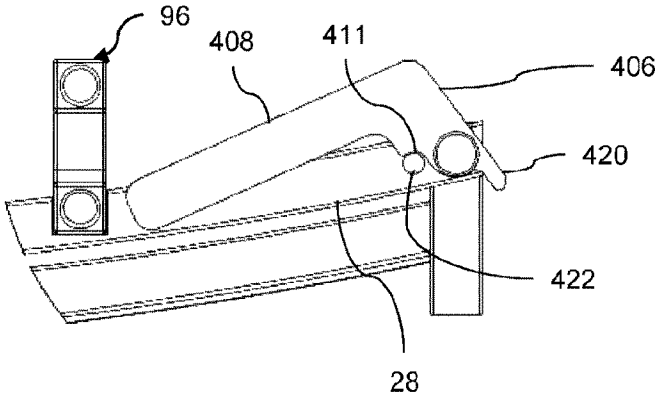
FIG. 81 shows a plan view, from below, of a swing bracket of one of the rest support frames of FIG. 77 in an inoperative position.

For illustrative purposes, FIGS. 81, 82, 83 shows stages of the movement of the swing arm 408 from the inoperative position (FIG. 81) to the operative position (FIG. 83). FIG. 82 is illustrative of an intermediate position, which is not necessarily fixed but is rather a stage in the movement between the inoperative and operative positions.

Figure 85:
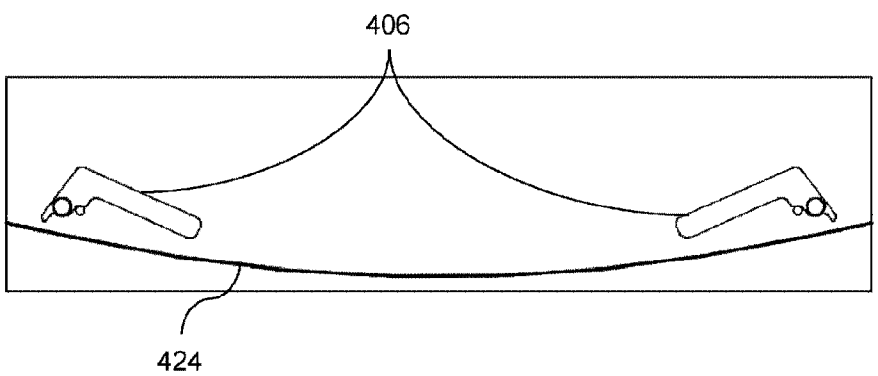
FIG. 85 shows a schematic plan view, from below, illustrating positions of the swing bracket relative to cushioning of the article of furniture.

In FIG. 85, there is shown a schematic view, from underneath, of the swing brackets 406, in their inoperative positions, relative to a wall of the cushion assembly. The wall is illustrated by a curved line 424. As can be seen, the lugs 420 do not impinge upon the inner side of the wall 424 when in their stowed positions and so are indiscernible when in their inoperative positions. This is facilitated by the provision of the shoulder 411, described above, which inhibits the swing arm 408 from excessive inward rotation, which would cause the swing arm 408 to impinge on the inner side of the wall 424.

Figure 86:
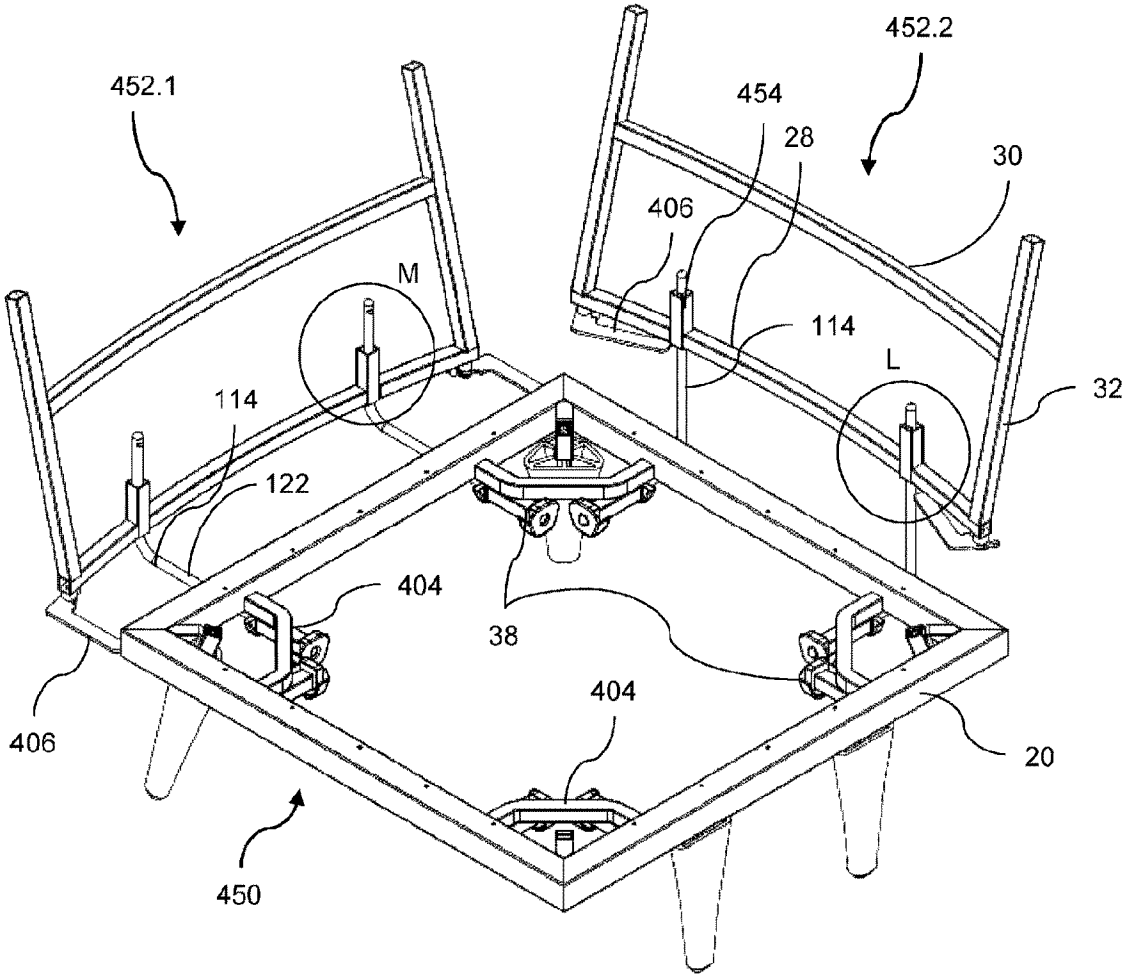
FIG. 86 shows a three-dimensional view, from above, of a seat support frame and two rest support frames of an embodiment of an article of furniture, in accordance with the invention.

In FIG. 86, reference numeral 450 generally indicates a seat support frame of an embodiment of an article of furniture, in accordance with the invention. Also, in FIG. 86, reference numeral 452 generally indicates a rest support frame of the article of furniture.

Two spaced sleeve assemblies 454 are mounted on the bottom frame member 28. The sleeve assemblies 454 are similar to the sleeve assemblies 106, as described above.

Figure 87:
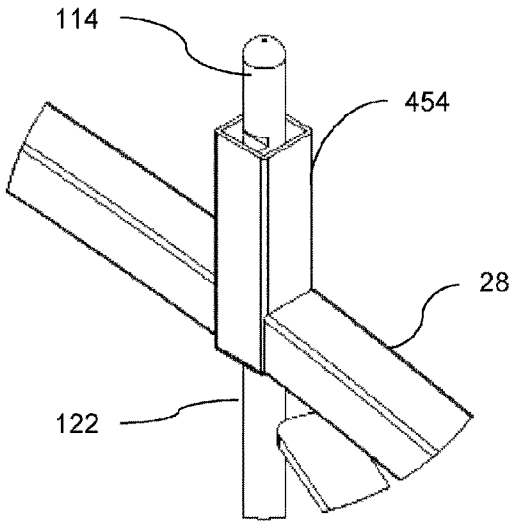
FIG. 87 shows a detailed view of the part L in FIG. 86.
Figure 88:
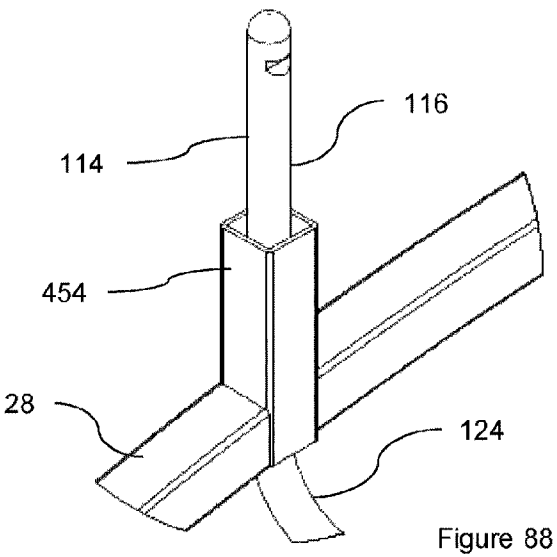
FIG. 88 shows a detailed view of the part M in FIG. 86.

In this embodiment, the functionality of the rest support frames 452 is defined by the way the elongate connectors 114 are used. For example, one of the rest support frames 452.1 functions as a support frame for an armrest. In that configuration, the associated elongate connectors 114 are positioned so that the portions 122 are connected to the sleeve assemblies 38 and the portions 116 are received through the respective sleeve assemblies 454 so that the sleeve assemblies 454 can simply slide down, with the rest support frame 452, to bear against the curved junction 124 between the portions 116, 122 (FIGS. 87, 88). In contrast, the other support frame 452.2 functions as a support frame for a backrest. In that configuration, the associated elongate connectors 114 are positioned so that the portions 116 are connected to the sleeve assemblies 38 and the portions 122 are received through the respective sleeve assemblies 454 so that the sleeve assemblies 454 can slide down until the associated cushion assembly on the rest support frame 452.2 is supported by the cushion assembly on the seat support frame 450 (FIGS. 86, 87).

It is to be appreciated that the sleeve assemblies 454 could be capped, for example, where a fixed height for the rest support frame 452 is required.

Figures 89, 90:
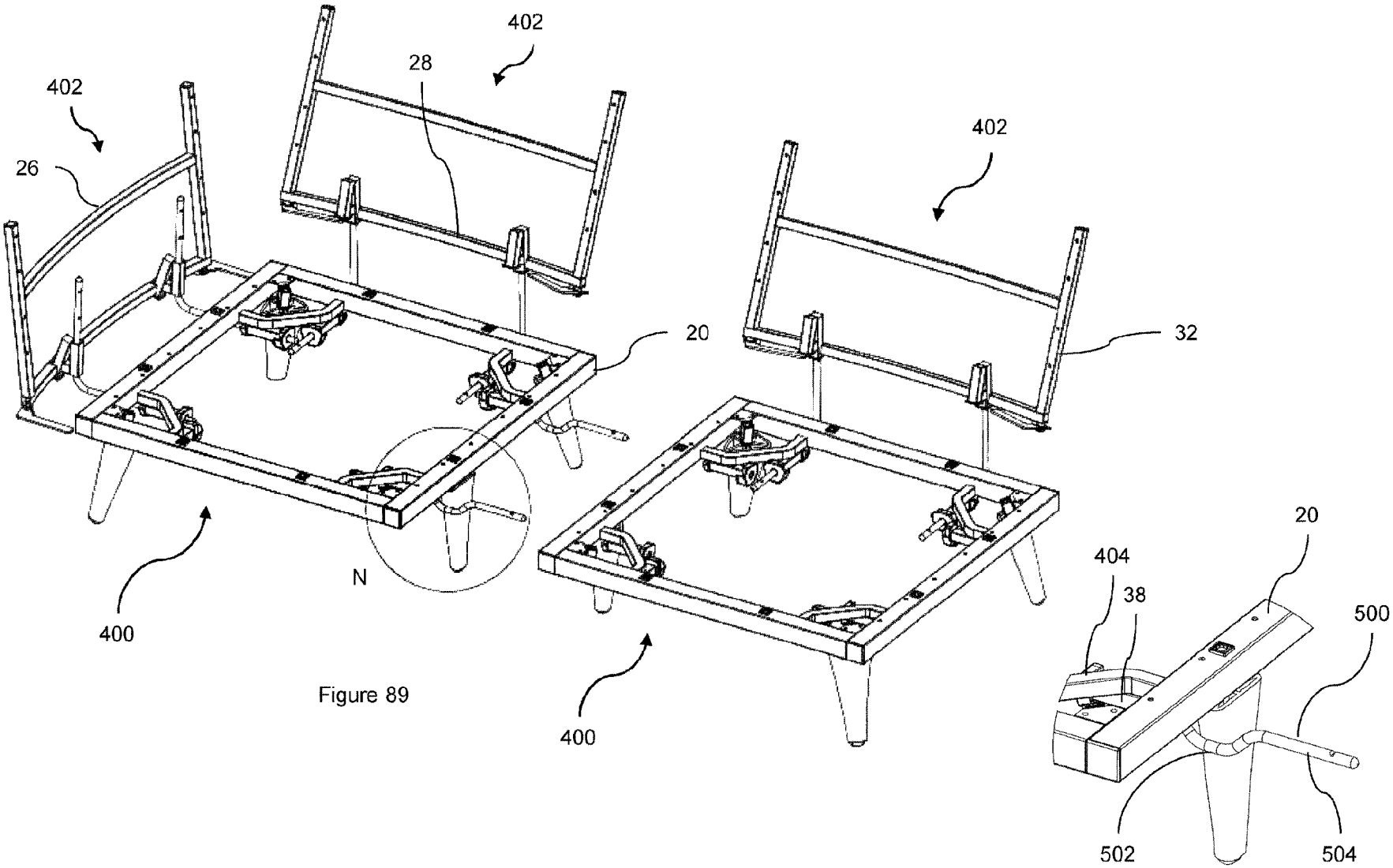
FIG. 89 shows a three dimensional view, from above, of two seat support frames in a stage of being connected together, using two seat connectors.
FIG. 90 shows a detailed view of the part N in FIG. 89.
Figure 91:
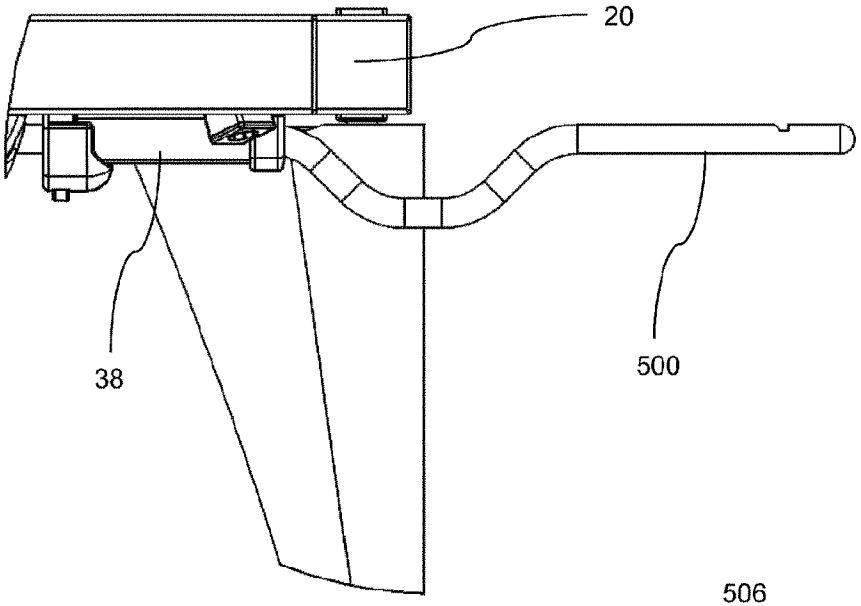
FIG. 91 shows a front view of the part N in FIG. 89.
Figure 92:
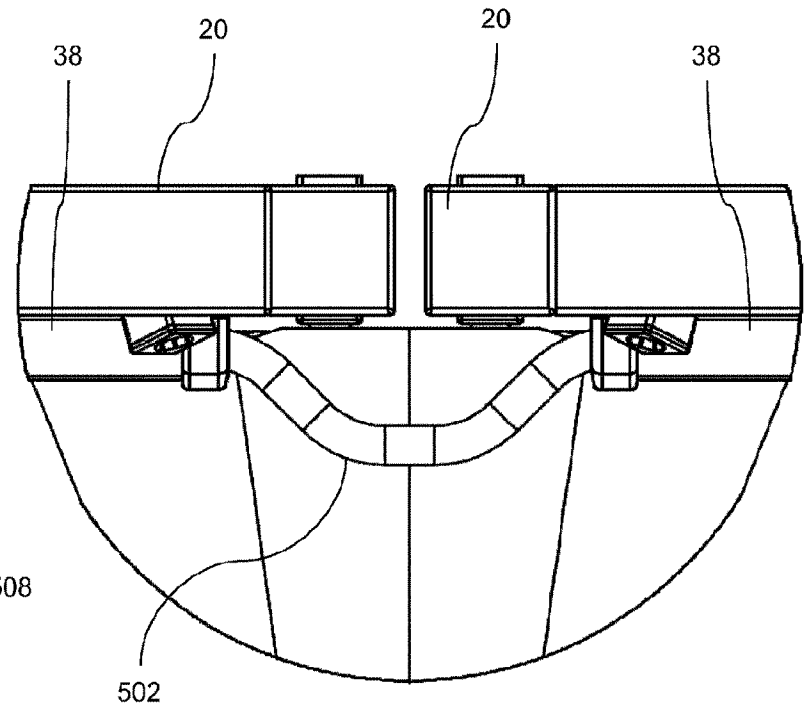
FIG. 92 shows a front detailed view of parts of the seat support frames connected together with one of the seat connectors.
Figure 93:
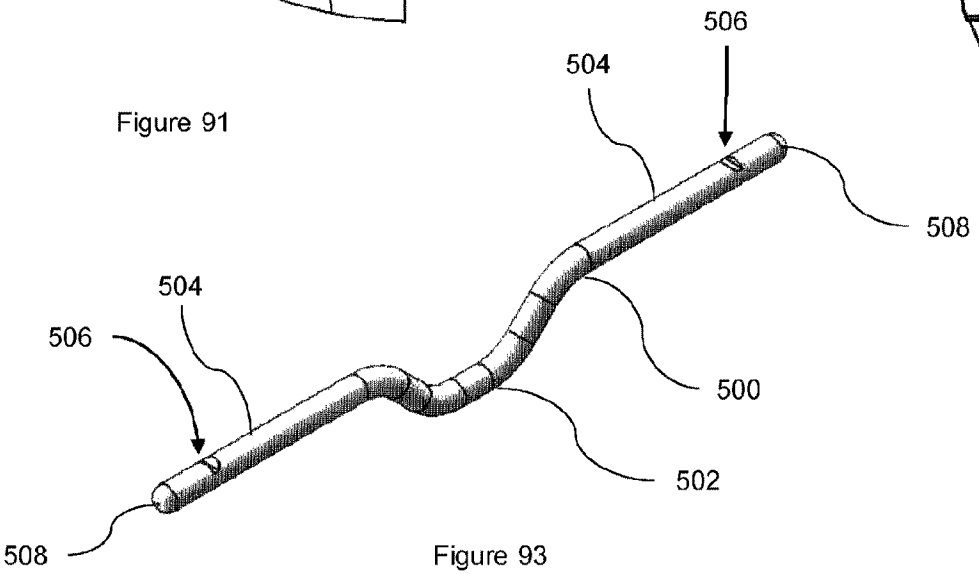
FIG. 93 shows a three-dimensional view of one of the seat connectors.
Figure 96:
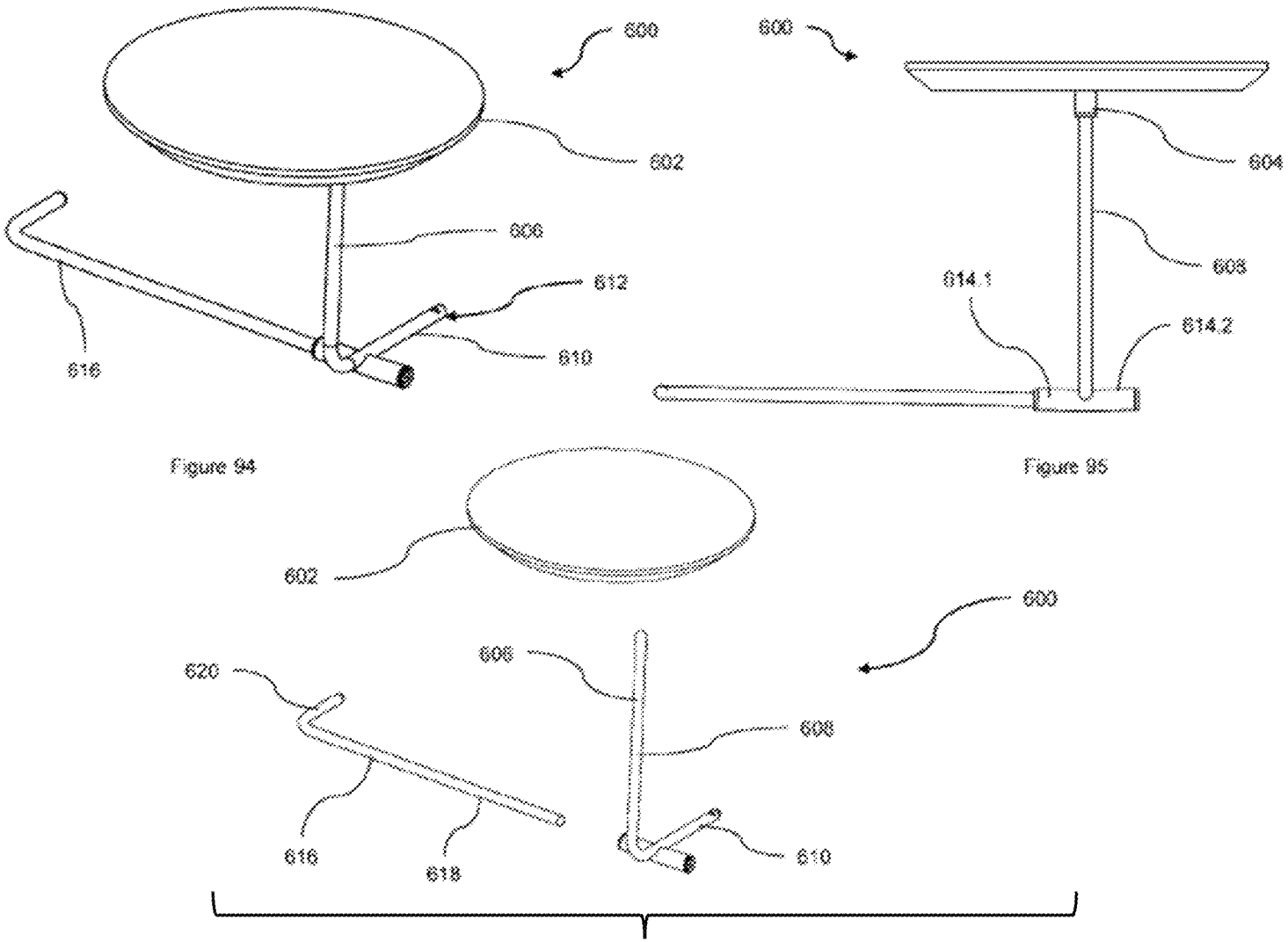
FIG. 96 shows a three-dimensional view, from above, of the table assembly in a disassembled configuration.
Figure 98:
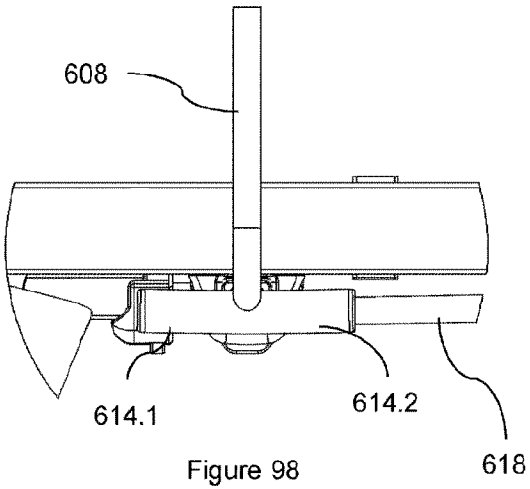
FIG. 98 shows a front view of the part P in FIG. 97.
Figure 99:
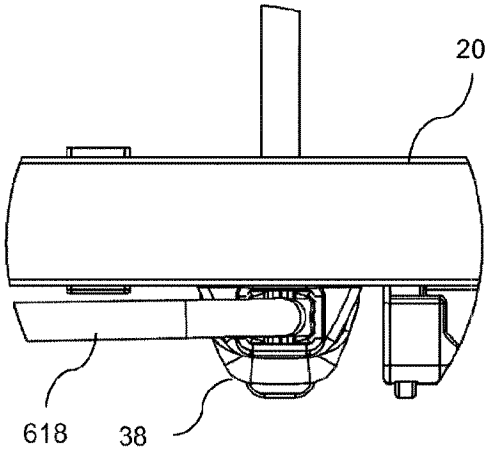
FIG. 99 shows a front view of the part R in FIG. 97.
Figure 97:
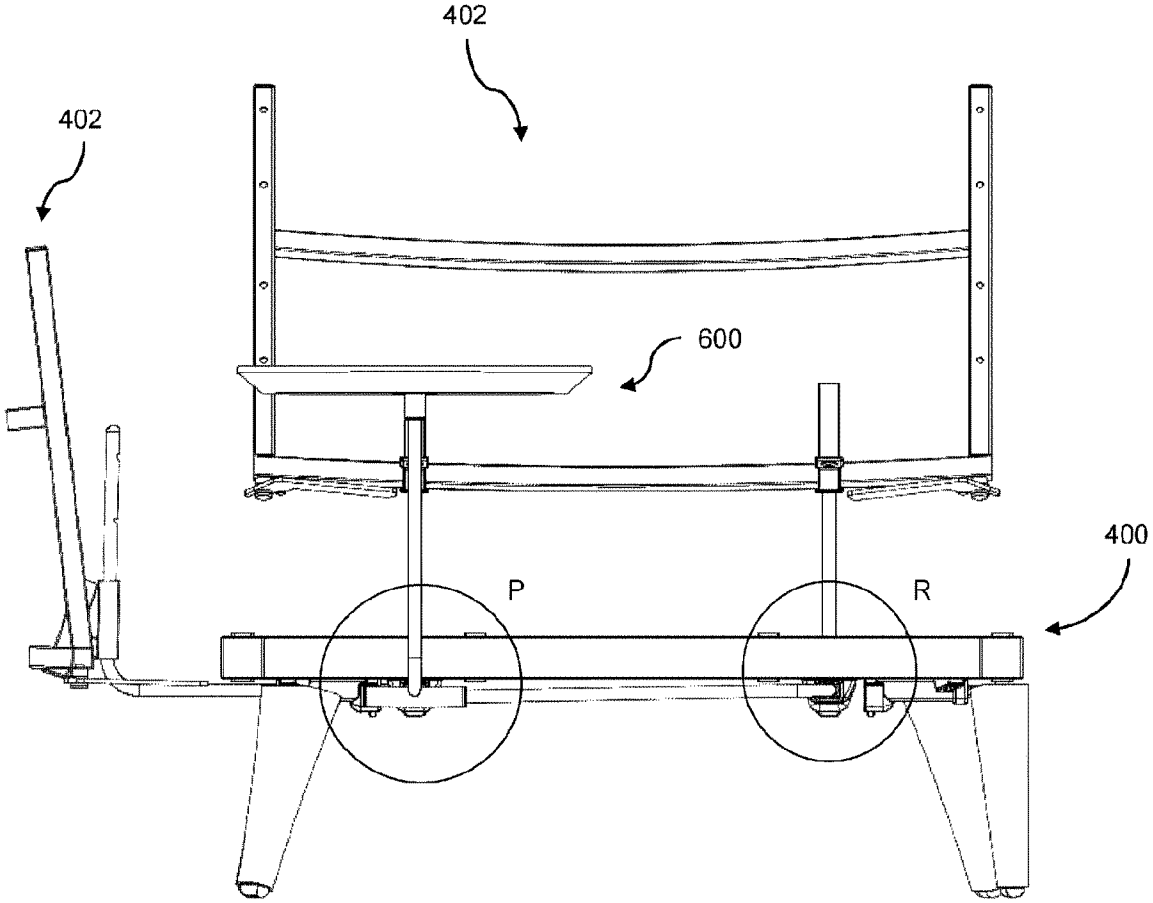
FIG. 97 shows a front view of the table assembly connected to one of the seat support frames, with rest support frames engaged with the seat support frame.

In FIG. 89, there is shown a system for connecting two of the seat support frames 400 together to form a two-seat article of furniture. It will be appreciated that any number of the seat support frames 400 can be connected together using the system, depending on the number of seats required.

The system includes a number of seat connectors 500. Each seat connector 500 is elongate with an intermediate portion 502 interposed between end portions 504. The end portions 504 are generally aligned with each other. The intermediate portion 502 is offset with respect to the end portions 504. Thus, in overall shape, the seat connector 500 resembles a crank. In use, when the end portions 504 are linearly restrained but free to rotate, the intermediate portion 502 can be manipulated to rotate the seat connector 500.

Each end portion 504 includes a groove or recess 506 positioned at or near a free end 508 of the end portion 504. The recess 506 is similar to the recess 174, 176 in the seat connector 168.

The seat connector 500 is dimensioned so that each of the end portions 504 can be inserted into respective apertures 72 of aligned passageways 64 of respective sleeve assemblies 38. The lengths of the intermediate portion 502 and end portions 504, together with positions of the recesses 506 are such that when the seat support frames 400 are brought into side-by-side abutment, the pins 77 of the associated locking assemblies 58 are received in the recesses 506 of the seat connector 500. The free ends 508 are tapered, chamfered or rounded. This facilitates the insertion of the end portions 504 and limits damage to the sleeve assemblies 38. Furthermore, the dimensions of the intermediate portion 502 are such that the extent of insertion of the end portions 504 is limited by a position of a junction between the end portions 504 and the intermediate portion 502, since insertion can only occur until the junction bears against the associated sleeve assembly 38. Without the intermediate portion 502, continued urging of the seat connector 500 would result in the pin 77 disengaging from the recess 506. Thus, the intermediate portion 502 serves to facilitate proper location of the seat connectors 500.

In use, two of the seat connectors 500 are used to connect two of the seat support frames 400 together. One of the end portions 504 of each connector 500 is inserted into a respective aperture 72, of the sleeve assemblies 38 of one seat support frame 400, until the end portions 504 clip into engagement with the associated sleeve assembly 38 and the intermediate portion 502 is inhibited from further inward travel. Subsequently, another seat support frame 400 is manipulated so that the other end portions 504 are received through the respective apertures 72 of the sleeve assemblies 38 until the connectors 500 clip into engagement with the associated sleeve assemblies 38 and the intermediate portion 502 is inhibited from further inward travel. It will be appreciated that the connectors 500 are inhibited from inward travel while another seat support frame 400 is manipulated as described above.

Each of the recesses 506 is oriented at about 180° relative to the offset of the intermediate portion 502. Thus, once the seat support frames 400 are connected together, as described above, the intermediate portions 502 project partially downwardly with respect to the abutting frame members 20. This facilitates user access to the intermediate portions 502 so that the seat connectors 500 can be cranked by a user grasping the intermediate portions 502 to disengage the recesses 506 from the pins 77, in the manner described above with reference to FIGS. 16 to 21, allowing the seat support frames 400 to be separated.

The offset intermediate portions 502 facilitate access to the seat connectors 500 by the consumer without the consumer having to look under the seat support frames 400. The intermediate portions 502 are readily grasped, and, given their offset orientation, the seat connectors 500 can be easily cranked to disengage them from the seat support frames 400.

Furthermore, connecting the seat support frames 400 together can be done without the consumer having to be on their knees or seated. The two seat connectors 500 can be inserted into the respective sleeve assemblies 38, as described above. Then, while the consumer is still in a standing position, the consumer (possibly with the help of another person) can urge the seat support frames 400 together so that the connectors 500 engage their respective sleeve assemblies 38, as described above. During this process, the portion 502 prevents the connector 500 from excessive inward movement with respect to one seat support frame 400, which would result in an inability to get the portions 504 to engage with the sleeve assemblies 38 of the other seat support frame 400.

In FIGS. 94 to 97, reference numeral 600 generally indicates a table assembly for use with the article of furniture 10.

The table assembly 600 includes a tabletop 602. The tabletop 602 can be any of a variety of shapes. In this example, the tabletop 602 is round.

A receiver 604 extends from a bottom surface of the tabletop 602. The table assembly 600 includes a support member 606 that engages the tabletop 602, to support the tabletop 602 at a suitable height. The support member 606 includes an operatively substantially vertical support post 608 and a leg 610 that extends generally at right angles to the support post 608. The leg 610 is detachably engageable with the rest mount with the support post 608 extending operatively upwardly from the leg 610. An elongate racing member 616 extends from the support member 606 and is detachably engageable with the rest mount to brace the table assembly 600 against pivotal movement.

The leg 610 has a groove or recess 612 at or near a free end of the leg 610. The recess 612 is similar to the recesses described above. In addition, the dimensions of the leg 610 and the position of the recess 612 permits the leg 610 to be inserted into the passageway 64 and then 62 of a front opening sleeve assembly 38 so that the leg 610 engages with the sleeve assembly 38, as with the connector 16. Thus, the tabletop 602 can be positioned in front of the associated seat support frame 400 and thus in front of a seat assembly containing the support frame 400. In the case of the tabletop 602 being round, the receiver is offset from a centre of the tabletop 602 so that the tabletop 602 can be pivoted into a suitable position.

A receiver 614 is fixed to the leg 610 and extends generally at right angles to the leg 610. The bracing member 616 is elongate and has a cross-sectional dimension that is similar to that of the support member 606. The bracing member 616 includes a major portion 618. A free end of the major portion 618 is receivable in the receiver 614, the receiver 614 being configured so that the bracing member 616 can be retained in the receiver 614. The bracing member 616 also includes a minor portion 620 that extends generally orthogonally with respect to the major portion 618, such that the bracing member 616 is generally L-shaped.

The receiver 614 is in the form of a tube that is welded to the leg 610. The receiver 614 includes one portion 614.1 on one side of the leg 610 and another portion 614.2 on an opposite side of the leg 610. The portions 614.1 and 614.2 are angled with respect to each other such that each portion 614.1 is angled upwardly with respect to the leg 610. This allows for sufficient space to be created between the seat frame 400 and the receiver 614 for fabric or leather seat covers. The upward angle of each portion 614 is the same so that the bracing member 616 can be used on either side of the receiver 614, as explained below.

The major portion 618 has a length such that, when the leg 610 is engaged with one of the sleeve assemblies 38 on a front frame member 20 of the seat support frame 400, the minor portion 620 can be received in the other of the sleeve assemblies 38 on the front frame member 20 of the seat support frame 400. Thus, the table assembly 600 can be detachably secured to the seat support frame 400.

Detachment of the table assembly 600 from the seat support frame 400 can be carried out by operating the push member 74, in the manner described above with reference to the detachment of the elongate connector 16 from an associated sleeve assembly 38.

It will be appreciated that the table assembly 600 can engage any side of the seat support frame 400 that does not have a rest support frame 402 already attached thereto. It follows that the table assembly 600 can be positioned in any number of positions depending on how the consumer configures the article of furniture 10.

The sleeve 614 is open at both ends. Thus, the major portion 618 can be positioned on any side of the support member 606, allowing for flexibility to suit the configuration of the article of furniture 10.

It will be appreciated that any number of accessories can be configured to engage either the rest mount or seat mount of the article of furniture by using a suitable connecting arrangement that can cooperate with the rest or seat mount, as described above, with reference to the various elongate connectors.

It will readily be appreciated that the various embodiments of the article of furniture 10 described above will be supplied in the form of a kit and, as such, it is intended that the description of the various embodiments of the article of furniture 10 should also be regarded as a description of kids for the article of furniture 10.

As is clear from the preceding description, the article of furniture 10 can take a multitude of different forms utilising a number of seat assemblies and rest assemblies that can function either as a backrest or armrests depending on the forms or orientations of elongate connector used for mounting the seat assemblies and rest assemblies to each other. Thus, the article of furniture 10 is modular and expandable to suit a wide range of living conditions. It follows that the article of furniture 10 is suitable for ameliorating or addressing the issues raised in the background of this description associated with other forms of articles of furniture.

The seat assemblies and rest assemblies can be provided as separate components so that a user can expand their seating arrangements as required. For example, if they move from a smaller residence to a larger residence, it will be possible to purchase further components to expand their seating arrangements. This obviates the need for them to purchase all new items of furniture and then deal with the problems of discarding the old furniture. Alternatively, if they are downsizing, they can simply remove various components and alter the configuration of the article of furniture to suit the downsized environment.

As described above, the cushion assembly is capable of being disassembled into its respective components for recycling, where possible, or replacement. This process can form part of the upsizing or downsizing alterations. The fact that the cushion assembly is capable of such disassembly and replacement of components allows a user to update existing components when further components are purchased for expansion. For example, the cushion covers could be replaced to suit the new components. Alternatively, the cushion covers could be replaced to suit a change in living conditions, such as a couple having children.

The fact that the seat assemblies and rest assemblies can be all single-seater size allows for easy transport of the various components. Furthermore, the dual function of the rest assemblies reduces the number of items required to be stocked in a warehouse. Delivery can thus be extremely quick and can include next day delivery. With conventional articles of furniture, next day delivery is extremely difficult and expensive because of the number of items that need to be pre-manufactured and stored. Attempts to achieve next day delivery with conventional articles of furniture can result in excessive inventory being stored in warehouses. These problems are not encountered with the article of furniture 10 because of its modularity and use of only two main components to achieve a large variety of different configurations.

The configuration of the elongate connectors is such that, when assembled, the characteristics of the article of furniture 10 can be adjusted to suit different users. For example, a seat depth adjustment can be achieved by adjusting a position of the backrest on the seat assembly. Some users prefer a deeper backrest seat, particularly for a more relaxed seating arrangement where the user's legs are on the seat assemblies. Other users prefer a shallower backrest for a more upright seating position. This adjustability is particularly useful for online purchases where a purchaser does not have the opportunity to test the article of furniture.

The appended claims are to be considered as incorporated into the above description.

Throughout this specification, the word "proximal" is intended to mean an orientation that is closest to a user in an operative position. For example, when an elongate connector has a "proximal" end, that end is the end that would be closest to the user manipulating the elongate connector. The word "distal" has an opposite meaning, being that end or that orientation furthest from the user.

When any number or range is described herein, unless clearly stated otherwise, that number or range is approximate. Recitation of ranges of values herein are intended to serve as a shorthand method of referring individually to each separate value falling within the range, unless otherwise indicated herein, and each separate value and each separate subrange defined by such separate values is incorporated into the specification as if it were individually recited herein.

Words indicating direction or orientation, such as "front", "rear", "back", etc, are used for convenience. The inventor(s) envisages that various embodiments can be used in a non-operative configuration, such as when presented for sale. Thus, such words are to be regarded as illustrative in nature, and not as restrictive.

The term "and/or", e.g., "A and/or B" shall be understood to mean either "A and B" or "A or B" and shall be taken to provide explicit support for both meanings or for either meaning.

Throughout the specification, the use of common reference numerals to label similar components in different embodiments is for convenience only and should not be regarded as limiting or as indicating that the respective components are identical.

Throughout this specification, reference to any advantages, promises, objects or the like should not be regarded as cumulative, composite and/or collective and should be regarded as preferable or desirable rather than stated as a warranty.

Throughout this specification, unless otherwise indicated, "comprise," "comprises," and "comprising," (and variants thereof) or related terms such as "includes" (and variants thereof)," are used inclusively rather than exclusively, so that a stated integer or group of integers may include one or more other non-stated integers or groups of integers.

It is to be understood that the terminology employed above is for the purpose of description and should not be regarded as limiting. The described embodiments are intended to be illustrative of the invention, without limiting the scope thereof. The invention is capable of being practised with various modifications and additions as will readily occur to those skilled in the art.

The invention claimed is:

1. An article of furniture that comprises:

a seat assembly that includes:

a rectangular seat support frame; and a rest mount arranged on each of at least two adjacent sides of the rectangular seat support frame;

a rest assembly that includes:

a rectangular rest support frame; and a cushion mounted to the rectangular rest support frame; the cushion having a cushion base portion; and a seat mount arranged on at least one side of the rectangular rest support frame; and at least one elongate connector, the at least one elongate connector having a first portion that is engageable, in a detachable manner, with either of the rest mounts, and a second portion that is engageable, in a detachable manner, with the seat mount, the at least one elongate connector and the rest and seat mounts being configured so that the at least one elongate connector provides at least two orientations of the seat assembly relative to the rest assembly, so that the rest assembly can function either as a backrest or an armrest of the article of furniture;

wherein, in a first orientation of the at least one elongate connector, the rest assembly is engaged with and supported by the at least one elongate connector so that the cushion base portion is elevated with respect to the seat assembly whereby the cushion functions as a backrest; and wherein in a second orientation of the at least one elongate connector the rest assembly is supported by the at least one elongate connector so that the cushion base portion is lowered with respect to the seat assembly whereby the cushion functions as an armrest.

2. The article of furniture as claimed in claim 1, in which the portions of the at least one elongate connector are oriented at an angle relative to each other to govern an orientation of the rectangular rest support frame relative to the rectangular seat support frame.

3. The article of furniture as claimed in claim 1, in which the rectangular seat support frame includes four seat frame members that are connected at their ends to define the sides of the rectangular seat support frame.

4. The article of furniture as claimed in claim 3, in which the seat frame members are configured so that the rectangular seat support frame is square.

5. The article of furniture as claimed in claim 3, in which two opposed seat frame members are longer than the remaining seat frame members so that the rectangular seat support frame is elongate.

6. The article of furniture as claimed in claim 5, in which each rest mount includes at least two spaced sleeve assemblies mounted on a seat frame member of the rectangular seat support frame.

7. The article of furniture as claimed in claim 6, in which each sleeve assembly is configured to receive either of the portions of the at least one elongate connector, with at least one portion of the at least one elongate connector being releasably engageable with the sleeve assembly.

8. The article of furniture as claimed in claim 7, in which the sleeve assembly includes a sleeve and a releasable locking assembly to lock the at least one portion of the at least one elongate connector within the sleeve.

9. The article of furniture as claimed in claim 8, in which the at least one portion of the at least one elongate connector defines one or more recesses or grooves, the releasable locking assembly including a catch mechanism that is configured to engage the, or either of the, recesses or grooves.

10. The article of furniture as claimed in claim 9, in which the catch mechanism includes a spring-operated catch member so that, when the portion is received in the sleeve assembly, the spring-operated catch member can be biased into the, or one of the, recesses or grooves.

11. The article of furniture as claimed in claim 10, in which the, or each, recess or groove is configured so that manipulation of the at least one elongate connector can disengage the spring-operated catch member from the associated recess.

12. The article of furniture as claimed in claim 1, in which the rectangular rest support frame includes four rest frame members in the form of two opposed side frame members, a bottom frame member that interconnects lower ends of the side frame members and an intermediate frame member that interconnects the side frame members.

13. The article of furniture as claimed in claim 12, in which the seat mount includes at least two spaced receiver assemblies mounted on the bottom frame member, each receiver assembly including a sleeve assembly, such that either of the portions of the at least one elongate connector can be received in the sleeve assemblies of the seat mount.

14. The article of furniture as claimed in claim 13, in which each receiver assembly includes a socket assembly, the socket assemblies opening operatively downwardly and being positioned to be in substantial front to back alignment with the sleeve assemblies of the receiver assemblies, in use, the socket assembly and sleeve assembly of each receiver assembly diverging operatively downwardly with the sleeve assembly being positioned in front of the socket assembly.

15. The article of furniture as claimed in claim 1, which includes:

at least two legs, each leg having an elongate body that defines at least one substantially flat face so that two legs can be positioned together with their faces in alignment and facing each other; and a connector arranged on an operatively upper end of each leg so that the leg can be connected to the rectangular seat support frame such that, when two of the rectangular seat support frames are adjacent each other to form a two-seat arrangement, the flat faces of corresponding legs on each of the rectangular support frames are in alignment and face each other.

16. The article of furniture as claimed in claim 1, which includes two corner members arranged on respective sides of the rectangular rest support frame, each corner member having a corner-defining structure and being configured so that the corner--defining structure can bear against an inner surface of a cover of a cushion assembly positioned on the rectangular rest support frame, at a lower edge of the cushion assembly, to neaten the cover at a lower front edge and outside corner of the article of furniture.

17. The article of furniture as claimed in claim 16, in which each corner member is in the form of a swing bracket that is pivotally mounted on each side of the rectangular rest support frame and is pivotal between an inoperative position in which the swing bracket is stowed operatively below the rectangular rest support frame and an operative position in which the swing bracket is pivoted outwardly away from the rectangular rest support frame to bear against the inner surface of the cover of the cushion assembly.

18. The article of furniture as claimed in claim 1, which includes a connecting system for connecting the seat assemblies together, the connecting system including:

an at least one sleeve assembly that is arranged on the rectangular seat support frame, the at least one sleeve assembly including a sleeve that defines a passageway, the at least one sleeve assembly being positioned on the rectangular seat support frame so that two seat assemblies can be positioned adjacent each other with the passageways of respective ones of the at least one sleeve assembly in alignment;

at least one seat connector, the at least one seat connector including a locking portion that is receivable through a respective pair of aligned passageways; and a locking arrangement that is arranged on the at least one sleeve assembly, the locking arrangement and the at least one seat connector being configured so that the locking portion can be releasably locked in the passageway, such that the rectangular seat support frames of the adjacent seat assemblies can be locked to each other, with the locking portion received through aligned passageways, in a releasable manner.

19. The article of furniture as claimed in claim 1, wherein the at least one elongate connector is reversible thereby to provide the at least two orientations of the seat assembly relative to the rest assembly.

20. A kit for an article of furniture, the kit comprising:

a seat assembly that includes:

a rectangular seat support frame; and a rest mount arranged on each of at least two adjacent sides of the rectangular seat support frame;

a rest assembly that includes:

a rectangular rest support frame; and a seat mount arranged on at least one side of the rectangular rest support frame; and at least one elongate connector, the at least one elongate connector having a first portion that is engageable, in a detachable manner, with either of the rest mounts, and a second portion that is engageable, in a detachable manner, with the seat mount, the at least one elongate connector and the rest and seat mounts being configured so that the at least one elongate connector provides at least two orientations of the seat assembly relative to the rest frame-assembly, so that the rest assembly can function either as a backrest or an armrest of the article of furniture;

wherein, in a first orientation of the at least one elongate connector, the rest assembly is supported by the at least one elongate connector so as to be elevated with respect to the seat assembly thereby to function as a backrest; and wherein in a second orientation of the at least one elongate connector the rest assembly is supported by the at least one elongate connector lowered with respect to the seat assembly thereby to function as an armrest.

21. The kit as claimed in claim 20, wherein the at least one elongate connector is reversible thereby to provide the at least two orientations of the seat assembly relative to the rest assembly.

* * * * *